US007470227B2

(12) United States Patent
Sekine et al.

(10) Patent No.: US 7,470,227 B2
(45) Date of Patent: Dec. 30, 2008

(54) PAPER FOLDING APPARATUS AND IMAGE FORMING APPARATUS USING THE SAME

(75) Inventors: Noriaki Sekine, Saitama (JP); Takamichi Fujitate, Saitama (JP); Satoshi Hirata, Saitama (JP); Wataru Kurita, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 53 days.

(21) Appl. No.: 11/208,760

(22) Filed: Aug. 23, 2005

(65) Prior Publication Data

US 2006/0128543 A1 Jun. 15, 2006

(30) Foreign Application Priority Data

| | | |
|---|---|---|
| Aug. 24, 2004 | (JP) | 2004-244491 |
| Aug. 26, 2004 | (JP) | 2004-246234 |
| Mar. 15, 2005 | (JP) | 2005-073481 |
| May 24, 2005 | (JP) | 2005-150466 |
| May 31, 2005 | (JP) | 2005-159957 |

(51) Int. Cl.
*B31F 1/10* (2006.01)
*B31F 7/00* (2006.01)

(52) U.S. Cl. ..... 493/434; 493/421; 493/416

(58) Field of Classification Search ..... 493/434, 493/413, 414, 415, 419, 420, 421, 451
See application file for complete search history.

(56) References Cited

U.S. PATENT DOCUMENTS

| | | | | |
|---|---|---|---|---|
| 4,493,690 | A * | 1/1985 | Niemiro et al. | 493/444 |
| 4,643,705 | A * | 2/1987 | Bober | 493/444 |
| 4,781,667 | A * | 11/1988 | Kitai | 493/359 |
| 5,044,617 | A * | 9/1991 | Roberts | 270/45 |
| 5,169,376 | A * | 12/1992 | Ries et al. | 493/445 |
| 5,695,182 | A | 12/1997 | Sekine | |
| 5,702,341 | A * | 12/1997 | Keilhau | 493/426 |
| 5,718,313 | A | 2/1998 | Sekine | |
| 5,738,620 | A * | 4/1998 | Ebner et al. | 493/445 |
| 5,769,774 | A * | 6/1998 | Beck et al. | 493/421 |
| 5,957,447 | A | 9/1999 | Sekine | |
| 6,276,677 | B1 * | 8/2001 | Hommochi et al. | 270/32 |
| 6,592,506 | B1 * | 7/2003 | Lyga | 493/424 |
| 6,719,680 | B2 * | 4/2004 | Hosoya et al. | 493/324 |
| 7,052,005 | B2 * | 5/2006 | Yamakawa et al. | 270/37 |
| 2002/0135821 | A1 | 9/2002 | Sekine | |

FOREIGN PATENT DOCUMENTS

| | | |
|---|---|---|
| JP | 2524155 | 11/1996 |
| JP | 2849914 | 11/1998 |
| JP | 3173121 | 3/2001 |

* cited by examiner

*Primary Examiner*—Paul R Durand
(74) *Attorney, Agent, or Firm*—Oblon, Spivak, McClelland, Maier & Neustadt, P.C.

(57) ABSTRACT

A paper folding apparatus which is used as a finisher equipment of an image forming apparatus. The paper folding apparatus can securely fold a sheet of paper, optionally change the starting position for folding a leading edge of the paper, and can produce a thin sheaf of papers even after the papers are folded, without causing the shape of the folded end section fluctuate even in the case of strong paper such as heavy paper.

27 Claims, 54 Drawing Sheets

PAPER FOLDING APPARATUS AND IMAGE FORMING APPARATUS USING THE SAME

BACKGROUND OF THE INVENTION

1. Field of the Invention

The present invention relates to an image forming apparatus such as a copying machine, printer, facsimile machine, and digital multifunctional device, and more particularly to improvement of a paper folding apparatus which is used as a finisher and the like of the image forming apparatus.

2. Description of the Related Art

There has been conventionally known a paper folding apparatus which has a function of forming any fold line at any position on a sheet of paper such as a copier paper, recording paper, and printing paper ejected from an image forming apparatus of an electrophotographic system such as a copying machine, printer, and facsimile machine. For example, in an electrophotographic copying machine for copying a large-size draft such as a draft of a drawing, the draft is usually copied on large-sized coping paper such as A0 or A1 paper. Keeping or handling these large-sized copier papers as they are takes up a lot of storage space, or causes inconvenience in handling, thus the papers are usually folded and stored. However, folding these copying papers by hand generally requires a considerable amount of time, and sometimes folding the papers takes several times longer than copying. For this reason, there has been developed a paper folding apparatus which is disposed at a ejection path of a copying machine, and there has been known a paper folding apparatus for folding an A0 sized drawing into an A4 size.

In the case of folding large-size paper into small-size paper using such a paper folding apparatus, when filing the folded paper in a file or the like, the edge of the paper is also filed. Also, it may be necessary to change a starting position for folding the edge due to limitations of the image information on the paper. In order to prevent such folding of edges or to form a most appropriate fold line corresponding to the image on the paper, it is necessary for an operator to fold the edges of the folded paper again by hand, and then file the paper by means of a staple or paper punch to create a file. However, the burden on the operator is increased if folding of the edges is manually performed on every single piece of paper. Therefore, there is proposed an edge folding device which can automatically fold in the edges of paper and reduce the burden placed on the operator.

For example, Japanese Patent Application No. 2849914 discloses a technology in a paper folding apparatus in which at least a pair of rotating members which are driven in mutual synchronization are provided along a paper conveying path, and a groove and a protrusion for forming a fold line on paper are provided in the rotating members respectively. In this conventional technology, however, since each of the rotating members rotates, slips a sheet of paper therebetween, and thereby form a fold line, and papers are stacked along the fold lines thereof into a paper storage portion provided below each of the rotating members, the problem is that it is difficult form a fold line nicely.

Further, Japanese Patent Application No. 3173121, for example, discloses an edge folding device which comprises paper conveying means for conveying paper, edge fold-in means having an edge folding member capable of vertical movement between a first position in which an edge of the paper is scooped up and a second position in which the edge of the scooped paper is folded in, paper detecting means for detecting an arrival of the paper in the vicinity of the edge folding member, edge fold controlling means for controlling so as to set the edge folding member at a constant timing after arrival the paper is detected by the paper detecting means, set the edge folding member in the second position at a constant timing after an edge of the paper is loaded on edge folding member, and fold in the edge of the paper under the second position, and edge fold-up means having a pair of fold rollers for nipping the paper whose edge is folded in and folding the edge upward. However, as described above, the position for starting to fold the edge is determined according to the shape of the edge folding member which is capable of vertical movement of scooping up the fold line formed on the folded edge, thus a user cannot change the position for starting to fold the edge at the leading edge of the paper, even if he wants to for the reason of filing or of the image information on the paper. There was no way but to replace the folding member with the one having a different shape in order to change the position for starting to fold the edge.

Furthermore, Japan Registration of Utility Model No. 2524155 discloses a technology for using and end section folding member to fold upward an end section of paper conveyed by paper conveying means, and forming a fold line on the end section of the paper by inserting a curved part of the folded-up paper into a nip portion of a pair of rollers. In this conventional technology, however, although the end portion of the is folded up by the end section folding member which is capable of vertical movement of scooping up an end section of paper, the curved part of the folded up paper is inserted in the nip portion of the pair of rollers, thus inserting into the nip portion was difficult, the angle of the fold line fluctuates, and the paper is bent due to wrinkles generated on the paper.

SUMMARY OF THE INVENTION

An object of the present invention is to provide a paper folding apparatus which can securely fold paper, and an image forming apparatus which uses the paper folding apparatus.

Another object of the present invention is to provide a paper folding apparatus which can optionally change a position for starting to fold an edge of a leading edge of a paper, and an image forming apparatus which uses the paper folding apparatus.

Yet another object of the present invention is to provide a paper folding apparatus which does not cause fluctuation on the shape of a folded end section even in the case of a sheet of hard paper such as heavy paper, and can produce a thin sheaf of papers even when stacking the folded parts of the papers.

A paper folding apparatus of the present invention comprises a paper conveying device for conveying papers; a first folding device for forming a fold line on the paper; and a second folding device for folding the paper on which a fold line is formed by the first folding device.

An image forming apparatus of the present invention comprises a paper folding apparatus. The paper folding apparatus comprises a paper conveying device for conveying papers; a first folding device for forming a fold line on the paper; and a second folding device for folding the paper on which a fold line is formed by the first folding device.

A paper folding apparatus of the present invention comprises a paper conveying device for conveying papers; a paper folding device for forming a fold line on the paper conveyed by the paper conveying device; a fold starting position changing device for changing a fold starting position in which folding of paper is started by the paper folding device according to the difference in the size of the paper; and a control device.

An image forming apparatus of the present invention comprises a paper folding apparatus. The paper folding apparatus comprises a paper conveying device for conveying papers, a paper folding device for forming a fold line on the paper conveyed by the paper conveying devices, a fold starting position changing device for changing a fold starting position in which folding of paper is started by the paper folding device according to the difference in the size of the paper, and a control device. Changing the fold starting position by means of the fold starting position changing means can be implemented by operation from an operation portion provided in the image forming apparatus.

An image forming apparatus of the present invention comprises a paper forming apparatus. The paper forming apparatus comprises a paper conveying device for conveying papers, a paper folding device for forming a fold line on the paper conveyed by the paper conveying device, a fold starting position changing device for changing a fold starting position in which folding of paper is started by the paper folding device according to the difference in the size of the paper, and a control device.

A paper folding apparatus of the present invention comprises a folding device having two pairs of fold rollers for forming a fold line on a paper which is conveyed, and a convex member for forming a fold line on the paper. A nip of the two pairs of fold rollers is disposed at an angle of the fold line, and the convex member pushes the paper into the nip of the pairs of fold rollers at a position of the fold line of the paper, according to the timing at which the paper is conveyed to the nip of the two pairs of fold rollers.

A paper conveying apparatus of the present invention comprises a paper folding apparatus. The paper folding apparatus comprises a folding device having two pairs of fold rollers for forming a fold line on a sheet of paper which is conveyed, and a convex member for forming a fold line on the paper. A nip of the two pairs of fold rollers is disposed at an angle of the fold line, and the convex member pushes the paper into the nip of the pairs of fold rollers at a position of the fold line of the paper, according to the timing at which the paper is conveyed to the nip of the two pairs of fold rollers.

A paper processing apparatus of the present invention comprises a paper folding apparatus. The paper folding apparatus comprises a folding device having two pairs of fold rollers for forming a fold line on a sheet of paper which is conveyed, and a convex member for forming a fold line on the paper. A nip of the two pairs of fold rollers is disposed at an angle of the fold line, and the convex member pushes the paper into the nip of the pairs of fold rollers at a position of the fold line of the paper, according to the timing at which the paper is conveyed to the nip of the two pairs of fold rollers.

An image forming apparatus of the present invention comprises a paper folding apparatus. The paper folding apparatus comprises a folding device having two pairs of fold rollers for forming a fold line on a sheet of paper which is conveyed, and a convex member for forming a fold line on the paper. A nip of the two pairs of fold rollers is disposed at an angle of the fold line, and the convex member pushes the paper into the nip of the pairs of fold rollers at a position of the fold line of the paper, according to the timing at which the paper is conveyed to the nip of the two pairs of fold rollers.

An image forming apparatus of the present invention comprises a paper processing apparatus integrally or separately. The paper processing apparatus comprises a paper folding apparatus which comprises a folding device having two pairs of fold rollers for forming a fold line on a sheet of paper which is conveyed, and a convex member for forming a fold line on the paper. A nip of the two pairs of fold rollers is disposed at an angle of the fold line, and the convex member pushes the paper into the nip of the pairs of fold rollers at a position of the fold line of the paper, according to the timing at which the paper is conveyed to the nip of the two pairs of fold rollers.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
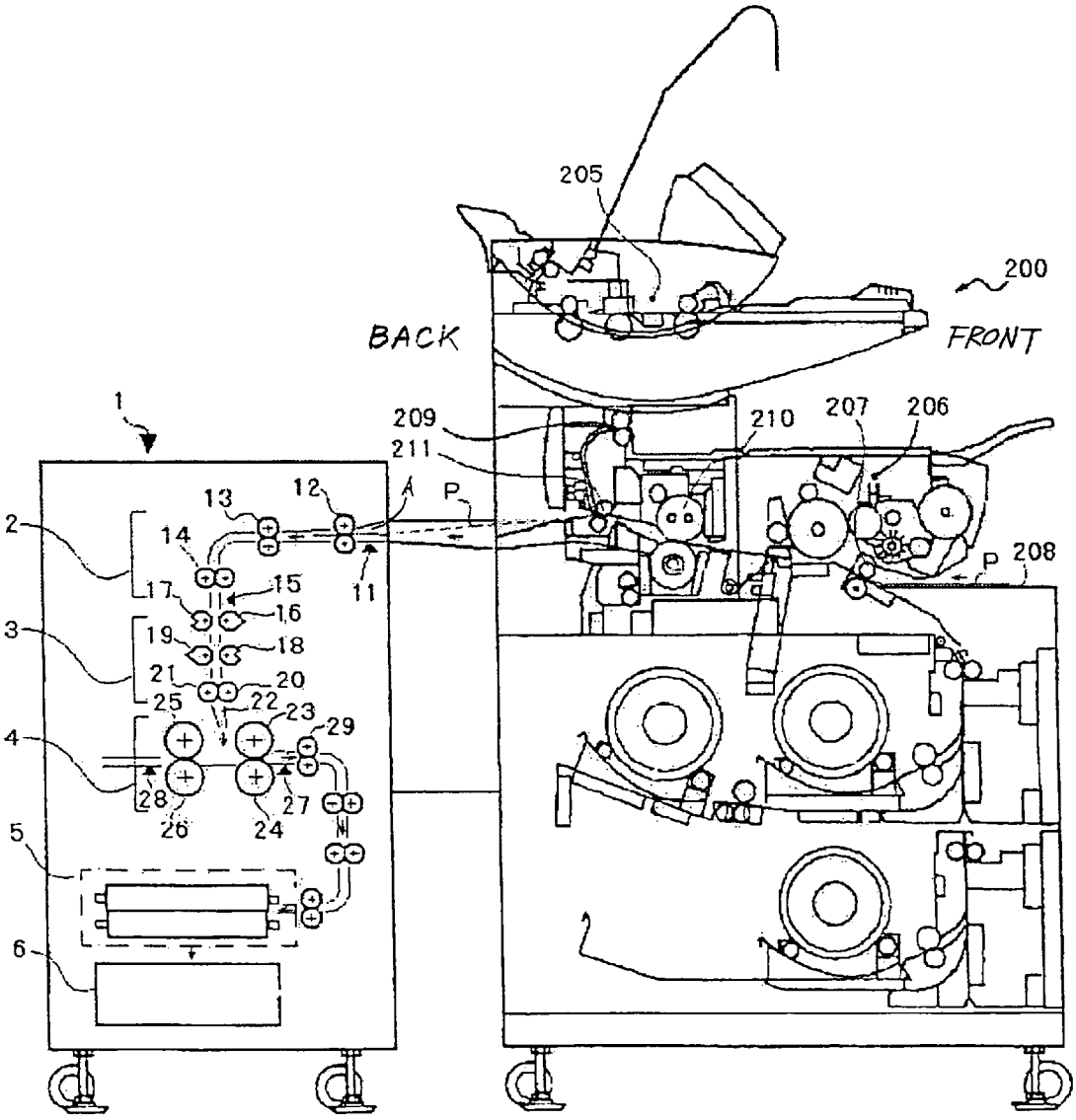
FIG. 1 a side view showing a schematic configuration of a copying machine and a paper folding apparatus according to a first embodiment of the present invention.

Preferred embodiments of the present invention will be described hereinafter. It is to be noted the reference numerals used in each embodiment are independent of the reference numerals of the other embodiments, i.e., the same reference numerals do not always designate the same structural elements.

First Embodiment

First embodiment is described in detail with reference to FIGS. 1 through 12.

First, the entire configuration of a copying machine and paper folding apparatus as an example of an image forming apparatus of the present embodiment is explained with reference to FIG. 1.

As shown in FIG. 1, a paper folding apparatus 1 of the present embodiment is provided in the immediate vicinity of a copying machine device main body 200 in which image formation is carried out. The paper folding apparatus 1 is constituted by a paper conveying portion (paper conveying means) 2 for conveying paper which is ejected from the copying machine device main body 200, a first bellows fold portion (first folding means) 3 for forming a fold line in a vertical direction of the paper with respect to the conveyance direction, a second bellows fold portion (second folding means) 4 for folding the paper in bellows along the fold line formed by the first bellows fold portion 3, a cross fold portion 5 for folding the paper, which is folded in bellows by the second bellows fold portion 4, into A4 sized paper in the vertical direction, and a stacker portion 6 for ejecting the paper folded into A4 size and stacking same.

In the copying machine device main body 200, an image reading device 205 is disposed, below which a manual paper feeding tray 208 is disposed. Paper which is set on the manual paper feeding tray 208 is suspended by a resist roller 207, and is fed to an imaging unit 206 according to the timing. The imaging unit 206 is designed such that a latent image corresponding to the image data is formed on a photoreceptor, the obtained latent image is developed by toner, and the toner is transferred onto the paper and fixed by a fixing device 210. The paper P on which the toner is fixed by the fixing device 210 is then ejected to a paper insertion slot A of the paper folding apparatus 1 by a paper ejection roller 211. Thereafter, the paper P is conveyed to the first bellows fold portion 3 by the paper conveying portion 2, a fold line is formed in the vertical direction with respect to the conveyance direction of the paper P, and then the paper is folded in bellows along the fold line by the second bellows fold portion 4. Further, the paper P which is folded in bellows is conveyed in the vertical direction with respect to the conveyance direction at the time of folding in bellows, folded into A4 sized paper by the cross fold portion 5, and ejected and stacked by the stacker portion 6.

Next, configurations of the bellows fold portions are explained with reference to FIGS. 1 and 2.

The first bellows fold portion 3 comprises a first pair of first rollers (first pair of rotating members), a second pair of fold rollers (second pair of rotating members) which are provided downstream of the paper conveyance direction of the first pair of fold rollers, wherein the first pair of fold rollers have a rotating roller (rotating member) 16 with a protrusion 16*c*, and another rotating roller (rotating member) 17 with a groove 17*c*, while the second pair of fold rollers have a rotating roller (rotating member) 19 with a protrusion 19*c* and another rotating roller (rotating member) 18 with a groove 18*c*. Moreover, a pair of conveying rollers 20, 21 are provided downstream of the second pair of fold rollers so that paper on which a fold line is formed is conveyed to the second bellows fold portion 4.

The second bellows fold portion 4 is provided with a paper switching port 22 provided movably in a lateral direction, and a second pair of right fold rollers 23, 24 and as second pair of left fold rollers 25, 26 are provided downstream o the paper switching port 22. In this second bellows fold portion 4 the paper on which the fold line is formed is folded.

Next, a configuration of a control system of the present embodiment is explained.

Figure 11:
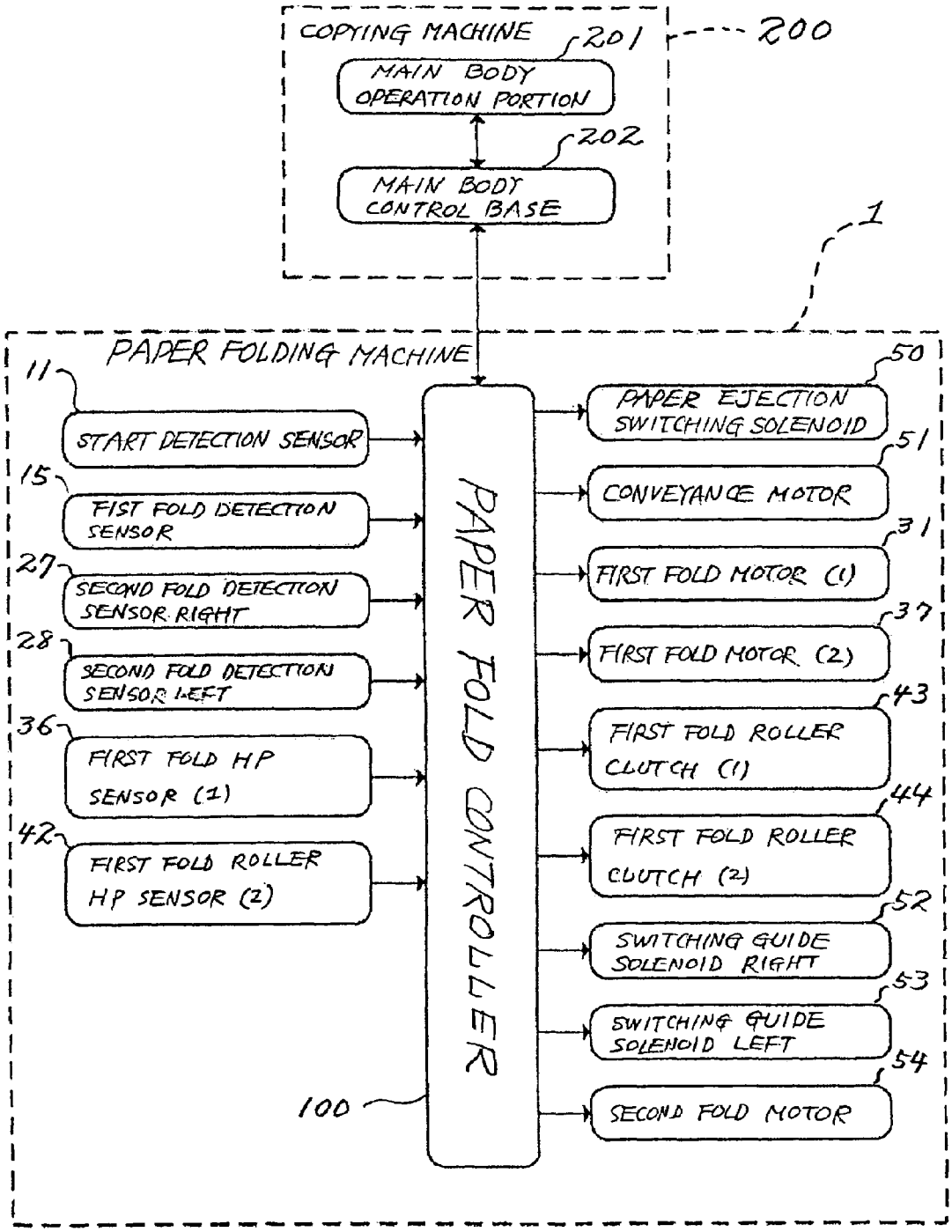
FIG. 11 is a block diagram showing a configuration of a control system according to the first embodiment.

As shown in FIG. 11, the copying machine 200 has a main body operation portion 201 and a main body control base 202, and is connected to a paper fold controller 100 of the paper folding apparatus 1. In the paper folding apparatus 1, each detection sensor (start detection sensor 11, first fold detection sensor 15, second right fold detection sensor 27, second left fold detection sensor 28, first fold roller HP sensor (1) 36, and first fold roller HP sensor (2) 42) is connected to the paper fold controller 100. Moreover, the paper fold controller 100 is connected to a paper ejection switching solenoid 50, conveyance motor 51, first fold motor (1) 31, first fold motor (2) 37, first fold roller clutch (1) 43, first fold roller clutch (2) 44, right switching guide solenoid 52, left switching guide solenoid 53, and second fold motor 54.

Figure 12:
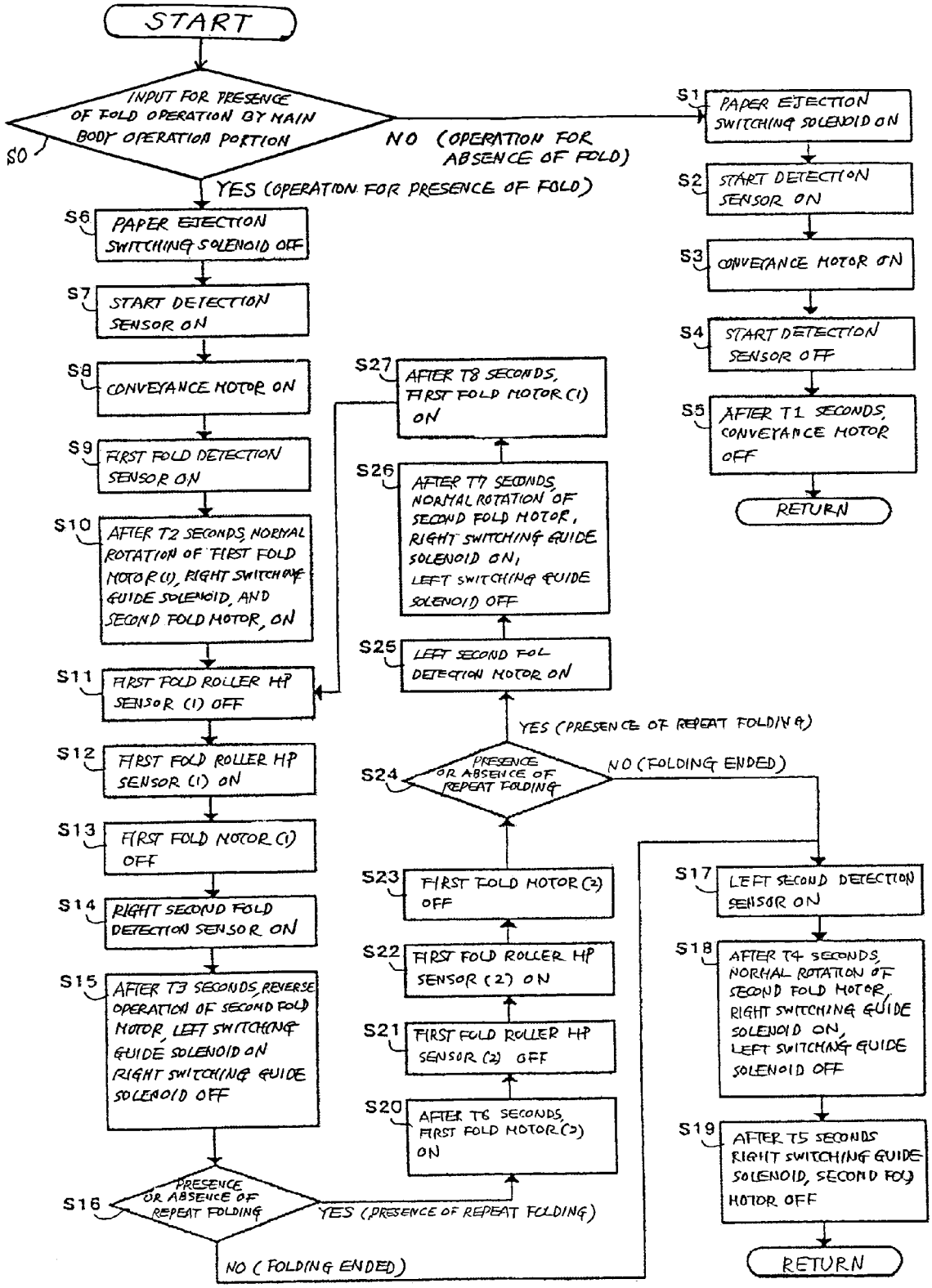
FIG. 12 is a flow chart showing the conveyance movement of the paper according to the first embodiment.

Next, the function and effect of the paper folding apparatus in the present embodiment are described using FIGS. 3 through 10 and the flow chart of FIG. 12.

Figure 3:
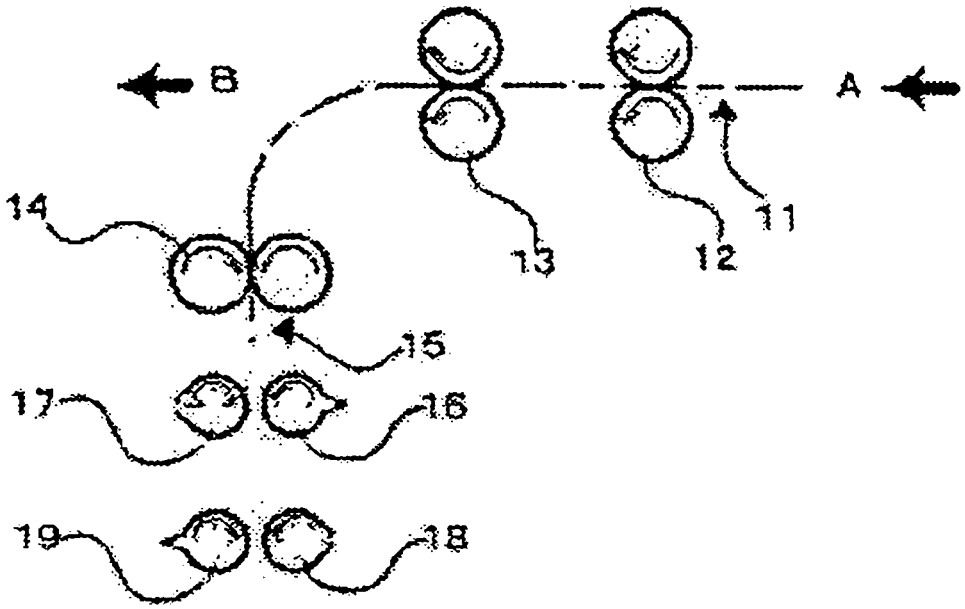
FIG. 3 is a side view showing a state in which paper is conveyed to a first bellows portion in a conveyance movement of the paper in a bellows fold portion according to the first embodiment.
Figure 4:
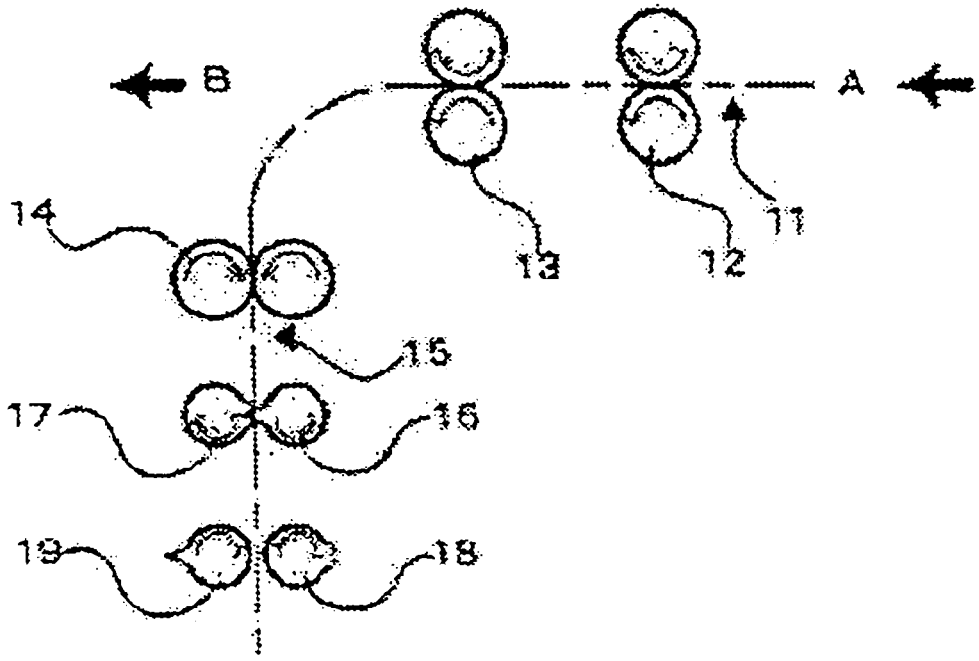
FIG. 4 is a side view showing a state in which a fold line is formed on the paper by a pair of fold rollers in the conveyance movement of the paper in the bellows fold portion.

As shown in FIG. 3, the paper conveyed from the copying machine main body 200 is inserted into the paper insertion slot A of the paper folding apparatus 1, thereafter, when a leading edge of the paper P reaches on the start detection sensor 11, rotation operation of the conveyance motor 51 is started, and conveyance of the paper P is started by a pair of conveying rollers 12, 13. When folding of the paper is not performed, the paper ejection switching solenoid 50 is operated to turn around a paper ejection switching claw thereof, whereby the paper is ejected from an ejection port B, and the conveyance motor 51 is stopped after t1 seconds (steps S1 through S5 in the flow chart of FIG. 11). When folding of the paper is performed, the paper ejection switching solenoid 50 is not operated, and, as shown in FIG. 4, the paper P passes through a pair of conveying rollers 14 and is conveyed to the first bellows fold portion 3 (S6 through S8). After t2 seconds after the paper P reaches on the first fold detection sensor 15, rotation operation of the first fold motor (1) 31 is started, a pair of fold rollers 16, 17 are driven (S9 and S10), and the paper is slipped between the protrusion provided straight in the horizontal direction in the rotating roller 16 and the groove provided straight in the horizontal direction in the rotating roller 17, whereby a fold line D is formed in the form of a mountain. It should be noted that changing the width of the fold can be performed by changing the start timing t2 of the rotation operation of the first fold motor (1) 31 after the leading edge of the paper P reaches on the first fold detection sensor 15.

Figure 9:
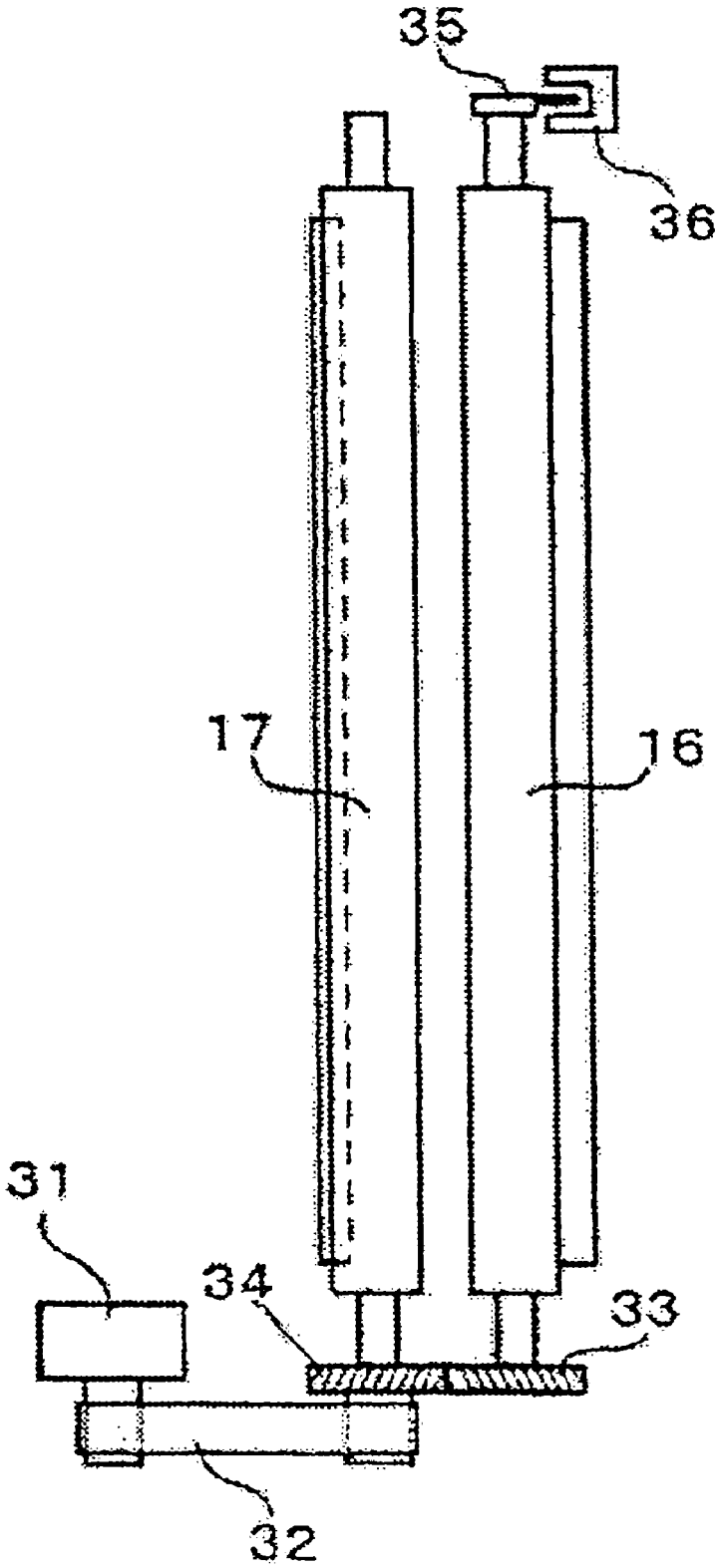
FIG. 9 is a plan view showing a pair of rollers (first pair of fold rollers) located upstream of first folding means.
Figure 10:
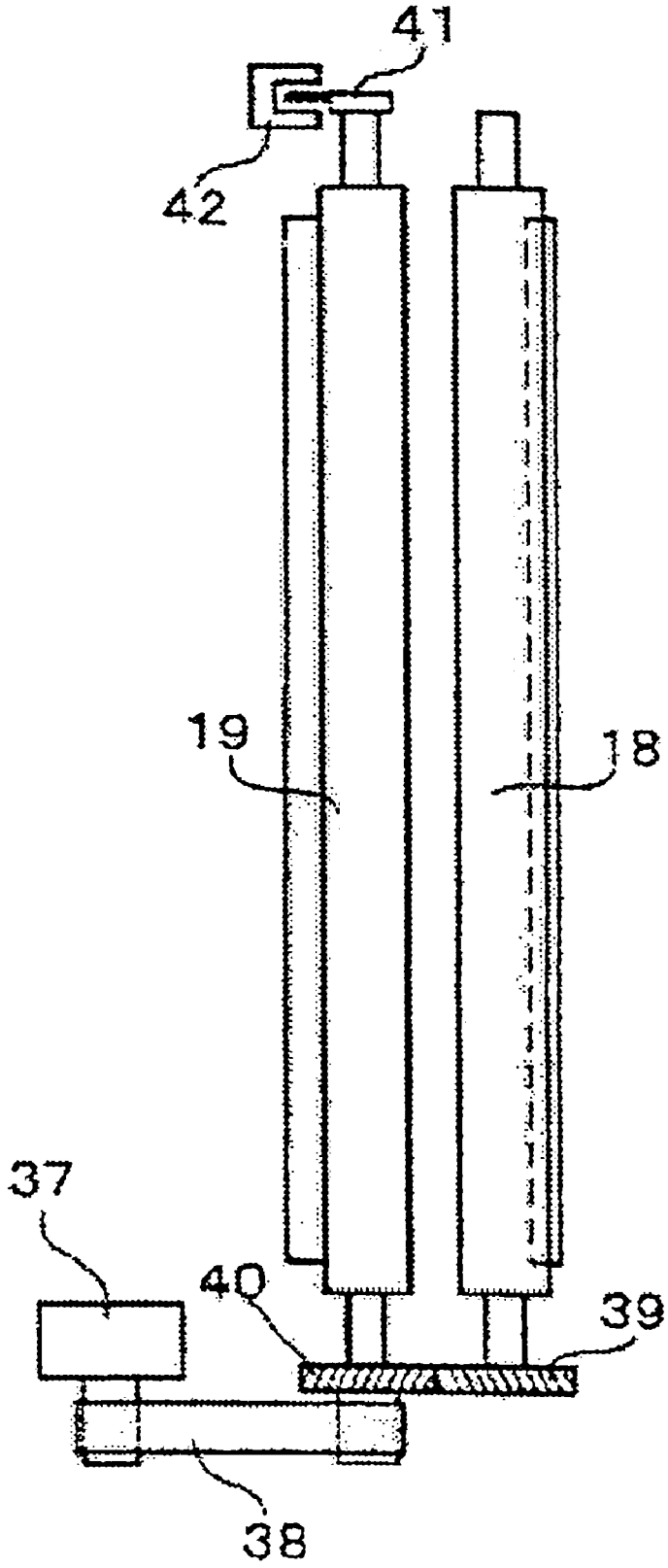
FIG. 10 is a plan view showing a pair of rollers (second pair of fold rollers) located downstream of the first folding means.

In addition, the first fold motor (1) 31 is stopped by a first fold roller HP detection plate 35, which is located at an end portion of the first pair of fold rollers 16, 17 as shown in FIG. 9, and the first fold roller HP sensor (1) 36. When rotation operation of the first fold motor (1) 31 is started, the first pair of fold rollers 16, 17 are driven by means of a first fold roller driving belt 32, right drive gear 33, and left drive gear 34. Since the first fold roller HP detection plate 35 also is rotated at the same time, the first fold roller HP sensor (1) 36 transmits an ON signal to rotate the first fold roller HP detection plate 35 once, and the first fold roller HP sensor (1) 36 is then protected from light by the first fold roller HP detection plate 35 again, and transmits an OFF signal, thereby stopping the rotation operation of the first fold motor (1) 31 (S11 through S13).

Figure 5:
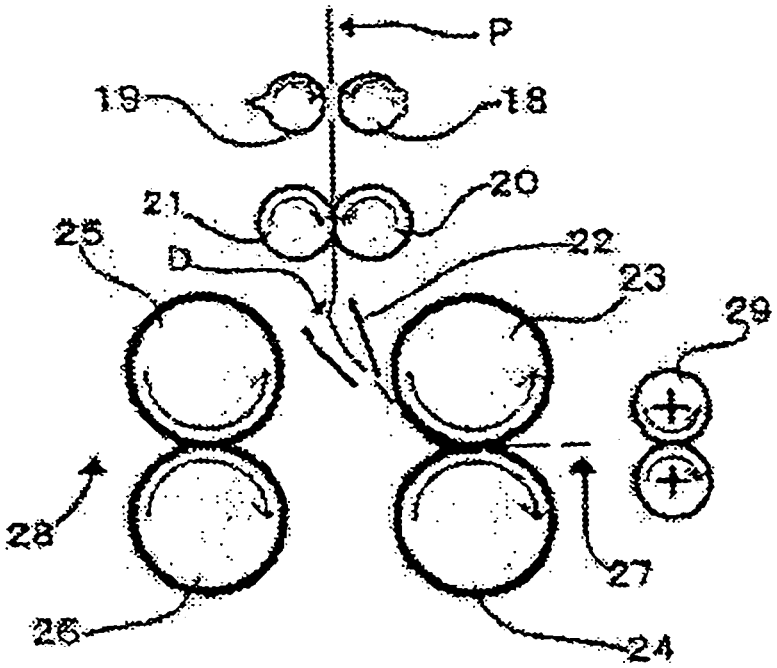
FIG. 5 is a side view showing a state in which the paper is conveyed to a second bellows portion in the conveyance movement of the paper in the bellows fold portion.

After the fold line D is formed by the first bellows fold portion 3, the paper P is folded by the second bellows fold portion 4 along the fold line D. The second bellows fold portion 4 is configured such that a pair of rollers are arranged farther apart from each other, in which the paper P travels back and forth between these rollers and thereby is folded in bellows. After t2 seconds after the leading edge of the paper P reaches on the first fold detection sensor 15, the ON operation of the right switching guide solenoid 52 which is not shown and the normal rotation operation of the second fold motor 54 are started simultaneously (S1). The, paper P is then guided to the paper switching port 22 as shown in FIG. 5, and applied between the second right fold rollers 23, 24, and then the leading edge of the paper is conveyed to the second right fold detection sensor 27 (FIG. 5).

Figure 6:
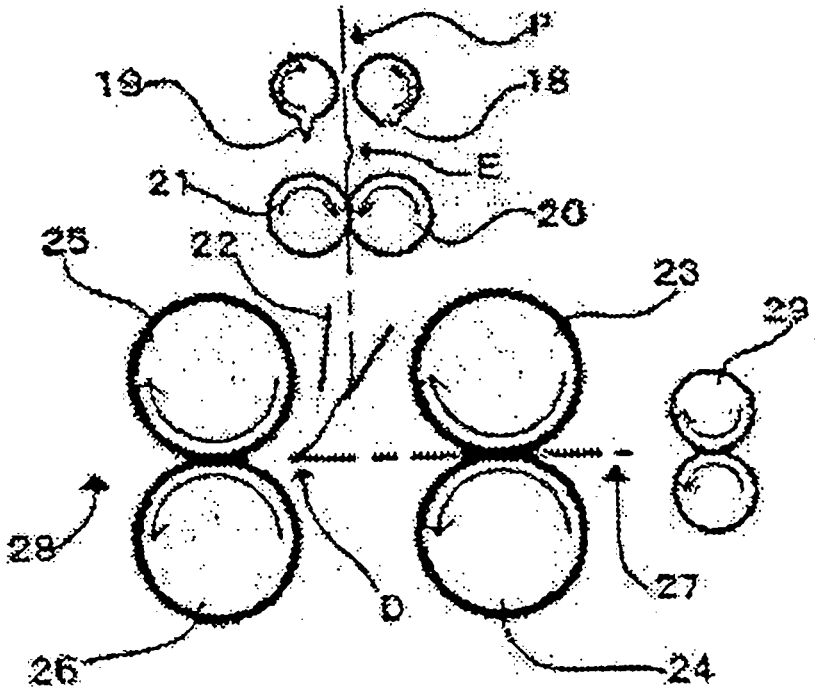
FIG. 6 is a side view showing a state in which the paper is folded in the second bellows portion in the conveyance movement of the paper in the bellows fold portion.

After t3 seconds after the leading edge of the paper P reaches the second right fold detection sensor 27, the OFF operation of the right switching guide solenoid 52 is started, the paper switching port 22 is directed to the left by the ON operation of the left switching guide solenoid 53, the reverse operation of the second fold motor 54 is started, and, as shown in FIG. 6, the paper P is conveyed by the conveying force from the pair of conveying rollers 14 and the conveying force from the second pair of right fold rollers 23, 24 while forming a loop where the fold line D as the leading edge, the fold line D being formed by the first bellows fold portion 3, and is then applied to the second pair of left fold rollers 25, 26, starting from the fold line D (S 14 and S15).

Figure 7:
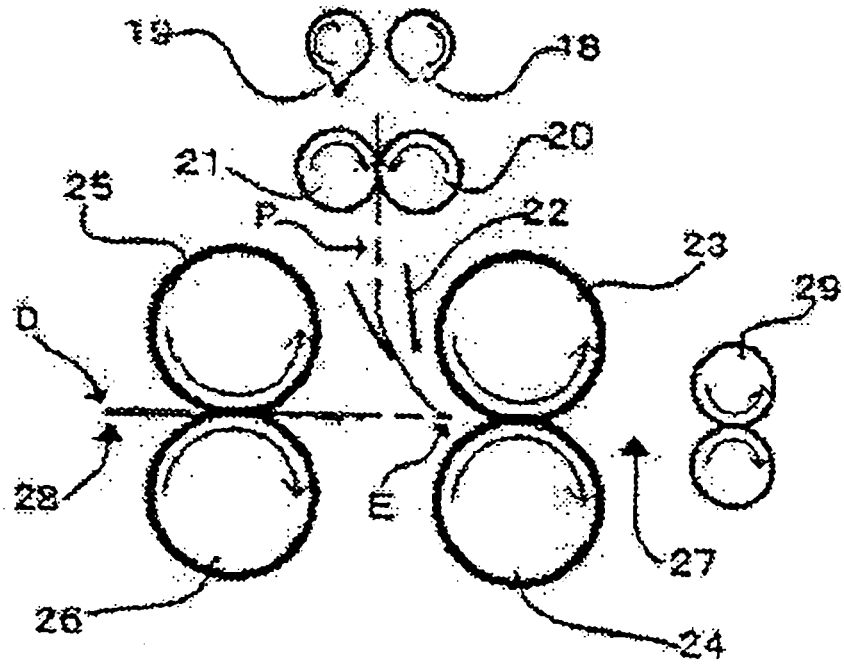
FIG. 7 is a side view showing the conveyance movement of the paper in the bellows fold portion, in which the paper is repeatedly folded in the second bellows portion.
Figure 8:
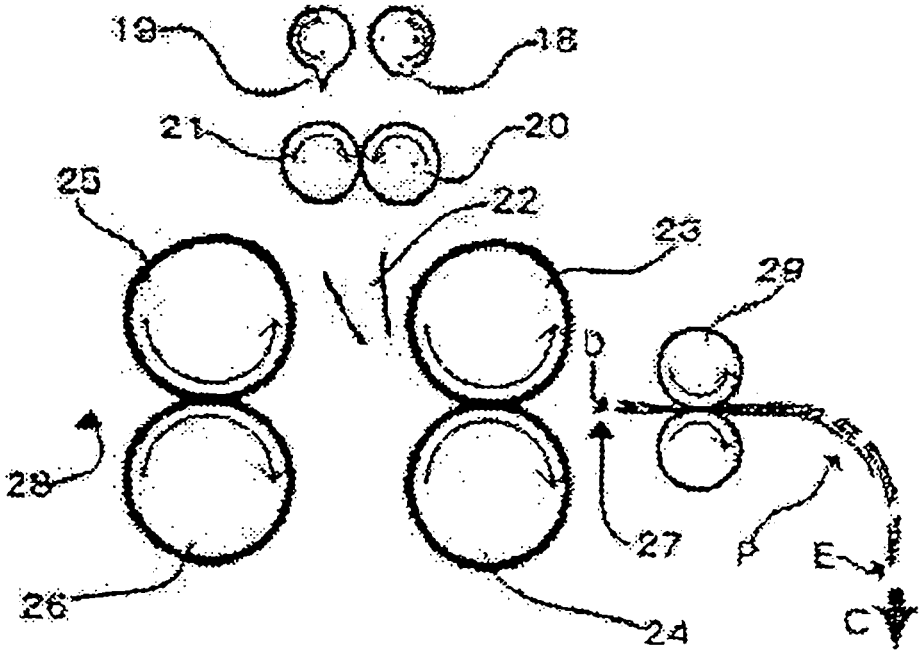
FIG. 8 is a side view showing the conveyance movement of the paper in the bellows fold portion, in which the folded paper is conveyed to a cross fold portion.

Accordingly, as shown in FIG. 7, the paper P is constantly conveyed while being folded completely along the fold line D as the base, and conveyed to second left fold detection sensor 28. After t4 seconds since the sensor is reached, the paper switching port 22 is directed to the right by the OFF operation of the left switching guide solenoid 53 and the ON operation of the right switching guide solenoid 52, and the normal rotation operation of the second fold motor 54 is started. When folding is not performed repeatedly, the paper P is kept folded in half, and conveyed from an ejection port C to the cross fold portion 5 by the second pair of right fold rollers 23, 24 and a pair of paper conveying rollers 29, as shown in FIG. 8, and after the rear edge of the paper P passes over the second right fold detection sensor 27, folding in bellows is ended by the OFF operation of the right switching guide solenoid 52 and discontinuation of the operation of the second fold motor 54 (S16 through S19).

When folding is performed repeatedly, the rotation operation of the first fold motor (2) 37 is started before the paper is applied to the second pair of left fold rollers 25, 26 as shown in FIG. 7, the second pair of fold rollers 18, 19 are driven, and the paper is slipped between the protrusion provided straight in the horizontal direction in the rotating roller 19 and the groove provided straight in the horizontal direction in the other rotating roller, whereby a fold line E is formed in the form of a valley in the opposing direction of the fold line D (S16 through S23).

Thereafter, the fold line D is applied to the second pair of left fold rollers 25, 26 in the same manner as above, the paper is conveyed while being folded, the paper switching port 22 is directed to the right by the OFF operation of the left switching guide solenoid 53 and the ON operation of the right switching guide solenoid 52 after t3 seconds after the second left fold detection sensor 28 is reached, the normal rotation operation of the second fold motor 54 is started, and the paper P is conveyed by the conveying force from the pair of conveying rollers 14 and the conveying force from the second pair of left fold rollers 25, 26 while forming a loop where the fold line E as the leading edge, the fold line E being formed by the first bellows fold portion 3, and is then applied to the second pair of right fold rollers 23, 24, starting from the fold line E.

Then, When folding is not performed repeatedly, the paper is conveyed from an ejection port C to the cross fold portion 5 by the pair of paper conveying rollers 29, and after the rear edge of the paper P passes over the second right fold detection sensor 27, folding in bellows is ended by the OFF operation of the right switching guide solenoid 52 and discontinuation of the operation of the second fold motor 54 (S24 through S19). Further, when folding of A0 large-sized paper or the like is performed repeatedly, the directions of the fold lines of the papers P are formed alternately by repeatedly performing the above operations, thus the papers can be folded in bellows.

As described above, since the paper folding apparatus according to the present embodiment is characterized in having the first bellows fold portion 3 which forms a fold line on paper, and the second bellows fold portion 4 which further folds the paper along the fold line formed by the first bellows fold portion 3, even in the case of a large-sized paper, a fold line with a desired size can be formed securely, and a thin sheaf of folded papers can be produced.

Furthermore, the first bellows fold portion 3 comprises the first pair of fold rollers 16, 17 and the second pair of fold rollers 18, 19, and is characterized in forming two kinds of fold lines, i.e. angled fold line and valley fold line, by inserting a sheet of paper between the rollers, thus it takes only one of the pairs of the fold rollers to fold the paper in bellows, whereby the configuration can be made small and inexpensively.

Various modifications of the first embodiment are described next; however in the description, like reference numerals are used to indicate the portions that achieve the same functional effects as in the abovementioned portions of the present embodiment, thus the detailed explanations for those portions are omitted accordingly.

Figure 13:
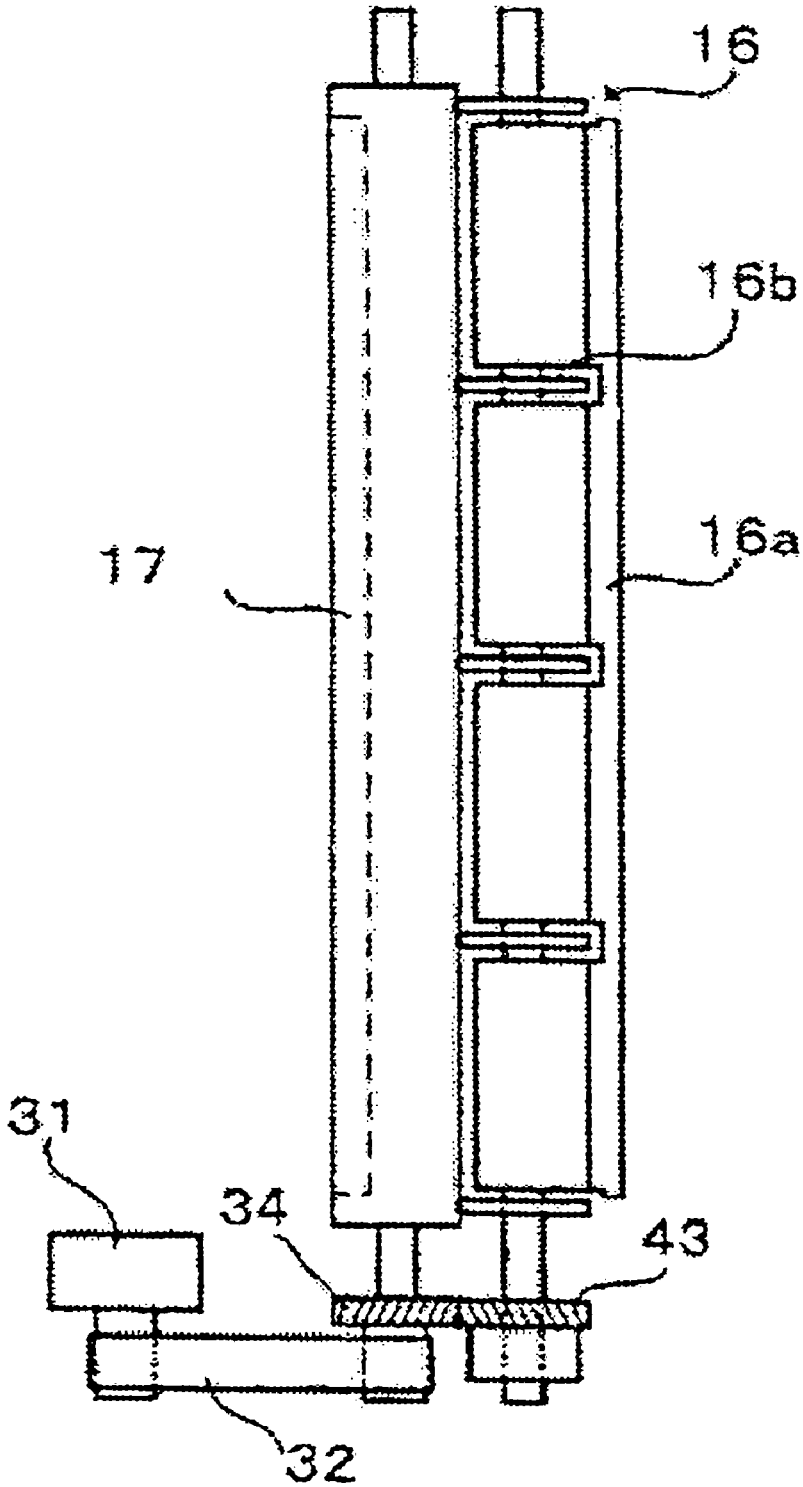
FIG. 13 is a plan view of the first pair of fold rollers according to a first modification of the first embodiment.
Figure 14:
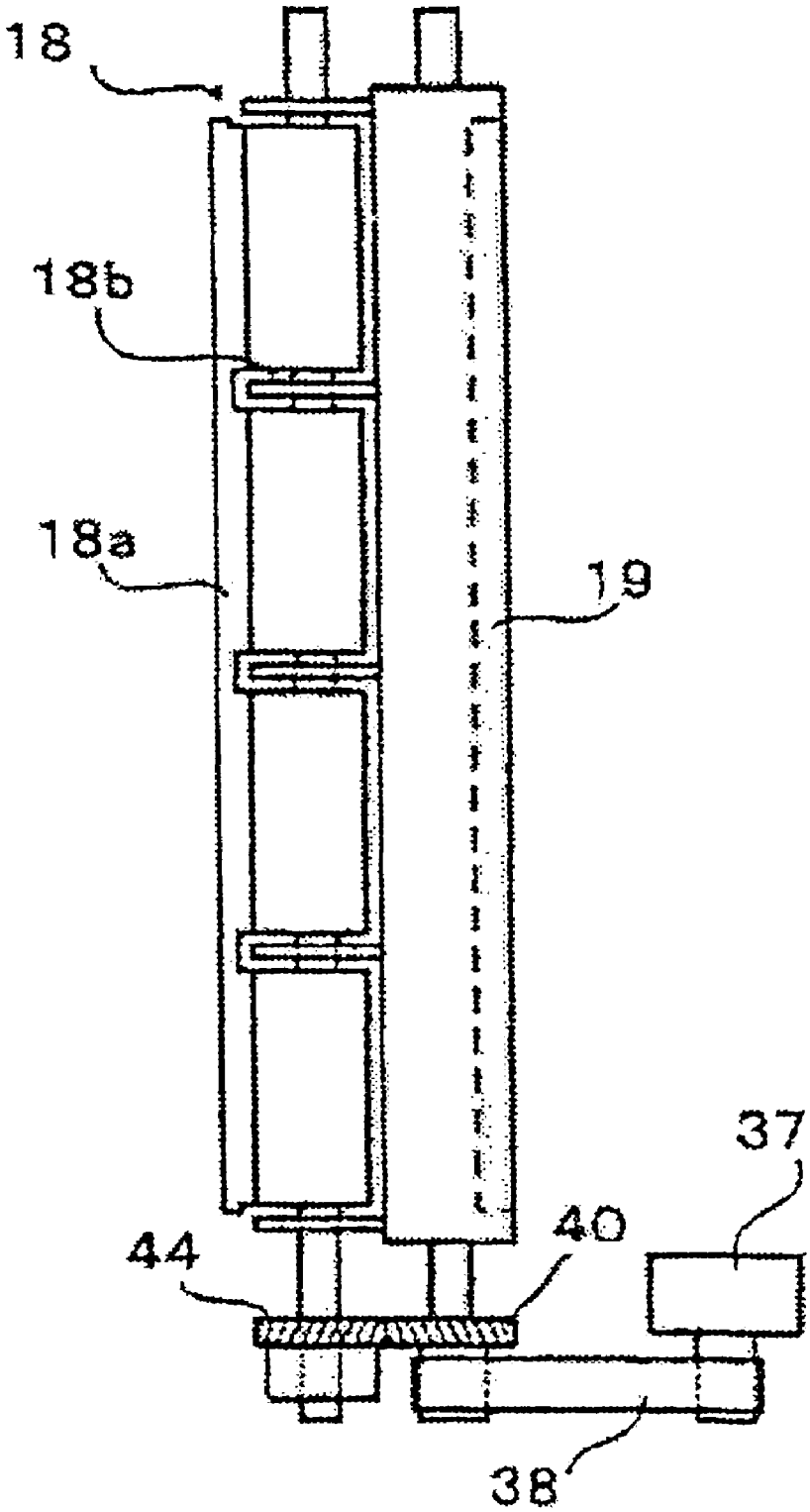
FIG. 14 is a plan view showing the second pair of fold rollers according to the first modification.
Figure 15:
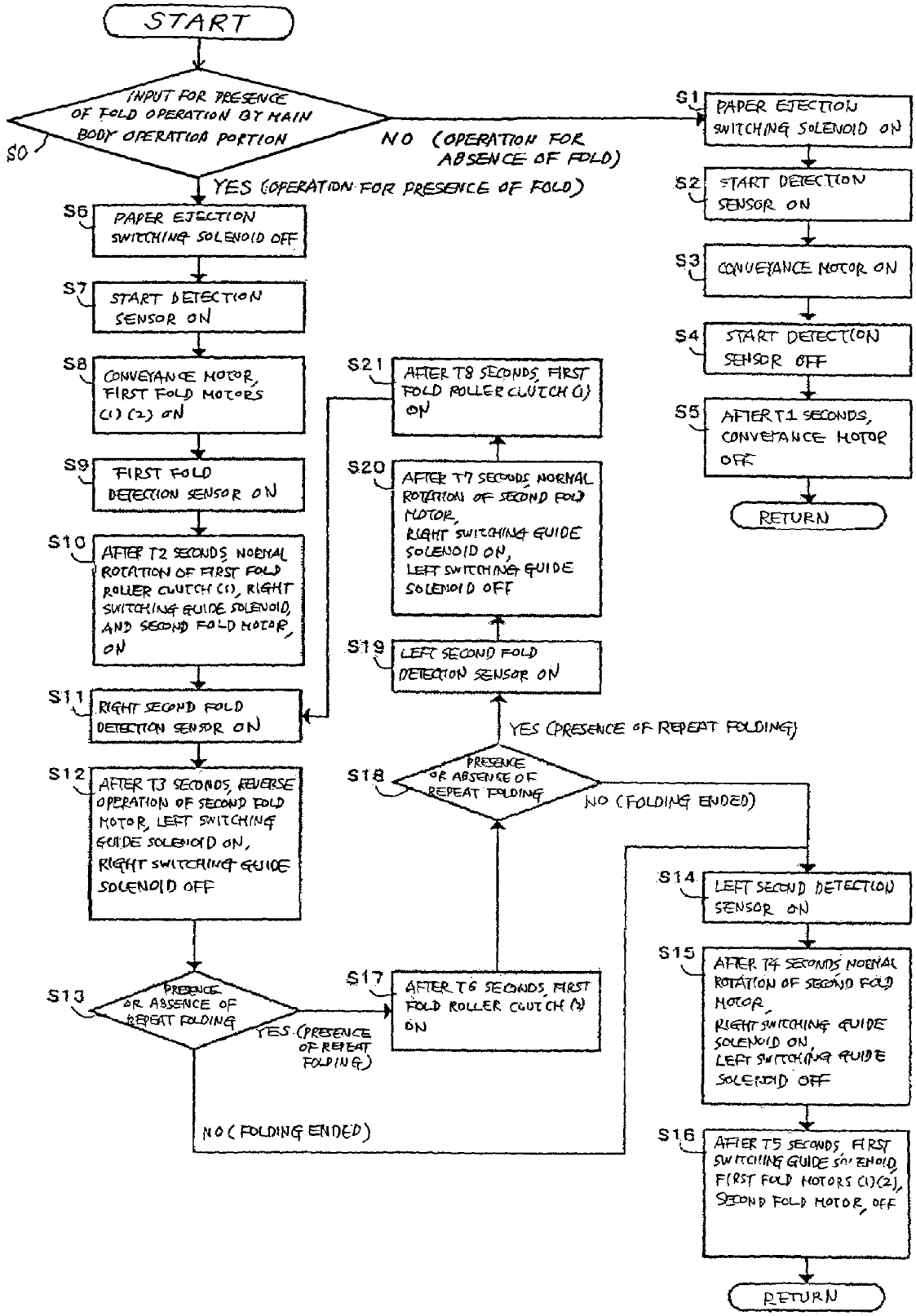
FIG. 15 shows a flow chart of the paper conveyance movement according to the first modification.
Figure 16:
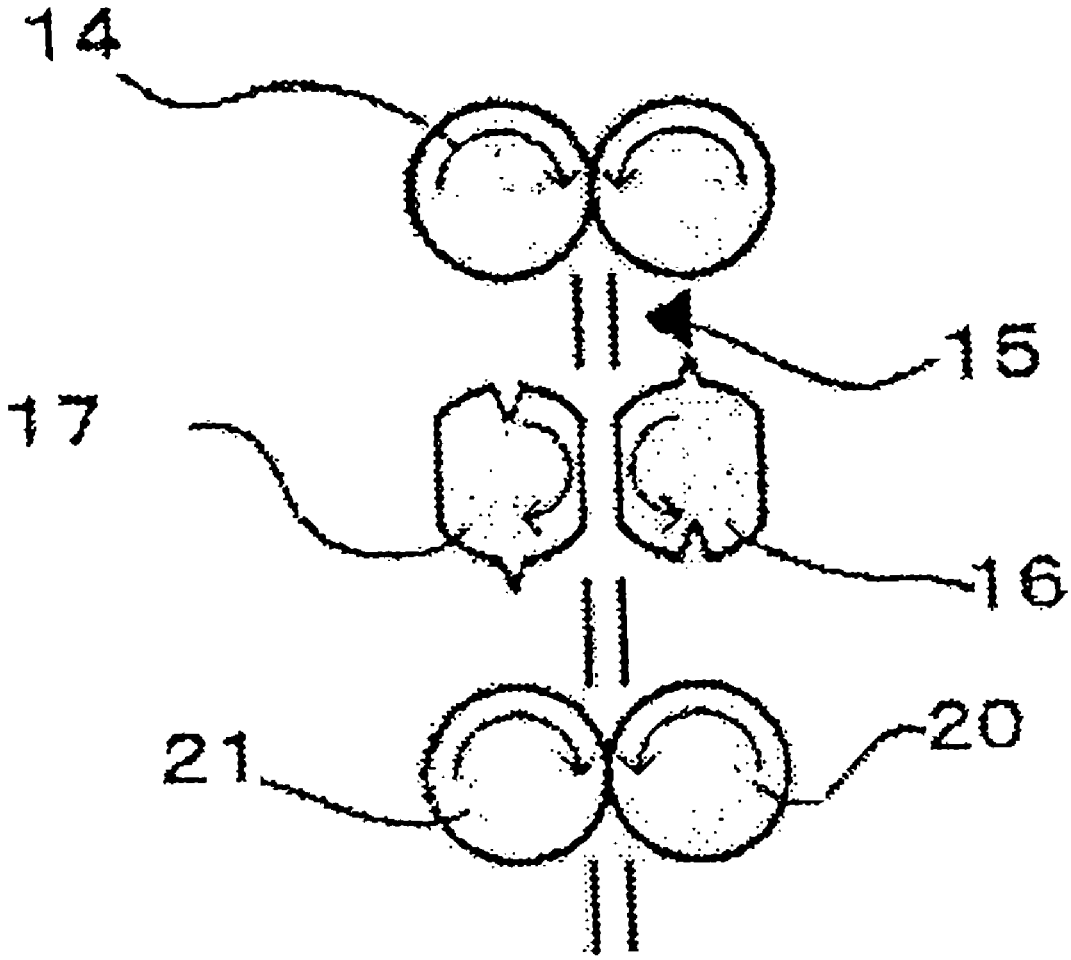
FIG. 16 is a side view of the first pair of fold rollers according to a second modification of the first embodiment.
Figure 17:
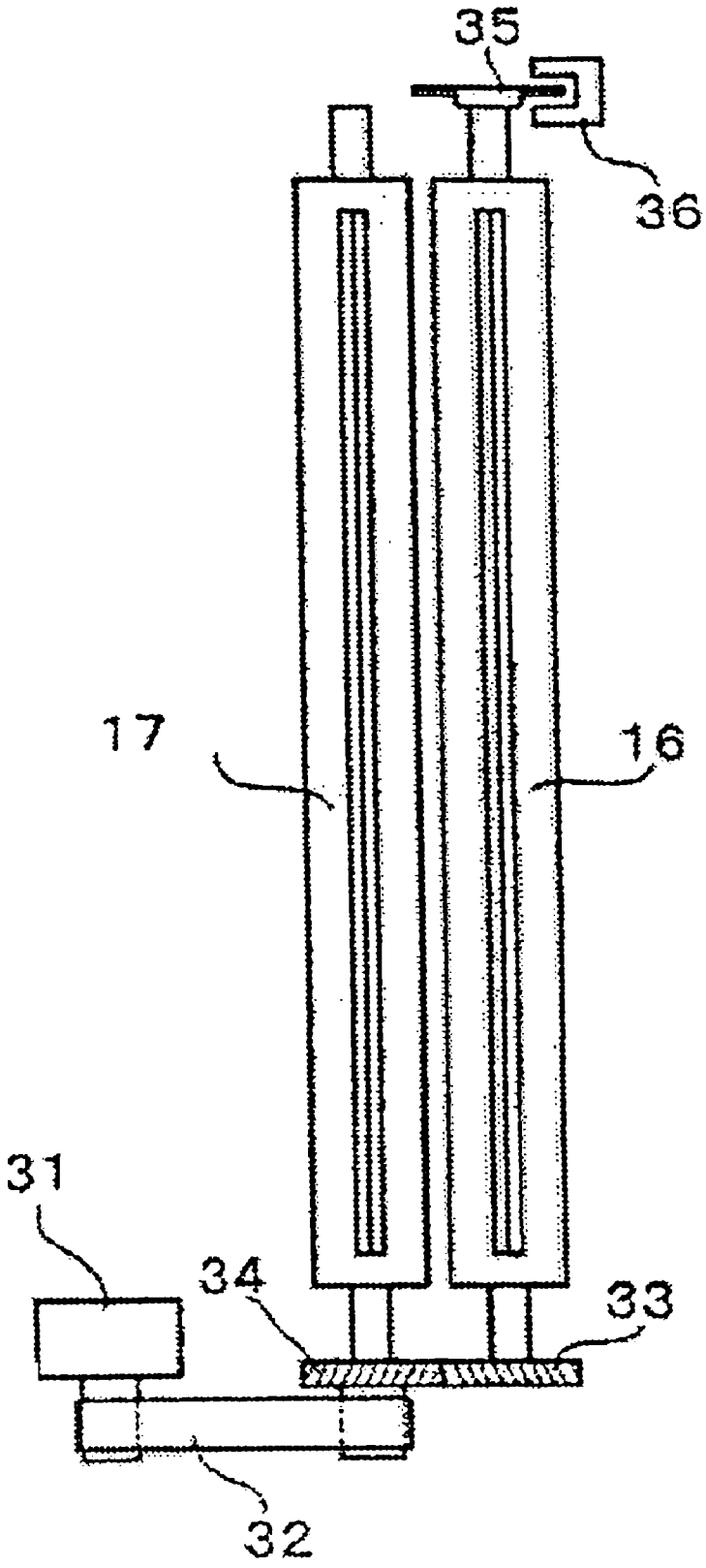
FIG. 17 is a plan view of the first pair of fold rollers.
Figure 18:
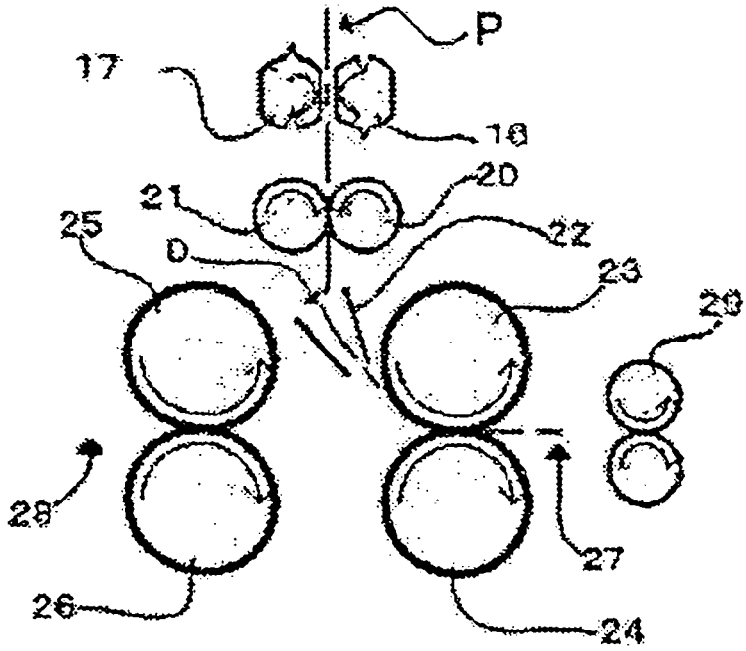
FIG. 18 is a side view showing a fold line is formed on the paper in a first bellows fold portion in the conveyance movement of the paper in the bellows fold portion according to the second modification.
Figure 19:
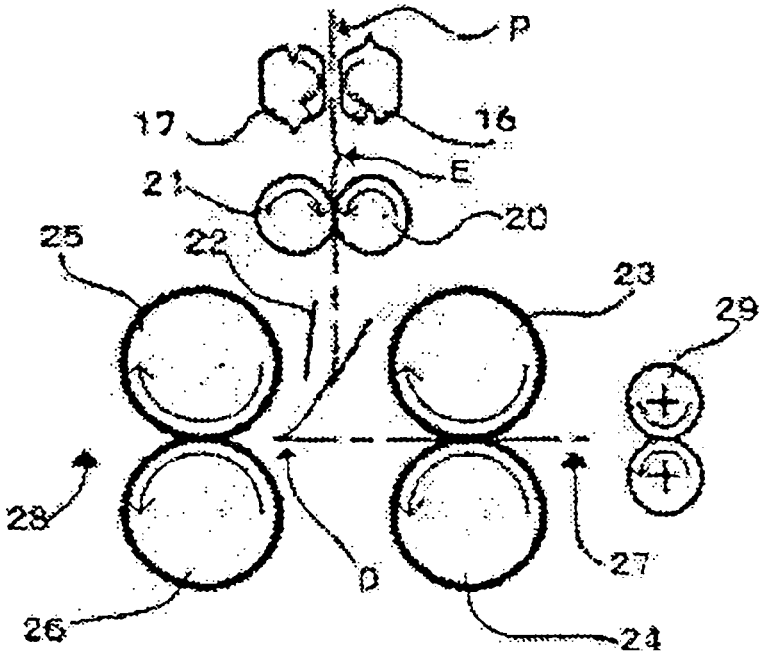
FIG. 19 is a side view showing a state in which the paper is folded in a second bellows fold portion in the conveyance movement of the paper in the bellows fold portion.
Figure 20:
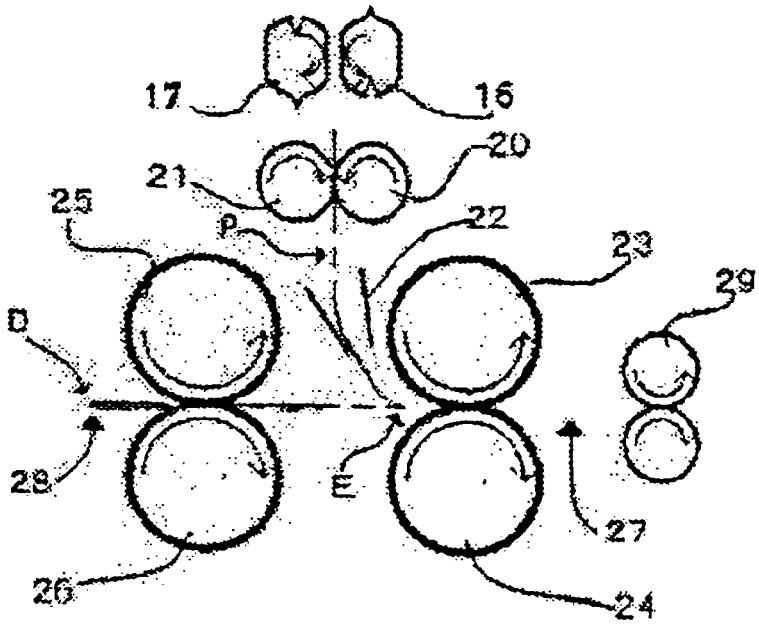
FIG. 20 is a side view showing a state in which the paper is repeatedly folded in the second bellows fold portion in the conveyance movement of the paper in the bellows fold portion.

First of all, FIGS. 13 through 15 are used to describe the first modification.

For the first bellows fold portion 3, the first pair of fold rollers 16, 17 and the second pair of fold rollers 18, 19 have the same configurations as in first embodiment described above. The pair of paper conveying rollers 14 used in the above-described first embodiment are omitted, and instead the first pair of fold rollers 16, 17 and the second pair of fold rollers 18, 19 play the role of paper conveyance.

As shown in FIG. 13, the rotating rollers 16 in the first pair of fold rollers 16, 17 is constituted by a roller 16*a* having a protrusion, and a plurality of wheels 16*b* provided with an appropriate spate therebetween on a roller shaft. Further, in the second pair of fold rollers 18, 19 as well, the other rotating roller 18 is constituted by a roller 18*a* having a protrusion, and a plurality of wheels 18*b* provided with an appropriate spate therebetween on a roller shaft.

Also, a one-rotation clutch which is stopped after one rotation by one ON signal is attached to an end portion of the rotating roller 16 in the first pair of fold rollers 16, 17, and the first pair of fold rollers 16, 17 are driven via a gear pulley 34 attached to the rotating roller 17, and the drive belt 32. The rotation operation and stoppage of the first pair of fold rollers 16, 17 are conducted by the ON/OFF operation of the first fold motor (1) 31 in the above-described first embodiment, but, in this modification, the first pair of fold rollers 16, 17 are used as the paper conveying rollers even when not forming a fold line, thus formation of a fold line is performed by the ON/OFF operation of the one-rotation clutch described previously. It should be noted that the same configuration and method of operation as in the first pair of fold rollers 16, 17 are applied to the second pair of fold rollers 18, 19.

In this modification, the rotating rollers 16 in the first pair of fold rollers 16, 17 is constituted by the roller 16*a* having a protrusion, and the plurality of wheels 16*b* (the other rotating roller 18 in the second pair of fold rollers 18, 19 is also constituted by the roller 18*a* having a protrusion, and the plurality of wheels 18*b*), thus it can be used as the roller for conveying paper other than for forming a fold line, which means that a roller for conveying paper is not necessary. Therefore, the configuration can be made small and inexpensively.

FIGS. 16 through 20 are used to describe the second modification next.

The first bellows form portion 3 is constituted by the first pair of fold rollers 16, 17 only, and fold lines in the form of both mountain and valley can be formed on one sheet of paper P by means of only one pair of rollers. The both rotating rollers 16, 17 are in the shape of a rough square, wherein the rotating roller 16 has a protrusion as in the first embodiment described above, and also has a groove at 180 degrees opposite to the protrusion.

Moreover, the shape of the roller surface located 90 degrees from the face on which the protrusion and groove are formed has a flat shape so as to be parallel with respect to the paper conveyance direction when an indented axis line is located in a position at right angles, in other words, in a position where an operation for forming a fold line is not performed. The other rotating roller 17 has the same shape as the rotating roller 16, but the position for forming the protrusion and groove is different from that of the rotating roller 16 by 180 degrees in terms of an attachment direction. Further, the driving method is also the same as in the first embodiment described above, but the shape of the first fold roller HP detection plate 35 is different. In the above-described first embodiment, one rotation of the roller is equivalent to one operation when forming a fold line on paper, thus, in order to form fold lines in the form of both mountain and valley on the paper P, two pairs of the rollers are required. However, in the present modification, a half turn of the roller is equivalent to one operation, thus, by extending the first fold roller HP detection plate 35 to the opposite side by 180 degrees, the first fold roller HP sensor 36 can perform detection for each half turn of the roller, and further the ON/OFF operation of the first fold motor (1) 31 can be controlled for each half turn of the roller.

Next, the third modification is described.

Figure 21:
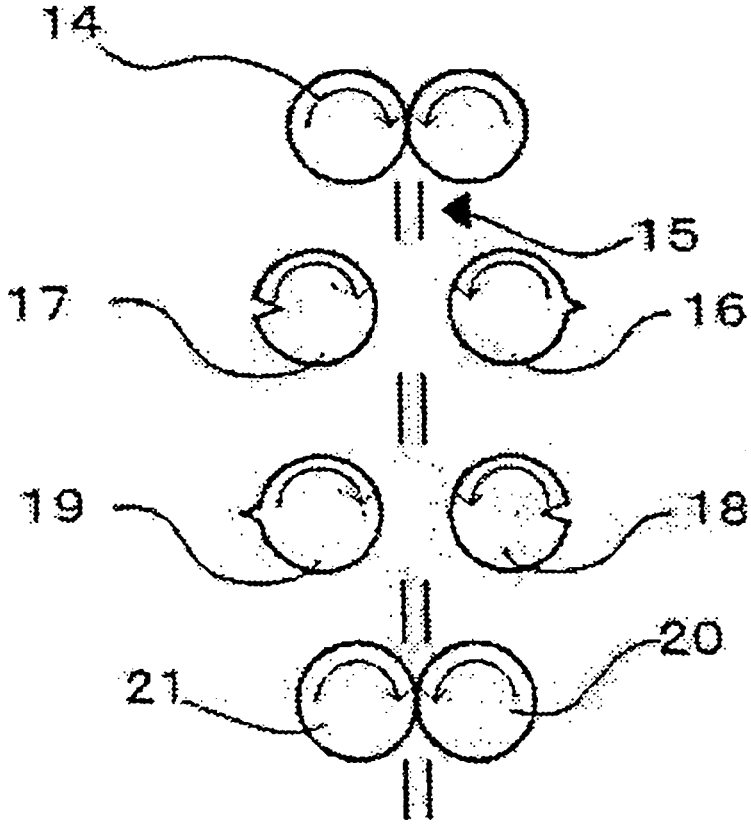
FIG. 21 is a side view showing the first bellows fold portion according to a third modification of the first embodiment.
Figure 22:
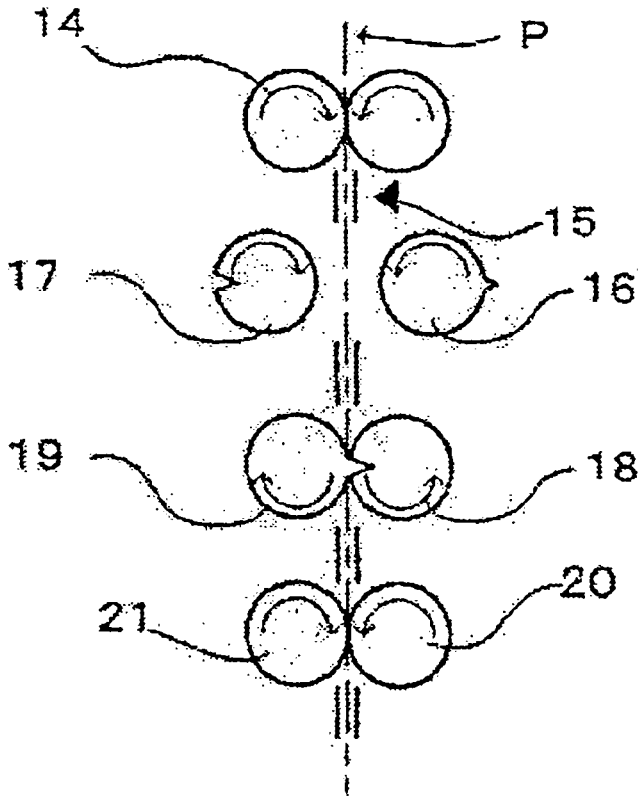
FIG. 22 is a side view showing a state in which the paper is conveyed to the first bellows fold portion.

As shown in FIG. 21 and FIG. 22, in the first pair of fold rollers 16, 17 and the second pair of fold rollers 18, 19, the rotating rollers 16, 19 and the other rotating rollers 17, 18 are provided such that the rotation shafts thereof are decentered from the center of the rotating rollers so that the rotating rollers 16, 19 and the other rotating rollers 17, 18 are eccentrically rotated.

In this manner, rotation shafts are decentered from the center of the rotating rollers, and the rotating rollers 16, 19 and the other rotating rollers 17, 18 are rotated eccentrically, thus formation of a fold line is performed while securely holding the paper at the nip portion of the pair of rollers, whereby a highly precise fold line can be formed.

The fourth modification is described next with reference to FIG. 23.

Figure 23:
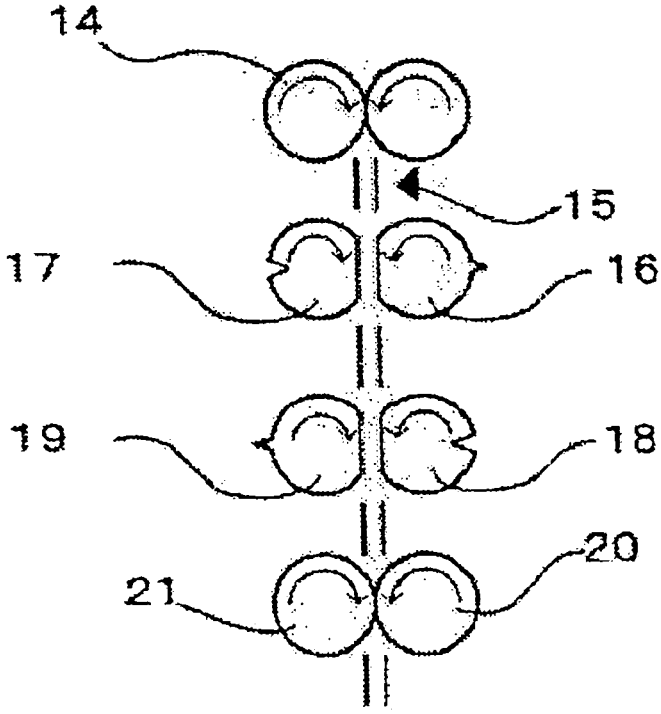
FIG. 23 is a side view showing the first bellows fold portion according to a fourth modification of the first embodiment.

As shown in FIG. 23, in the first pair of fold rollers 16, 17 and the second pair of fold rollers 18, 19, the roller surface, which is located at 180 degrees opposite to the indented portions (protrusion, groove) formed on each roller, has a flat shape so as to be parallel with respect to the paper conveyance direction. In this manner, since the roller surface, which is located at 180 degrees opposite to the indented portions formed on each roller, has a flat shape so as to be parallel with respect to the paper conveyance direction, when the first pair of fold rollers 16, 17 and the second pair of fold rollers 18, 19 are stopped, the pairs of rollers can be used as the guide for conveying paper, and, when the paper passes between the pairs of rollers in the case where formation of a fold line is not performed, the paper can be prevented from being caught, whereby the paper can be conveyed smoothly.

Figure 24:
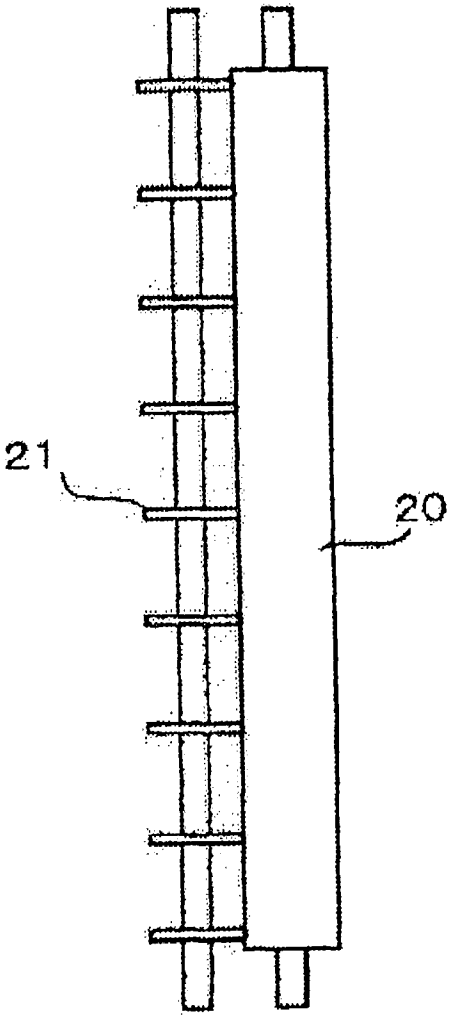
FIG. 24 is a plan view showing a pair of conveying rollers in the first bellows fold portion in a fifth modification of the first embodiment.

The fifth modification is described next using FIG. 24.

In the pair of conveying rollers 20, 21 provided downstream of the second pair of fold rollers 18, 19, the shape of one of the rollers has a form of a skewer such that a plurality of rollers are disposed along the axial direction. As described above, since the shape of at least one of the pair of rollers conveying the paper from the first bellows fold portion 3 to the second bellows fold portion 4 is in the shape a skewer, the fold line formed by the first bellows fold portion 3 can be conveyed to the second bellows fold portion 4 without breaking the fold line. Therefore, the paper can be folded along the fold line formed by the first bellows fold portion 3, and a thin sheaf of folded papers can be produced.

Figure 25:
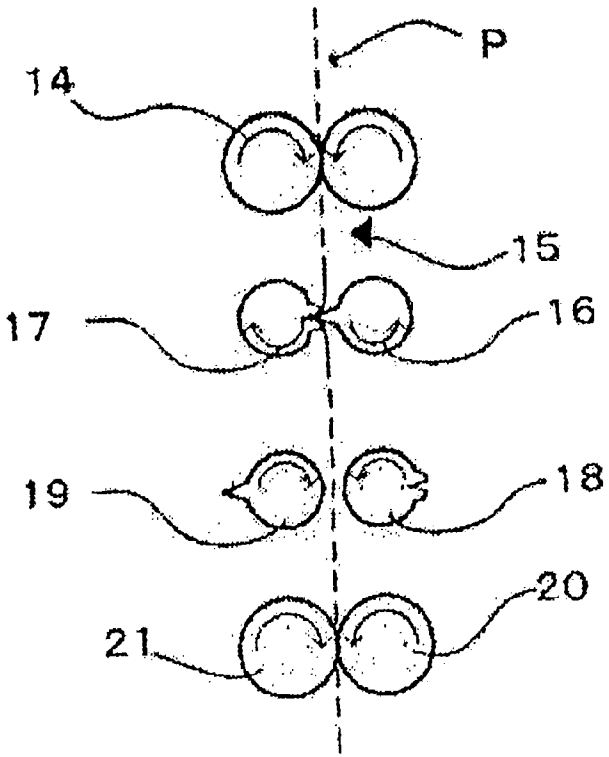
FIG. 25 is a side view showing the first bellows fold portion according to a sixth modification of the first embodiment.

The sixth modification is described next using FIG. 25.

In the sixth modification, in the first bellows fold portion 3 the rotating roller 16 of the first pair of fold rollers 16, 17 has the same configuration as in the first embodiment described above, the configuration being such that a cylindrical rubber having a protrusion at its shaft which is made of SUS is press-fitted. The other rotating roller 17 has a configuration in which a cylindrical rubber having a groove at its shaft which is made of SUS is press-fitted, but the cylindrical rubber used in the rotating roller 17 is softer than the cylindrical rubber used in the rotating roller 16. Therefore, by using the cylindrical rubber for the rotating roller 17, the cylindrical rubber being softer than that of the rotating roller 16, in the case where the protrusion and groove are fitted to each other to form a fold line on the paper, when the protrusion fits into the groove, it can be further pressed so that the protrusion and groove are attached firmly to each other, whereby a fold line can be formed securely and with high accuracy. It should be noted that the configuration of the second pair of fold rollers 18, 19 is the same as that of the first pair of fold rollers 16, 17.

Figure 27:
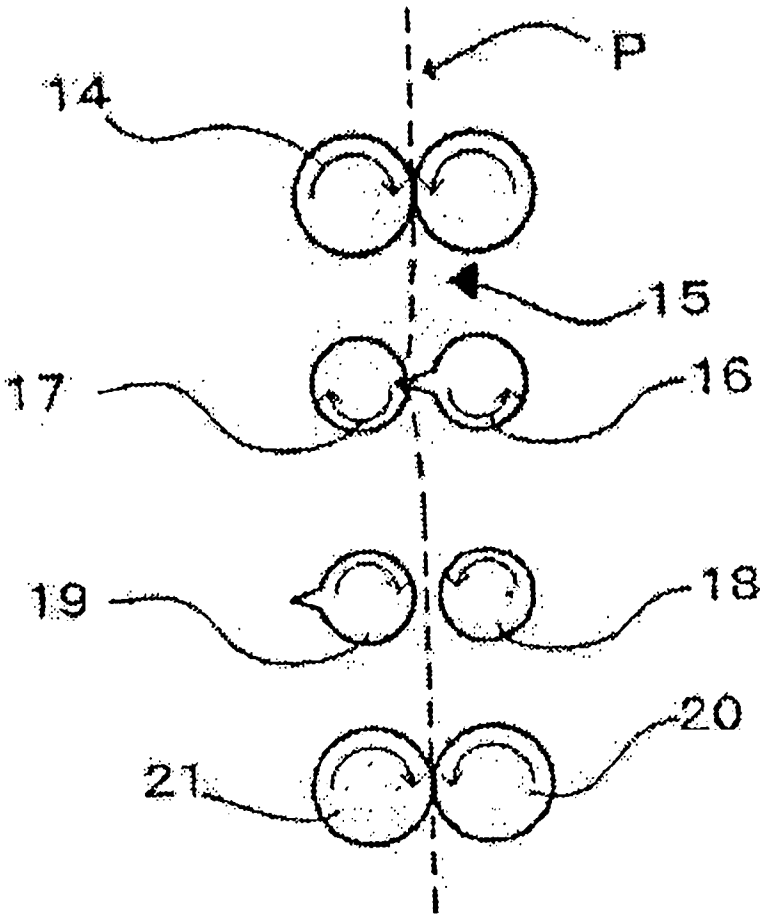
FIG. 27 is a side view showing a state in which the paper is conveyed to the fist bellows fold portion according to the seventh modification.
Figure 26:
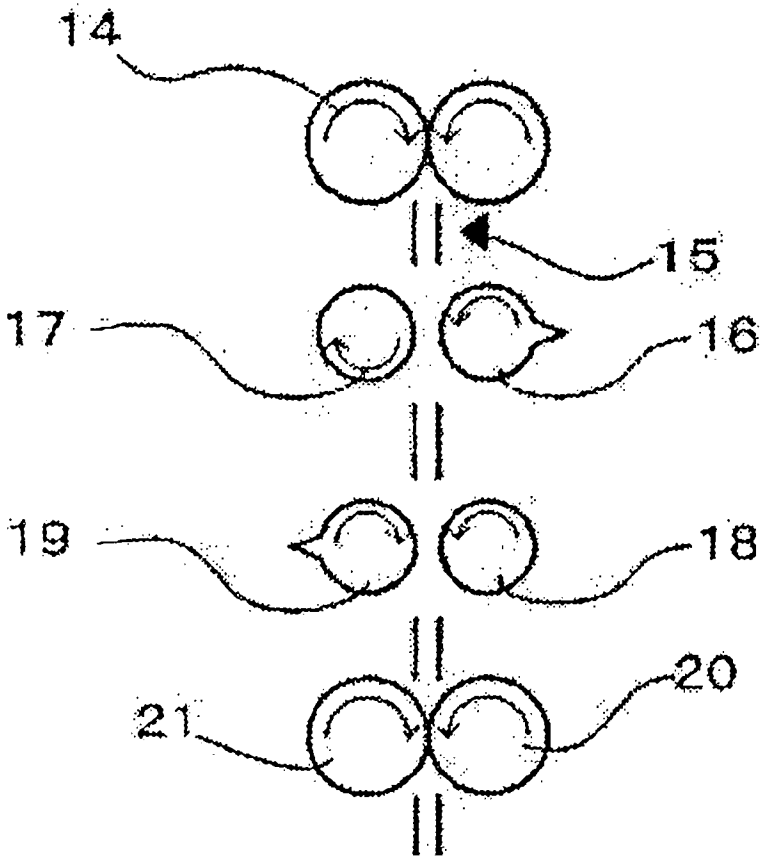
FIG. 26 is a side view showing the first bellows fold portion according to a seventh modification of the first embodiment.

Next, the seventh modification is described using FIG. 26 and FIG. 27.

In the seventh modification, in the first bellows fold portion 3 the rotating roller 16 of the first pair of fold rollers 16, 17 has the same configuration as in the first embodiment described above, the configuration being such that a cylindrical rubber having a protrusion at its shaft which is made of SUS is press-fitted. The other rotating roller 17 has a configuration in which a commonly used cylindrical rubber having no groove at its shaft which is made of SUS is press-fitted, but the cylindrical rubber used in the rotating roller 17 is softer than the cylindrical rubber used in the rotating roller 16. Therefore, the roller with no groove, which is usually used, is used instead of the rotating roller with a groove, thus, when forming a fold line the protrusion is buried in the surface of the counter roller (other rotating roller 17), whereby a fold line can be formed securely and with high accuracy. Also, since a commonly used roller is used instead of a special roller with a groove, the protrusion may be buried in any place on the counter roller, and even when a gap in rotation is generated between rotating roller 16 and the other rotating roller 17, a fold line can be formed always with high accuracy. It should be noted that the configuration of the second pair of fold rollers 18, 19 is the same as that of the first pair of fold rollers 16, 17.

Figure 29:
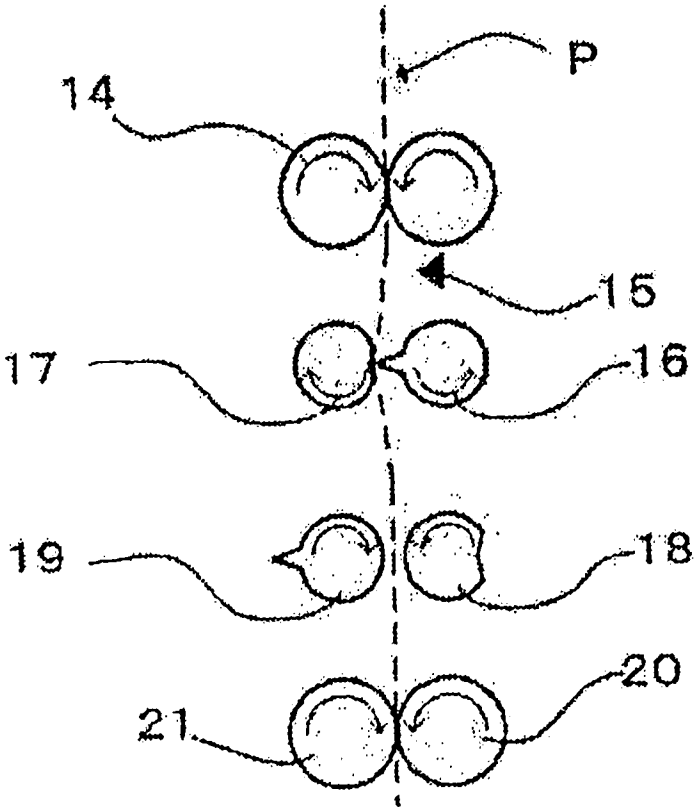
FIG. 29 is a side view showing a state in which the paper is conveyed to the first bellows fold portion according to the eighth embodiment.
Figure 28:
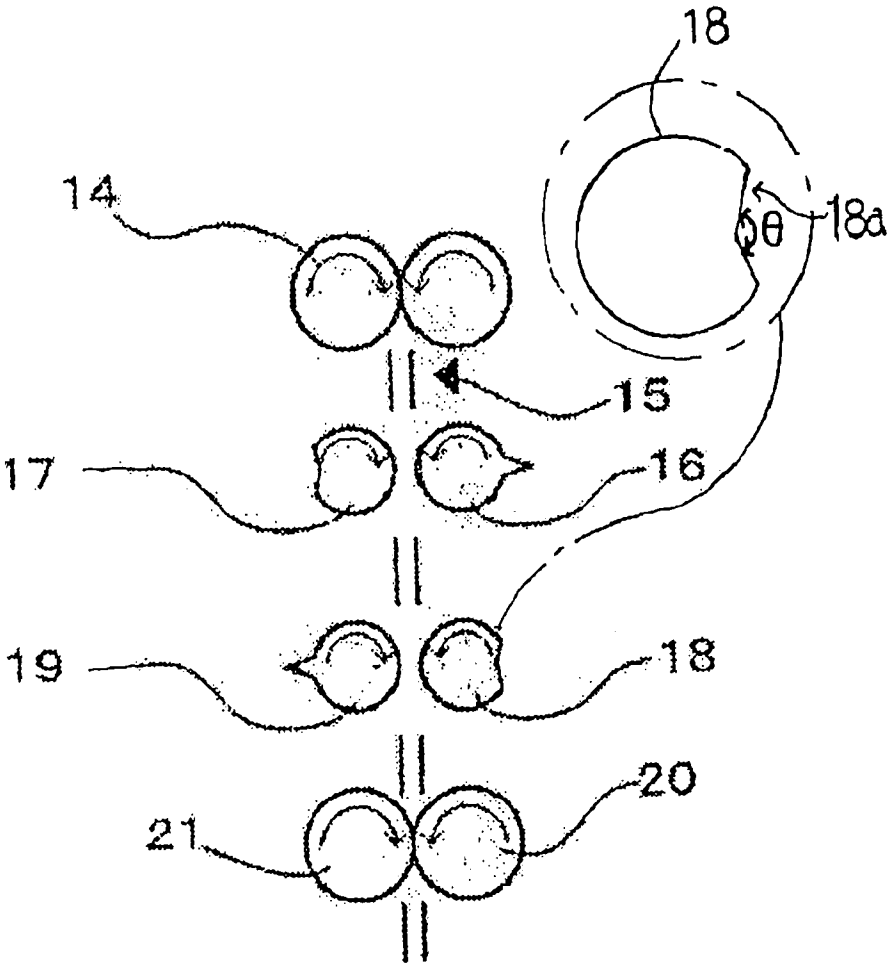
FIG. 28 is a side view showing the first bellows fold portion according to an eighth modification of the first embodiment.

The eighth modification is described next using FIG. 28 and FIG. 29.

In the eighth modification, in the first bellows fold portion 3 the shape of the groove formed in the other rotating roller 17 in the first pair of fold rollers 16, 17 is different from the one used in the first embodiment. As shown in FIG. 28, the angle formed by one wall and other wall that create the groove (θ, shown in the enlarged form, circled with a dashed line in FIG. 28) is formed to be a blunt angle. Therefore, since the angle formed by the first wall and the other wall that created the groove is formed to be a blunt angle, generation of unnecessary fold lines, which can be easily created at the nip of the rollers, can be prevented when forming a fold line on the paper, whereby a fold line can be formed securely and with high accuracy.

The ninth modification is described next using FIG. 30 through FIG. 39.

Figure 30:
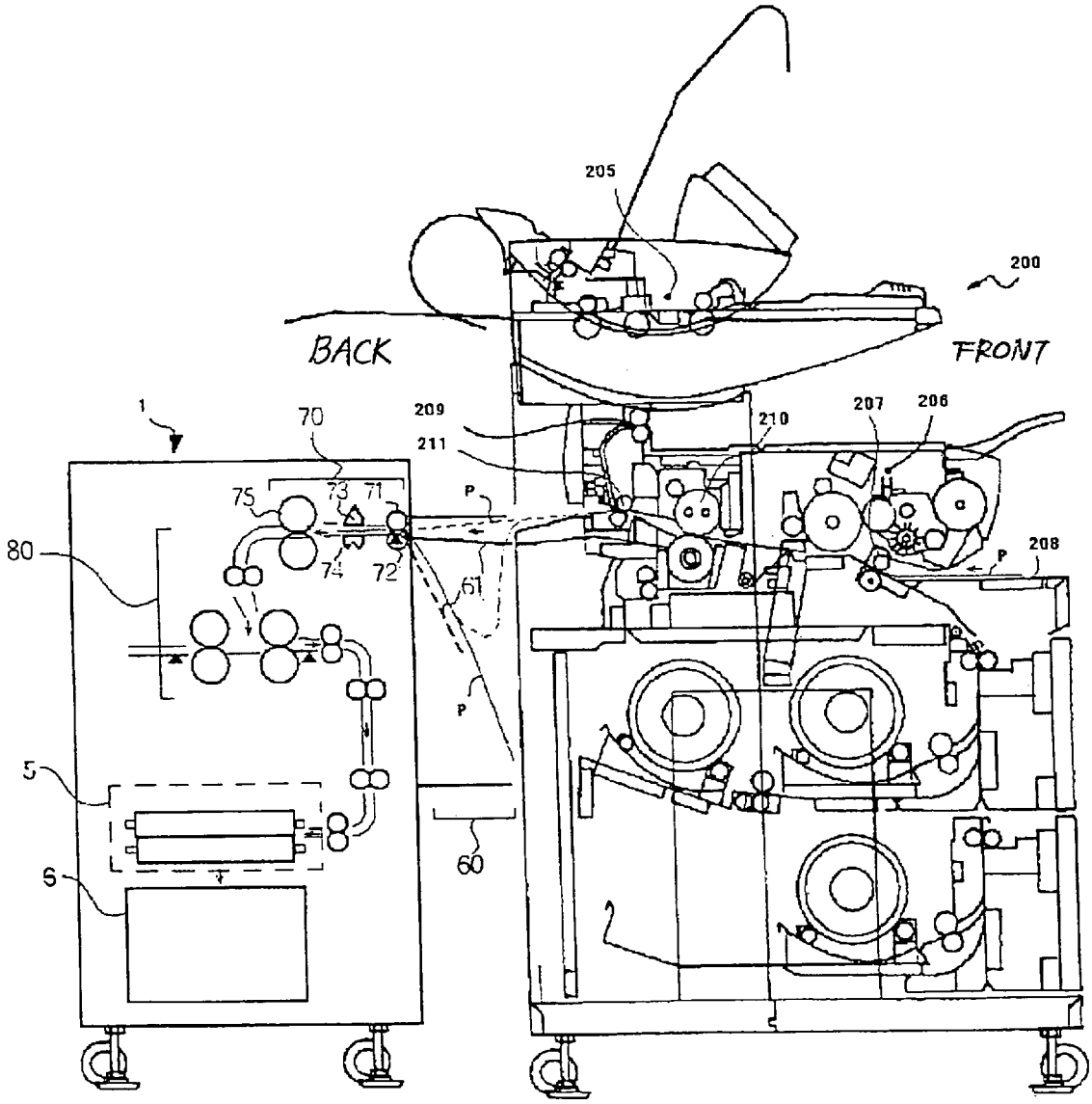
FIG. 30 is a side view showing a schematic configuration of a copying machine and a paper folding apparatus according to a ninth modification of the first embodiment.

In the ninth modification, the paper folding apparatus 1 is provided with an end section fold portion (first folding means) 70 for folding the end section at a leading edge of the paper, wherein a fold line is formed at the leading edge of the paper by the end section fold portion 70, and thereafter a fold line is formed in bellows in the conveyance direction of the paper in a bellows fold portion 80. Further, the paper folded in bellows is then folded into A4 sized paper in the cross fold portion 5, and thereafter the obtained paper is stacked in the stacker 6. When folding the paper at the end section fold portion 70, the paper is sent to the paper folding apparatus 1 by the paper ejection roller 211, passes through a coupling portion 60 and is sent by a pair of entrance conveying rollers 71 of the end section fold portion 70. When folding the end section of the paper the end section fold portion 70 folds the end section of the paper. At this moment, there is a case in which the end section of the paper is folded while conveying the paper, and a case in which conveyance of the paper is stopped once and then the end section of the paper is folded. In the later case where the end section of the paper is folded after stopping conveyance, when the rear edge of the paper is caught at the copying machine main body 200, the copying machine main body 200 continues to convey the paper as shown in FIG. 30, and an entrance guide plate 61 of the coupling portion 60 is mobile so that the entrance guide plate 61 moves from the position indicated with broken lines to the position indicated with solid lines is sag of paper, whereby the paper is ejected from the copying machine main body 200 while the conveyance of the leading edge of the paper is stopped. It should be noted that the configuration of the copying machine main body 200 is the same as the configuration described in the first embodiment, and the first modification through the eight modification, thus the detailed explanation for it is omitted by applying the like reference numerals.

The end section fold portion 70 is described next.

Figure 37:
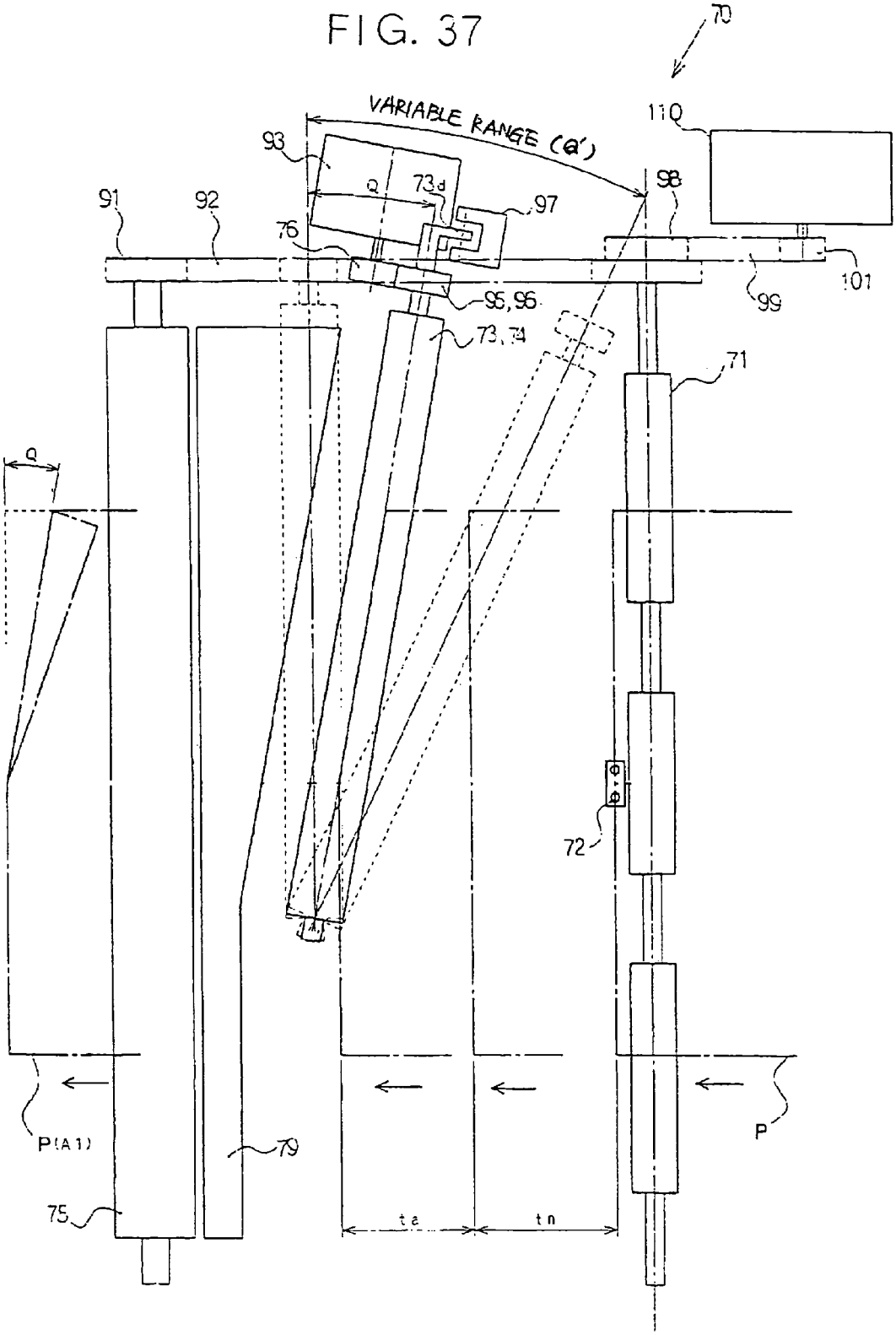
FIG. 37 is a plan view of the end section fold portion.

As shown in FIG. 37, a leading edge detection sensor 72 for detecting a leading edge of paper is disposed downstream and adjacent to the center of the pair of entrance conveying rollers 71. Further, in the downstream position there are end section fold rollers 73, 74 in which is disposed the roller shaft center at the same angle as an angle Q of the fold line of the end section folding with respect to the paper conveyance direction. In the further downstream position of the end section fold rollers 73, 74, there is disposed a pair of fold rollers 75 in which the roller shaft center is disposed at right angle with the paper conveyance direction. A pulley 98 is fixed to the pair of entrance conveying rollers 71, and a pulley 91 is fixed to the pair of fold rollers 75. Each of the pulleys 91, 98 is coupled to a drive belt 92, and the pulley 98 of the entrance conveying rollers 71 is coupled to a pulley 101 fixed to a conveyance motor 110 via a drive belt 99. the pair of fold rollers 75 and the pair of entrance conveying rollers 71 are rotated and stopped by the drive of the conveyance motor 110.

Figure 31:
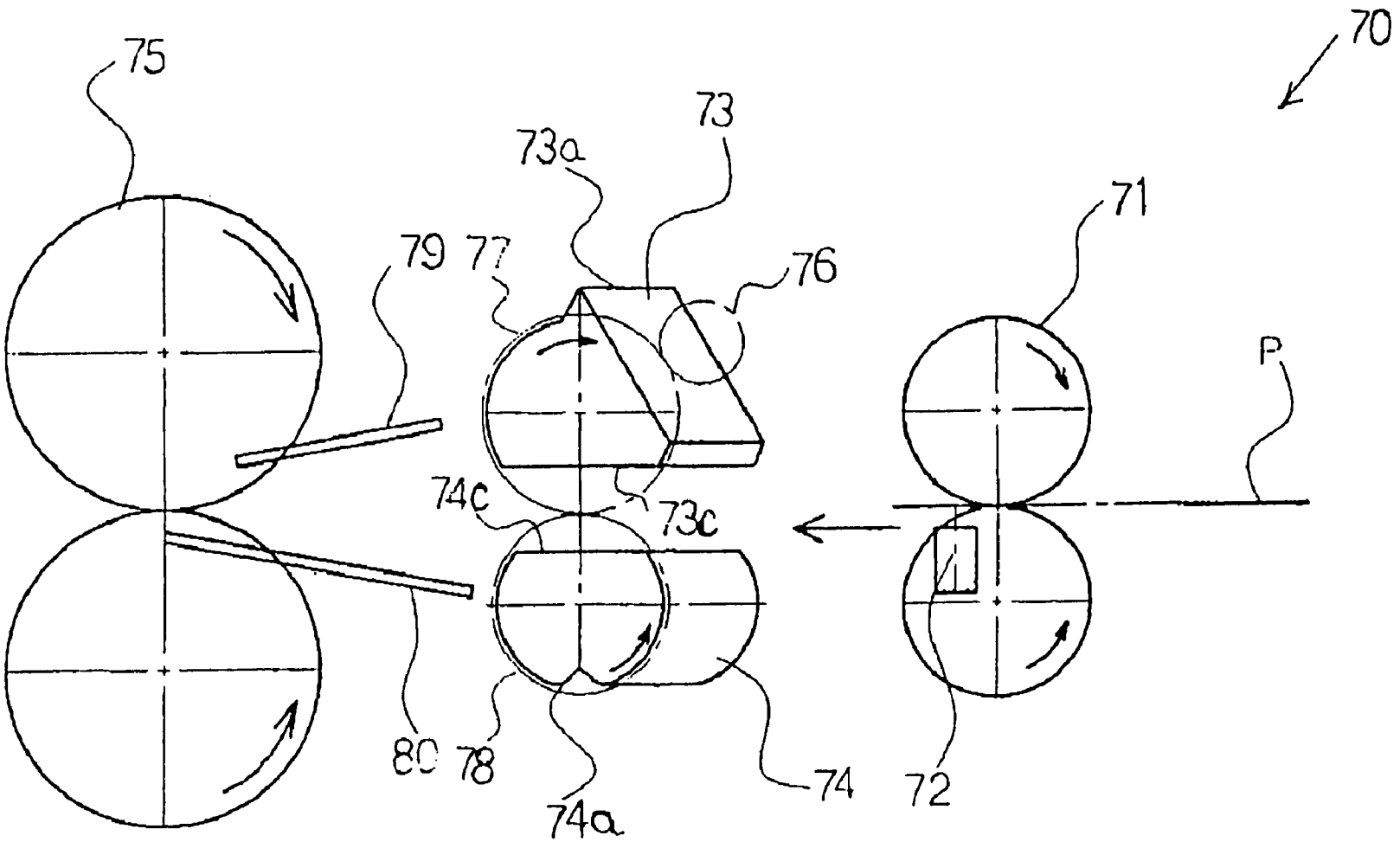
FIG. 31 is a schematic diagram showing an enlarged end section fold portion of the paper folding apparatus.

As shown in FIG. 31, the pair of end section fold rollers 73, 74 are constituted by the end section fold roller 73 with a protrusion 73*a*, and the other end section fold roller 74 with a grove 74*a*, wherein, by fitting the protrusion 73*a* to the groove 74*a*, a fold line can be formed on an end section of paper. Further, a flat portion 73*c* is formed evenly on the end section fold roller 73, and a flat portion 74*c* is formed evenly on the end section fold roller 74. The flat portions 73*c*, 74*c* become parallel to the conveying path when the paper is conveyed, and wait at a position where the paper is not interrupted to go through. Therefore, when folding of the end section is not performed, the end section fold rollers 73, 74 are kept in the position shown in FIG. 31. Moreover, gears 95, 96 are fixed to the end section fold rollers 73, 74 respectively, and the gear 95 is coupled to a gear 76 which is fixed to an end section fold motor 93. Therefore, the end section fold rollers 73, 74 are rotated and stopped by the end section fold motor 93.

Furthermore, as shown in FIG. 37, the end section fold roller 73 is provided with a light protection 73*d* in the shape of a key, which protects a home position sensor ("HP sensor" hereinafter) 97 from light at the waiting position of the end section fold rollers 73, 74, and the HP sensor 97 transmits an ON signal and thereby detects the waiting position.

As shown in FIG. 37, the end section fold rollers 73, 74 can adjust their movements with respect to the positions indicated with the broken lines, so when the angle where the end section fold rollers 73, 74 are disposed is changed to the angle indicated with Q' from the angle indicated with Q in the figure, the angle of the fold line on the end section also can be changed to Q'.

Figure 38:
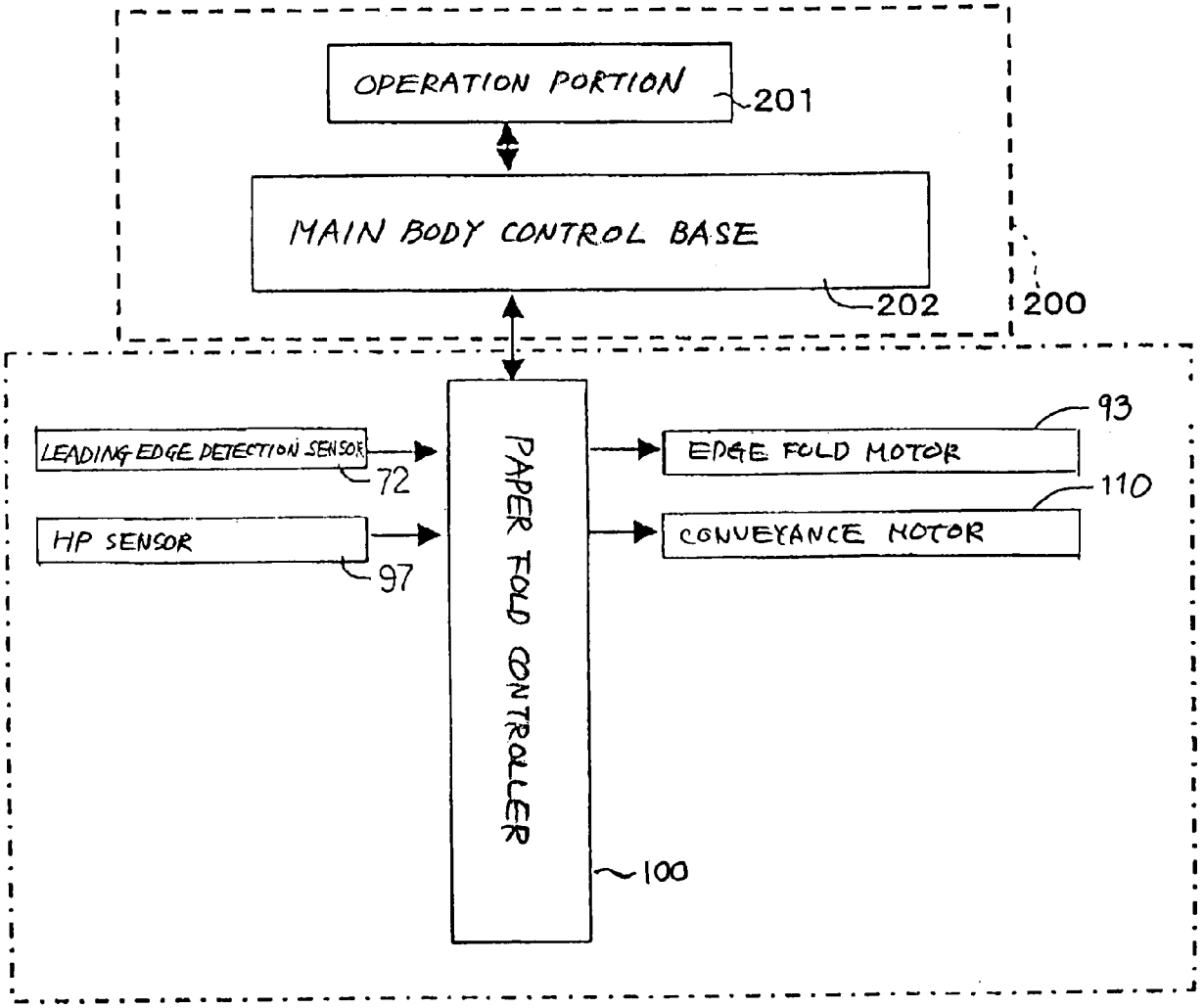
FIG. 38 is a block diagram showing a configuration of a control system of the paper conveyance movement according to the ninth modification and a tenth modification.

Next, FIG. 38 is used to describe a control system of the conveyance operation of the ninth modification.

The operation portion 201 configuring the copying machine device main body 200 performs selection on whether the user folds paper or not, and, when the user folds paper, an input operation for folding or not folding the end section. The input signal sent through the input operation is transmitted to the main body control base 202, and the signal is further transmitted to the paper fold controller 100 configuring the paper folding apparatus 1, whereby a paper fold operation is controlled. Moreover, folding of the end section is controlled by the paper fold controller 100, and control of stopping and rotating the edge fold motor (end section fold motor) 93 and conveyance motor 110 is carried out based on the input signal of the leading edge detection sensor 72 and the HP sensor 97.

Figure 39:
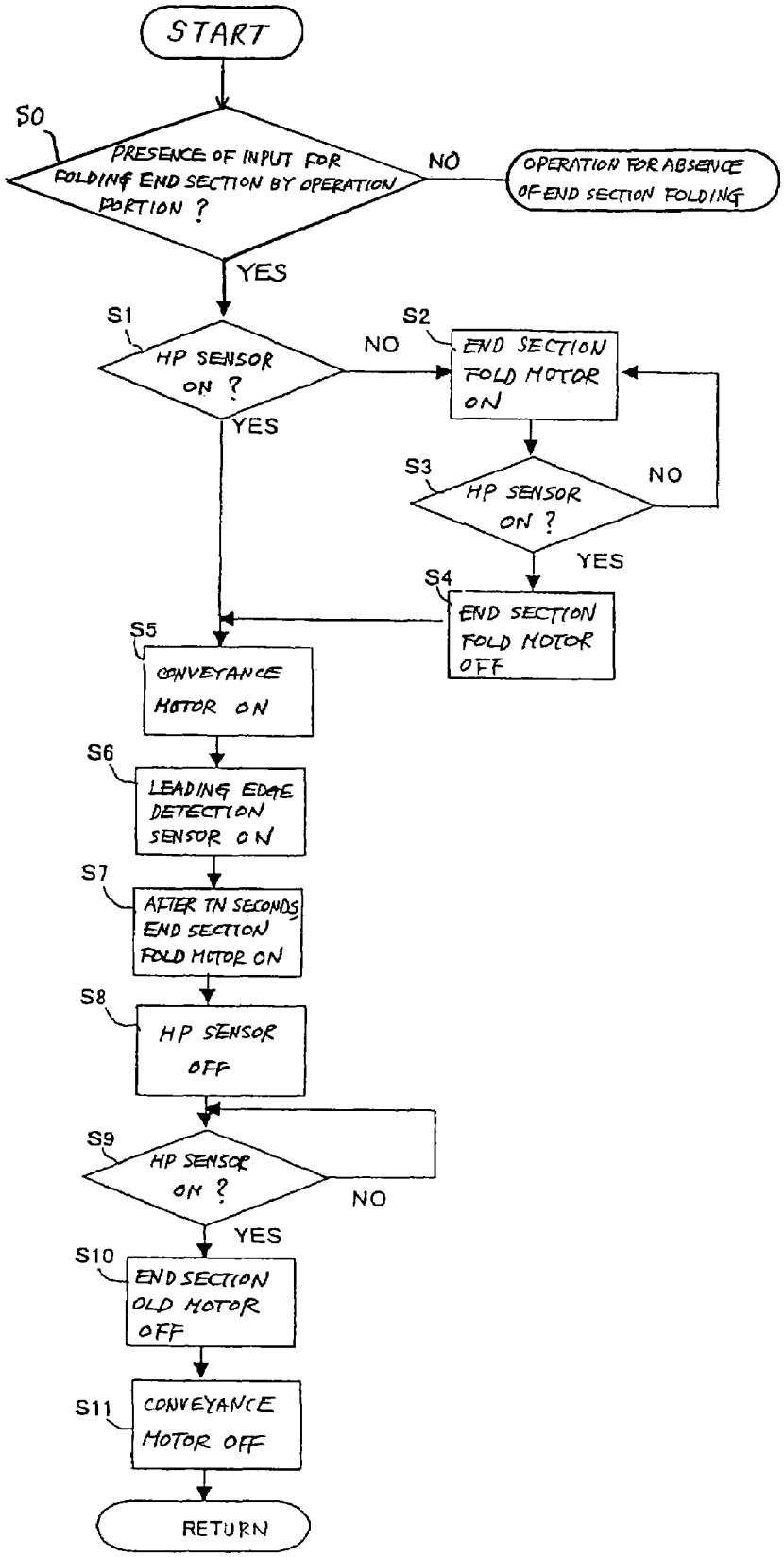
FIG. 39 is a flow chart showing the paper conveyance movement of the ninth modification.

FIG. 31 through FIG. 36 and the flow chart of FIG. 39 are used next to explain the functional effects of the ninth modification.

First, when an end section fold signal is input to the operation portion 201 on the main body side (S0), the signal is input to the paper fold controller 100 via the main body control base 202. Then, the paper fold controller 100 confirms the signal of the HP sensor to check whether or not the end section fold rollers 73, 74 are in the waiting position (S1). If the HP sensor 97 is not ON, the end section fold motor 93 is rotated (S2), and the end section fold rollers 73, 74 come to the waiting position, whereby the HP sensor 97 is switched ON (S3), and the end section fold motor 93 is stopped (S4). In this state the conveyance motor 110 starts to rate (S5), the fold rollers 75 and the entrance conveying rollers 71 rotate in the directions of arrows as shown in FIG. 31, and the paper is sent by the paper ejection roller 211 of the copying machine device main body 200.

Figure 32:
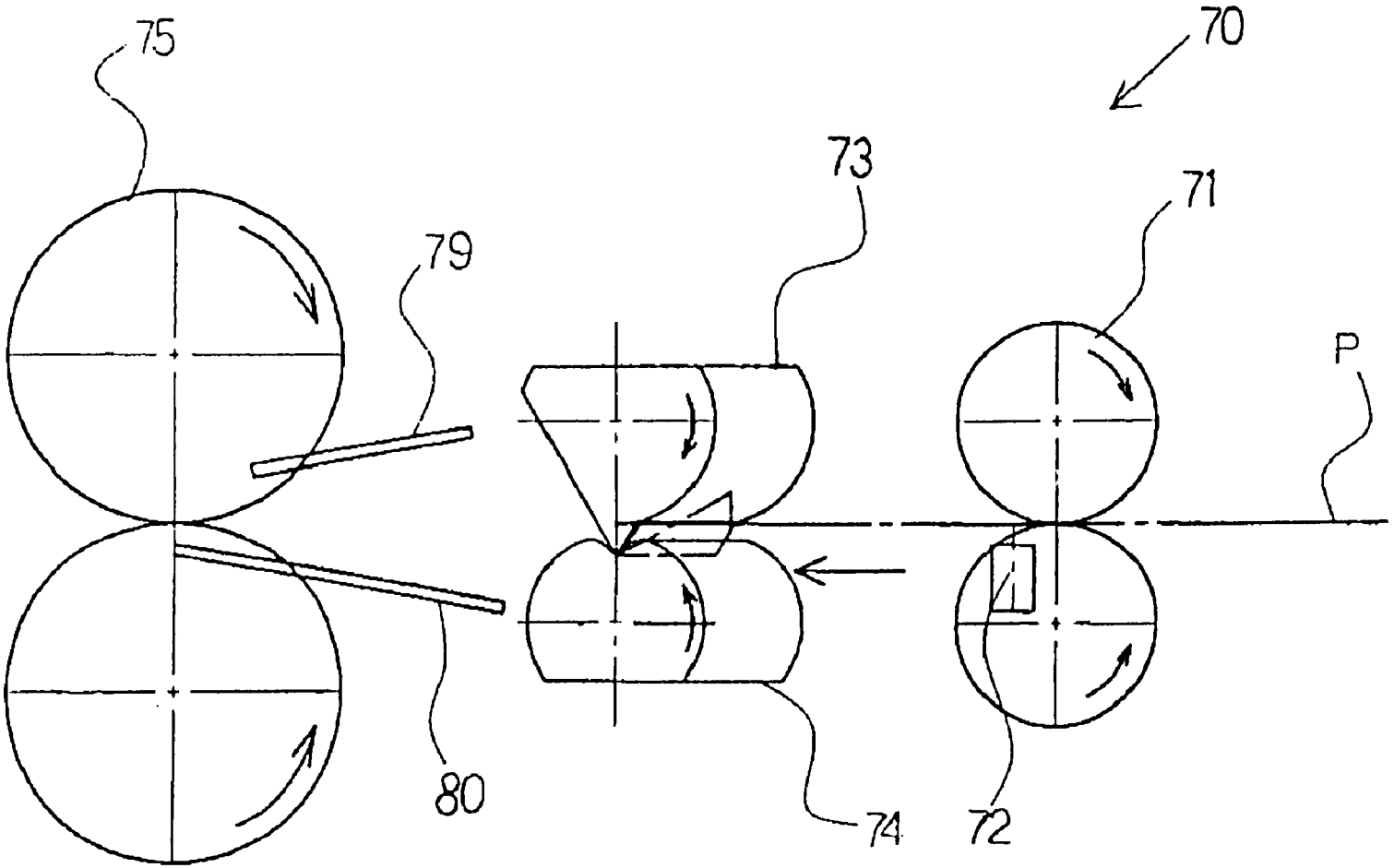
FIG. 32 is a figure showing a state in which a fold line is formed on the end section of the paper in a movement of folding an end section by the end section fold portion.
Figure 33:
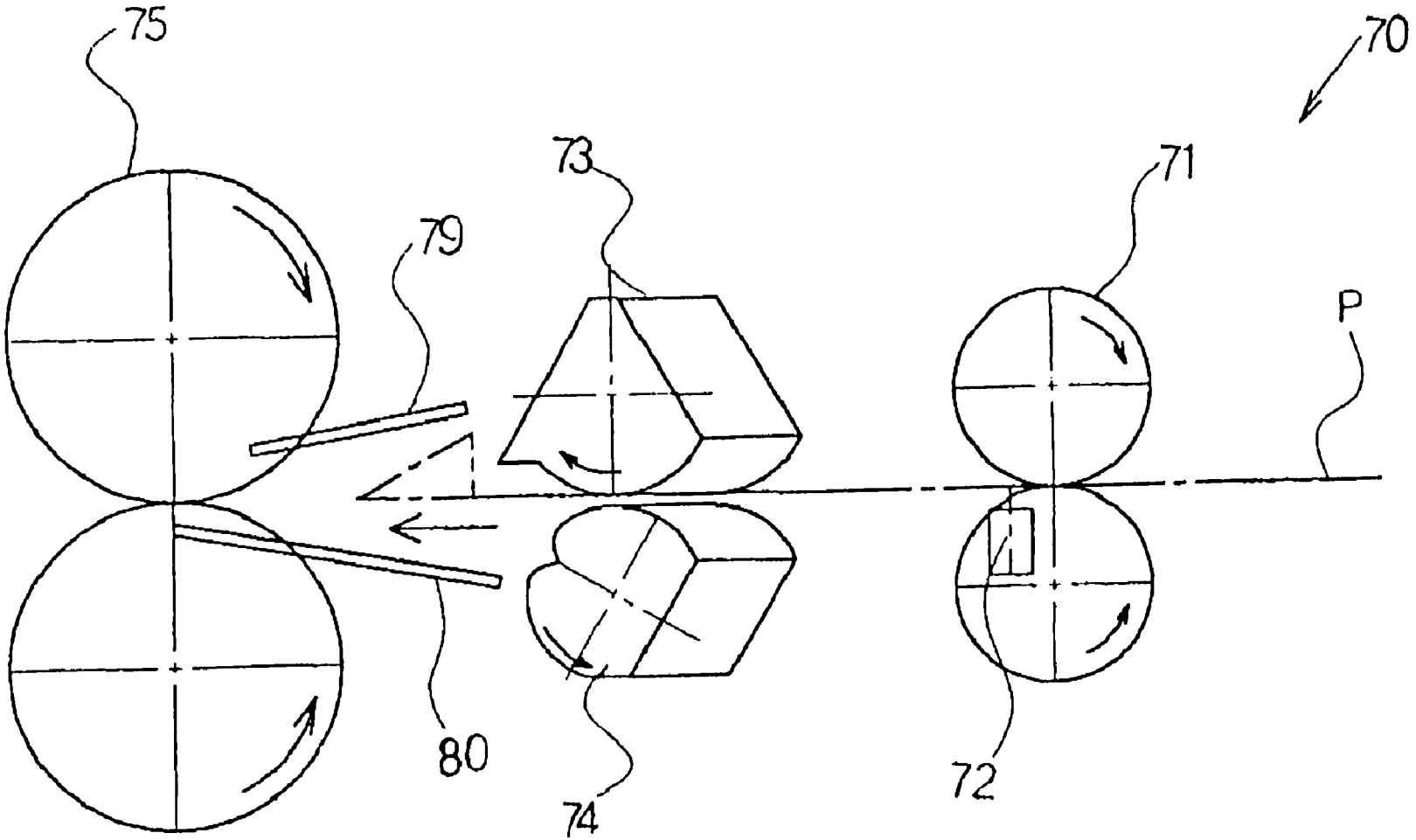
FIG. 33 is a figure showing a state in which the paper is conveyed to the fold roller in the movement of folding an end section by the end section fold portion.

When the paper reaches the entrance conveying rollers 71 as shown in FIG. 31, and the leading edge detection sensor 72 is switched ON by the leading edge of the paper (S6), the end section fold motor 93 also starts to rotate in tn seconds after the protrusion and the groove of the end section fold rollers 73 and 74 are fitted to each other at the position of the fold line on the end section, and the end section fold rollers 73, 74 start rotate in the direction of arrows as shown in FIG. 31 (S7). After ta seconds, as shown in FIG. 32, the protrusion and groove of the end section fold rollers 73 and 74 are fitted to each other in the position of the fold line on the end section, and the end section of the paper is folded back.

Figure 35:
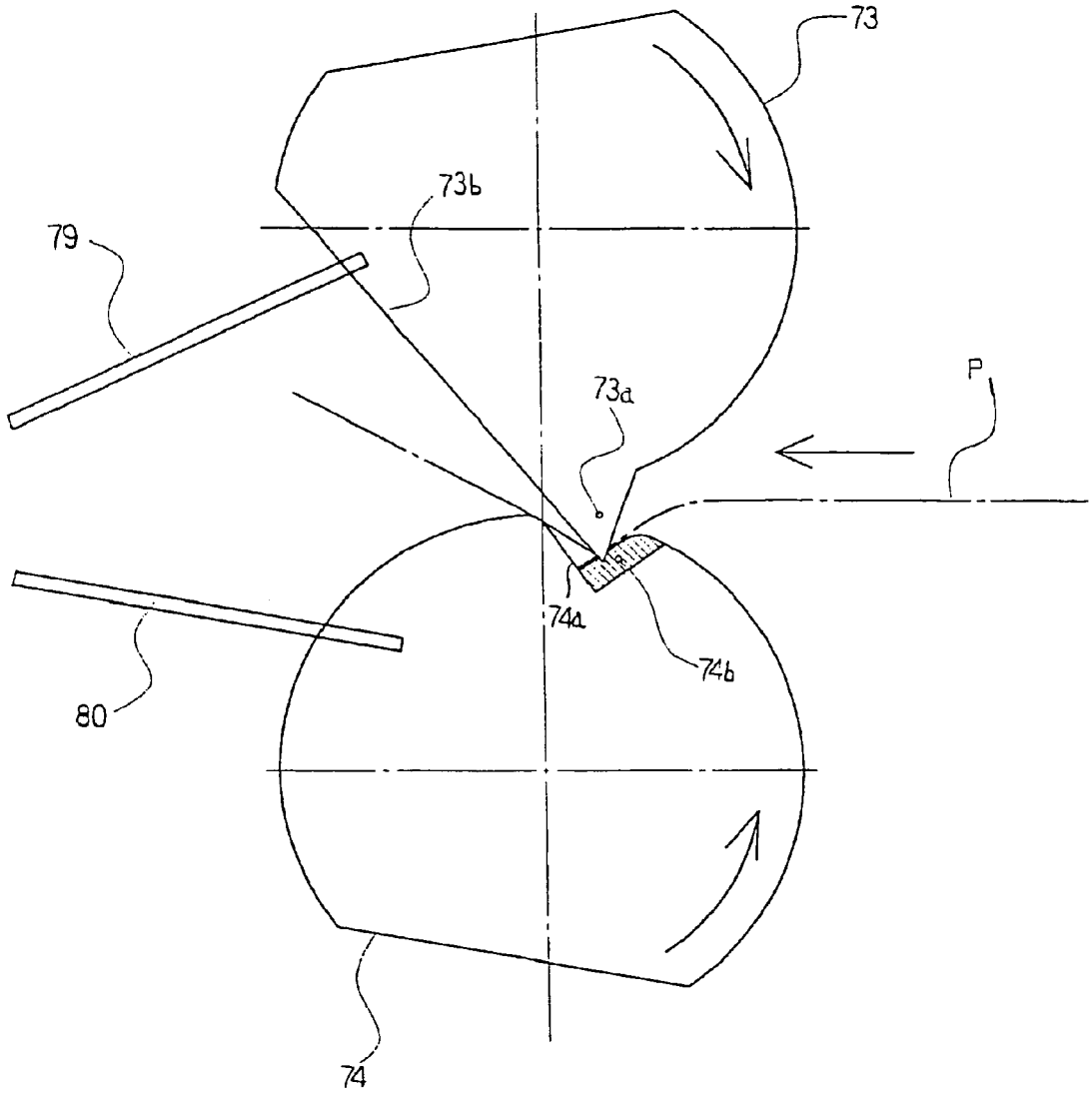
FIG. 35 is a side view showing an enlarged end section fold roller.
Figure 36:
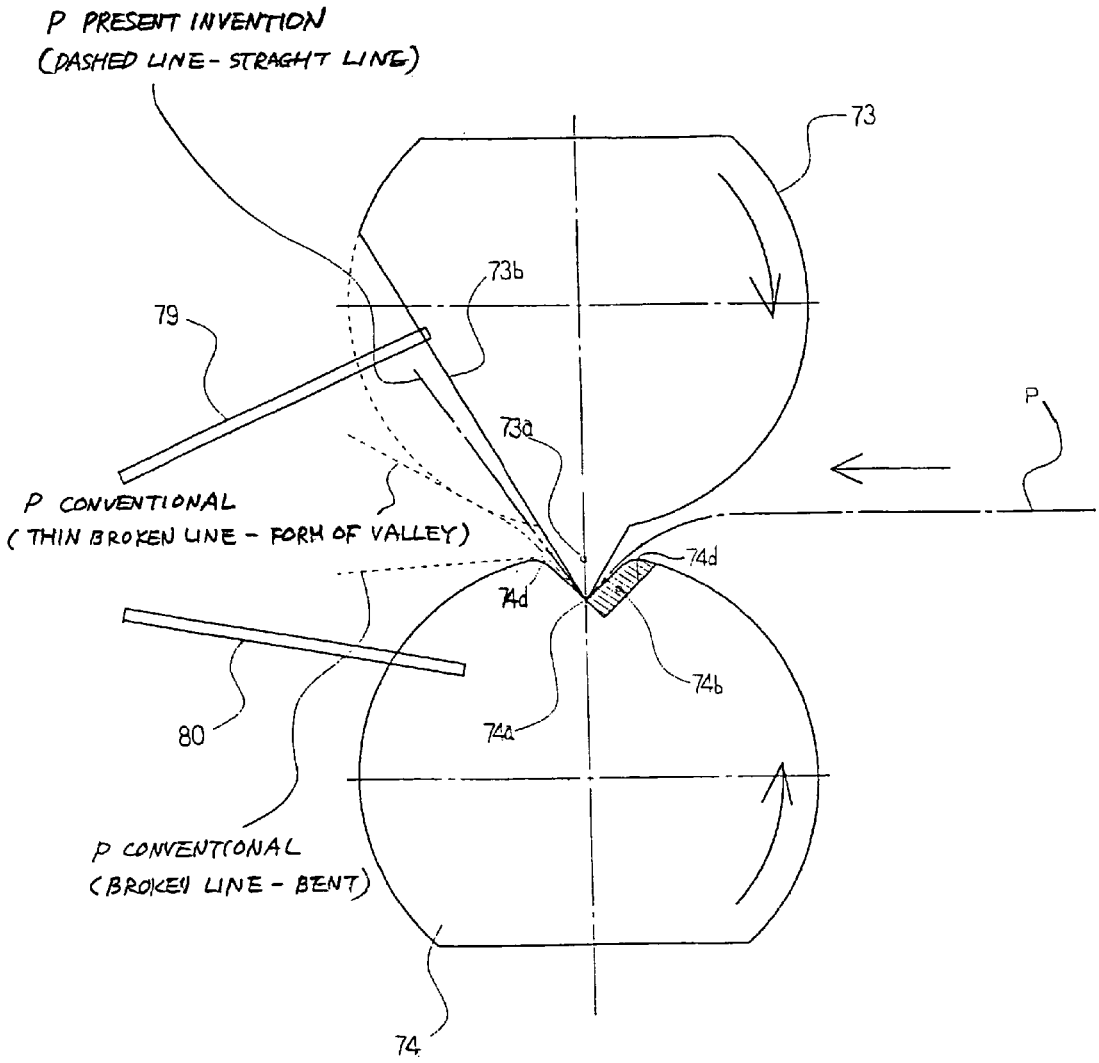
FIG. 36 is a side view showing the enlarged end section fold roller.

The operation at the moment of folding the end section as described above is shown in FIG. 35 and FIG. 36. As shown in FIG. 35, one of the walls of the groove 74*a* in the end section fold roller 74 is provided with an elastic body 74*b*. Immediately before the indented portions of the end section fold rollers 73, 74 are fitted to each other at the position of the fold line on the end section, the protrusion 73*a* of the end section fold roller 73 holds and rotates the paper at the position of its fold line by means of the elastic body 74*b* provided in the groove 74*a* in the end section fold roller 74, and folds back the end section of the paper while drawing the paper through. Then, the leading edge of the protrusion 73*a* in the end section fold roller 73 is fitted to the position at the bottom end of the groove 74*a* in the end section fold roller 74, as shown in FIG. 36, and the end section of the paper is folded back. At this moment, part of the circular arc portion of the end section fold roller 73, which is located downstream in the paper conveyance direction, is cut off so that the end section of the paper which is folded back does not contact the peripheral surface of the end section fold roller 73.

Figure 34:
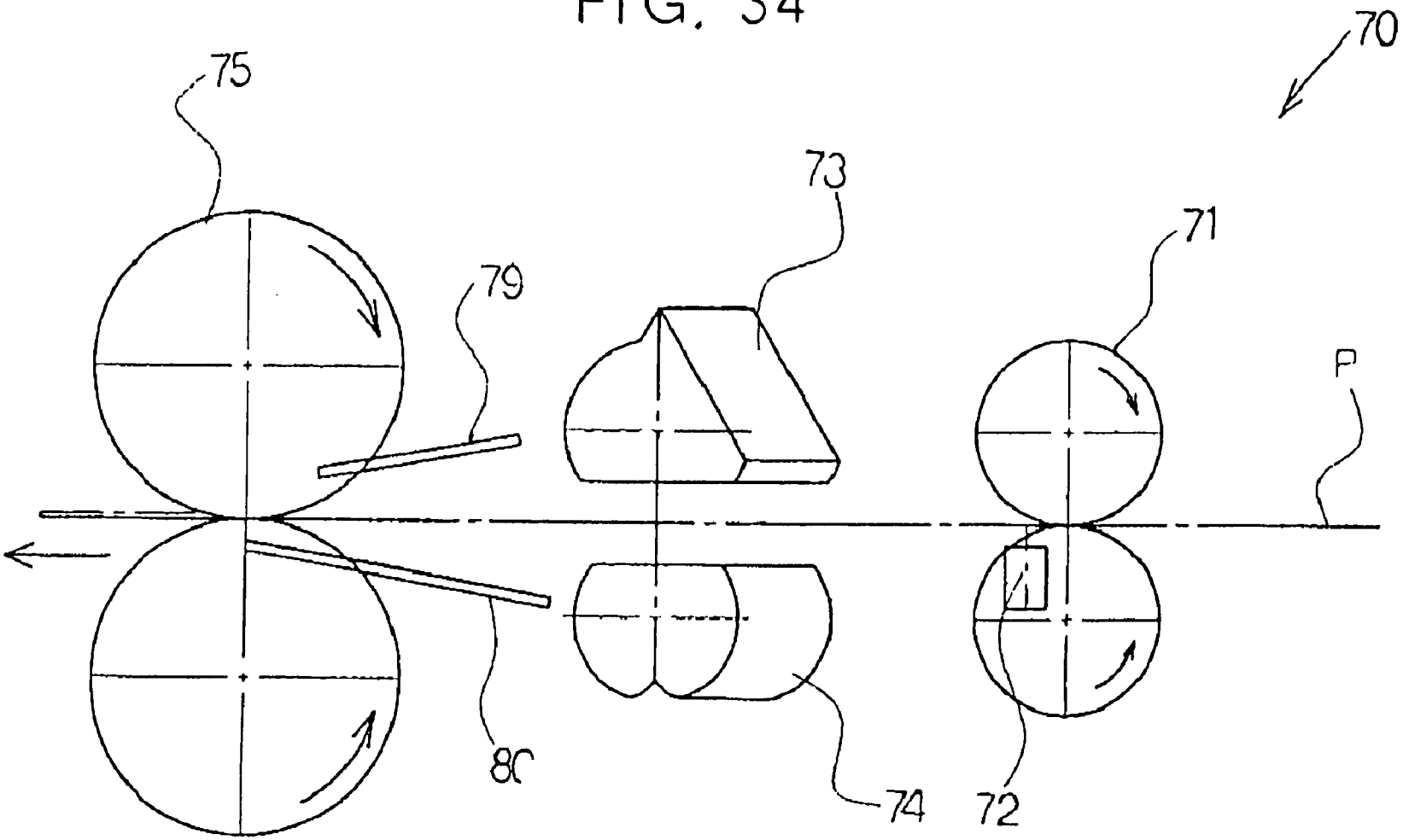
FIG. 34 is a figure showing a state in which an end section fold roller is in a withdraw position.

Further, in the groove 74*a* of the end section fold roller 74, an open edge portion 74*d* is formed into a curved surface. After a fold line is formed on the end section of the paper by the end section fold rollers 73, 74, the conveyance motor 110 and end section fold motor 93 continues to rotate, the paper gradually enters between the fold rollers 75 from the part of the fold line on the end section which is folded, and the part of the fold line part of the end section passes through the nip between the fold rollers 75 as shown in FIG. 34, the folded portion on the end section is folded back completely. At the same time, the paper fold controller 100 monitors whether or not the end section fold rollers 73, 74 reach the waiting position and the HP sensor 97 is switched ON (S9). When the HP sensor 97 is switched ON the end section fold motor 93 is stopped (S10), and the end section fold rollers 73, 74 remain in the waiting position. Thereafter, the conveyance motor 110 is stopped at the timing in which the rear edge of the paper passes through the nip between the fold rollers 75 (S11).

As described above, according to the ninth modification, a fold line is formed on the paper by the end section fold rollers 73, 74, and the end section of the paper in which the fold line is formed is further folded by the fold rollers 75, whereby the paper is folded back along the fold line. Thus, even in the case of strong paper such as heavy paper, not only the fold line of the paper is not broken, but also the angle of the fold line on the folded end section does not fluctuate, the paper is not bent, and wrinkles are not generated, so a paper jam rarely happens.

The end section fold rollers 73, 74 can optionally set the angle where the paper is disposed in the conveyance direction, the end section fold rollers can also optionally change the angle of a fold line of the folded end section.

When folding of the end section is not performed, the end section fold rollers 73, 74 can be shifted to the position where conveyance of the paper is not interrupted. Thus the paper gradually enters between the fold rollers 75 from the part of the fold line on the end section which is folded, and the fold line is applied with a weight locally so that the thickness of the paper when folded can be made thin. Further, since the end section fold rollers are shifted to the position where the conveyance is not interrupted, when folding of the end section is not performed the paper does not contact the end section fold rollers 73, 74, thus a paper jam rarely happens. Also, by folding the end section conveying the paper, the paper can be folded without causing the copy speed to be reduced.

Folding of the end section is performed by means of the protrusion 73*a* formed on the end section fold roller 73 and the groove 74*a* formed on the end section fold roller 74, thus formation of a fold line for folding the end section is possible with a simple configuration, and folding of the end section can be performed without causing fluctuation of fold accuracy regardless of the strength of the paper.

The elastic body 74*b* is provided on the groove 74*a* on the end section fold roller 74 so that the paper is not decentered easily due to friction of the elastic member 74*b*, thus folding of the end section can be performed without causing fluctuation of fold accuracy regardless of the strength of the paper.

The roller surface located downstream of the conveyance direction of the end section fold roller 73 is cut to a flat face, thus when the end section of the paper is bent by the end section fold rollers 73, 74, the end section of the paper which is bent and raised does not contact the roller surface of the end section fold roller 73 easily, and the paper with a folded line enters the fold rollers 75 while being bent in a form of a curvature or valley so as not to cause poor folding.

The open edge portion 74*d* of the groove 74*a* is formed into a curved face in the end section fold roller 74, thus the protrusion 73*a* of the end section fold roller 73 can enter and leave the groove smoothly, and a curl is prevented from being formed around the fold line, whereby generation of a paper jam at the time of conveyance can be prevented.

Figure 40:
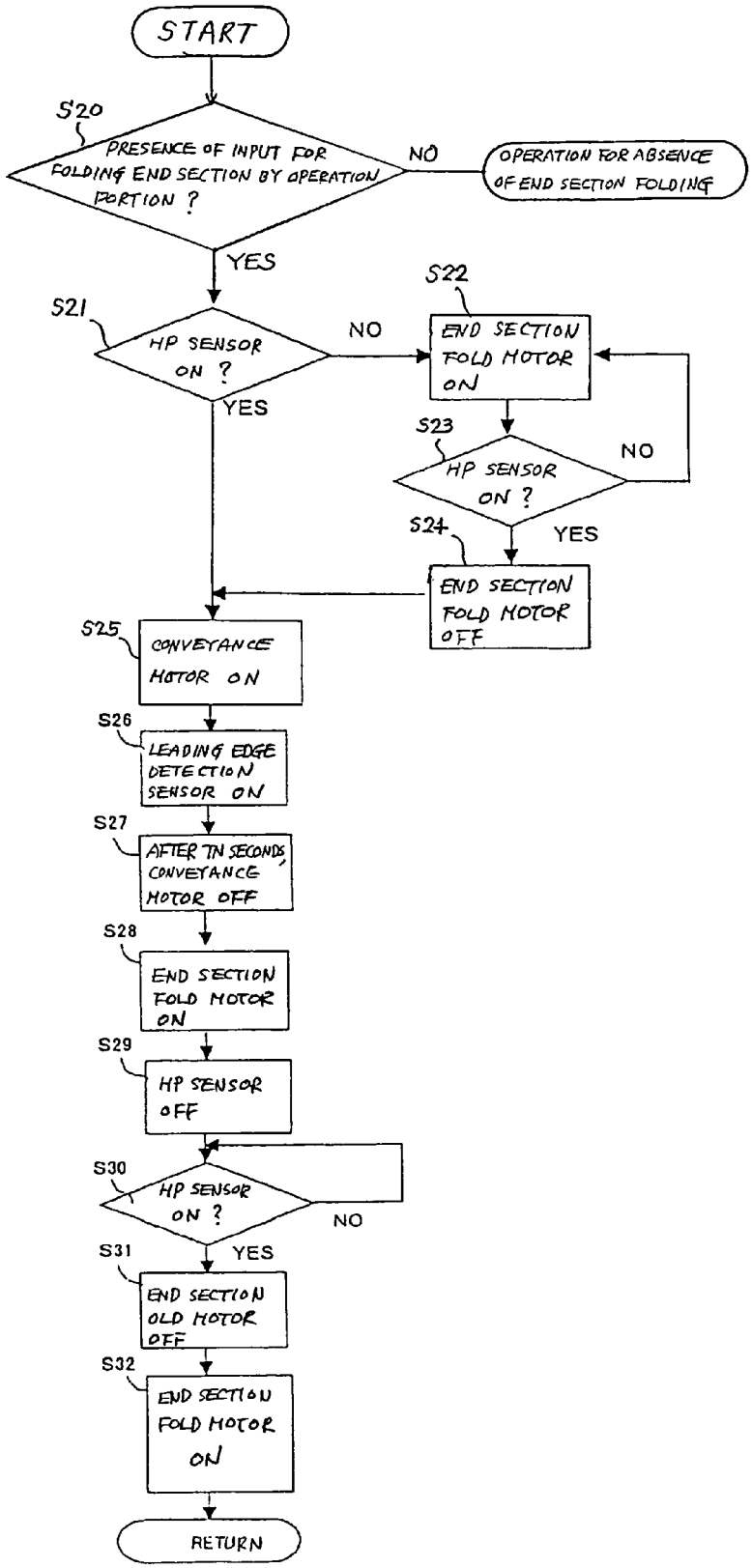
FIG. 40 is a flow chart showing the paper conveyance movement of the tenth modification.

Next, FIG. 32 and FIG. 40 are used to explain the tenth modification. In the ninth modification described above, folding of the end section is performed by means of the indented portions (protrusion 73*a*, groove 74*a*) of the end section fold rollers 73, 74, while conveying the paper. In this modification, on the other hand, the operation of folding the end section is performed in the state in which the conveyance of the paper is stopped temporarily.

In the flow chart shown in FIG. 40, operations up until S26 are same as the operations up until S6 in the ninth modification as shown in FIG. 39, and the conveyance motor 110 is operated and to stop the paper or ts seconds until the position for forming a fold line on the end section matches the position for fitting the indented portions of the end section fold rollers 73, 74 to each other (S27). Then, the paper is stopped in the state in which the position for forming a fold line on the end section matches the position for fitting the indented portions of the end section fold rollers 73, 74 to each other. Thereafter the end section fold motor 93 starts to rotate, the end section fold rollers 73, 74 rotate in the direction of the arrows shown in FIG. 32, the indented portions of the end section fold rollers 73, 74 are fitted to each other at the position of the fold line on the end section, and the end section is folded back (S28, S29).

During this time, the paper fold controller 100 monitors whether or not the end section fold rollers 73, 74 reach the waiting position and the HP sensor 97 is switched ON (S30). When the HP sensor 97 is switched ON the end section fold motor 93 is stopped (S31), and the end section fold rollers 73, 74 remain in the waiting position. At that moment, the leading edge of the paper does not move since the conveyance motor 110 is stopped, but if the rear end side of the paper still remains on the copying machine device main body 200 side as shown in FIG. 30, the ejection roller 211 continues to convey the paper to the paper folding apparatus 1, and the sag of the paper is moved from the position indicated with the broken line to the position indicated with the solid line by the entrance guide plate 61 due to the movability of the entrance guide plate 61 of the coupling portion 60, whereby the paper is ejected from the copying machine device main body 200 side while the conveyance of the leading edge of the paper is stopped.

Next, when the end section fold rollers 73, 74 return to the waiting position, the conveyance motor 110 rotates to convey the paper, the paper gradually enters the fold rollers 75 from the fold line part at the leading edge, and when the fold line part of the end section passes through the nip portion of the fold rollers 75 as shown in FIG. 34, the end section is folded back completely. Thereafter the conveyance motor 110 is stopped at the timing in which the rear end of the paper passes through the nip portion of the fold rollers 75 (S32).

In this manner, in the tenth modification, folding of the end section is performed in the state where the paper is stopped, thus even in the case of a low coefficient of friction on the paper surface when the toner is applied to the whole area of the paper such that a color is output, wrinkles or bending does not occur, and a paper jam or the like rarely happens.

Next, the eleventh modification is described.

Figure 2:
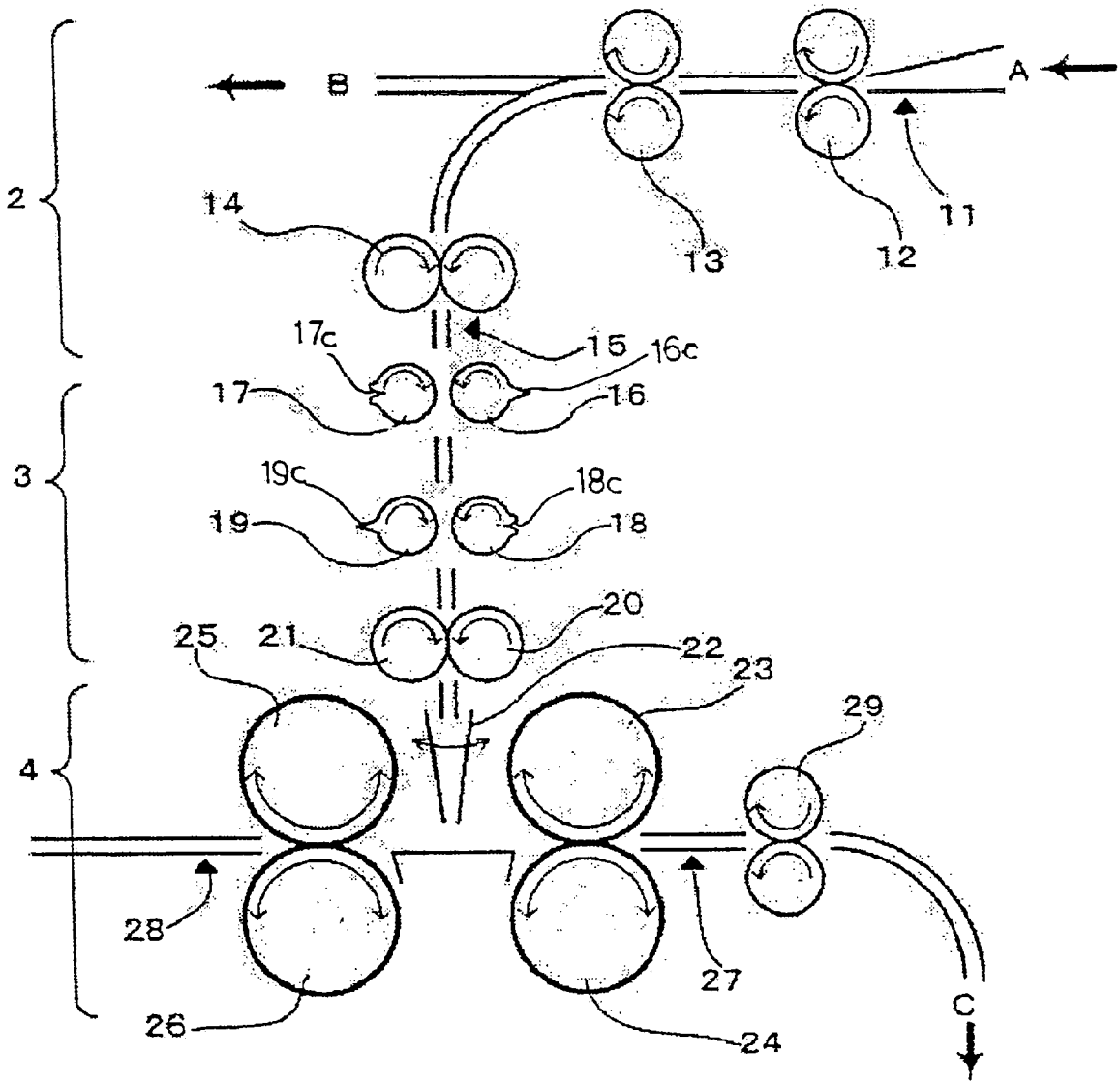
FIG. 2 is a side view showing an enlarged configuration of a substantial part of the paper folding apparatus.

In the eleventh modification, the two pairs of rollers 23 through 26 in the second bellows fold portion 4 shown in FIG. 2 are characterized by the surface of each of the rollers. The second bellows fold portion 4 has a configuration such that the two pairs of rollers are arranged farther apart from each other, and, in the respective pairs of the rollers, the coefficients of friction of the roller surfaces of the second fold rollers 23, 25 provided on the upper part are set to be lower than those on the second fold rollers 24, 26 provided in the lower part of same (upper part: metallic rollers, lower part: rubber rollers). The paper travels back and forth between the right and left pairs of fold rollers 23 through 26, and thereby is folded in bellows.

In this manner, in the respective pairs of the rollers, since the coefficients of friction of the roller surfaces of the second fold rollers 23, 25 provided on the upper part are set to be lower than those on the second fold rollers 24, 26 provided in the lower part of same, when the fold line D formed by the first bellows fold portion 3 is held between the second fold rollers, the upper face side of the paper P, with the fold line D as a boundary, contacts the left side of the second fold roller 25 on the upper side, but the paper is held by the second pair of fold rollers 25, 26, with the fold line D as the leading edge of the paper, without being pulled by the gripping power of the second fold roller 25 on the upper side. Therefore, double folding can be minimized, and, even in the case of large-sized paper, a desired size of a fold line can be formed securely by means of a small and simple apparatus, and the thin sheaf of folded papers can be produced.

The roller hardness of one of the roller pair configuring the second folding means is made softer than the other roller hardness (upper side: metallic roller, lower side: rubber roller), thus multiple nip parts can be formed with an applied pressure smaller than general conveying rollers. Therefore, a roller load is reduced, miniaturization of a roller drive unit leads to miniaturization and low cost of the paper folding apparatus, and a thin sheaf of folded papers can be produced.

The twelfth modification is described next.

In this twelfth modification in the two pairs of rollers 23 through 26 in the second bellows fold portion 4, the rollers configuring the second bellows fold portion 4 are metallic rollers, and the coefficients of friction on all of the roller surfaces (second fold rollers 23 through 26) are set to be low. When the fold line D formed by the first bellows fold portion 3 is held between the second fold rollers of the second bellows fold portion 4, the upper face side of the paper P, with the fold line D as a boundary, contacts the left side of the second fold roller 25 on the upper side, but since the left side of the second fold rollers 25 is a metallic roller, and the coefficient of friction of its surface is set low, the paper is held by the second pair of fold rollers 25, 26, with the fold line D as the leading edge of the paper, without being pulled by the gripping power of the left side of the second fold roller 25 on the upper side.

The left side of the second fold roller 26 on the lower side configuring the second bellows fold portion 4 is a metallic roller, and the coefficient of friction of the roller surface thereof is set low. Therefore, the lower section of the paper P with the fold line D as a boundary is not held between the second pair of left rollers 25, 26 while being pulled by the gripping power of the left second fold roller 26 on the lower side, but the paper with the fold line D as the leading edge of the paper is held between the second pair of left rollers 25, 26 by the conveying force from the pair of conveying rollers 14 and the conveying force from the second pair of right fold rollers 23, 24.

All of the rollers 23 through 26 of the second fold pair of rollers are metallic rollers, and the surfaces of the rollers are made such that the paper can slide easily when contacting the rollers. Therefore, when holding the fold line formed by the first bellows fold portion 3, and when the upper section of the paper with the fold line as the boundary contacts the upper side of the second fold rollers, the paper is held between the second pair of rollers, with the fold line as the leading edge of the paper, without being pulled by the gripping force of the second fold rollers 25 on the upper side. Further, the left side of the second fold roller 26 on the lower side is a metallic roller, and the coefficient of friction of its surface is set low, thus the lower section of the paper with the fold line as a boundary is not held between the second pair of left rollers 25, 26 while being pulled by the gripping power of the left second fold roller 26 on the lower side, but the loop formed having the fold line D as the leading edge is held between the second pair of rollers by the conveying force from the pair of conveying rollers and the conveying force from the second pair of right fold rollers 23, 24 on the opposite side, thus the papers can be produced without double folding them, and, even in the case of large-sized paper, a desired size of a fold line can be formed securely by means of a small and simple apparatus, and the thin sheaf of folded papers can be produced.

It should be noted in the above-described first embodiment and each of the modifications thereof that a fold line is formed on paper after completion of image formation by providing the copying machine main body 200 next to the paper folding apparatus 1, but the limitations are not made to this, thus the paper folding apparatus 1 may be used independently.

According to the first embodiment and each of the modifications thereof, the first folding means for forming a fold line on paper, and the second fold portion for further folding the paper along the fold line formed by the first folding means are provided. Therefore, even in the case of large-sized paper, for example, the paper can be folded securely by using the two folding means.

Second Embodiment

Hereinafter, the edge folding device as the paper folding apparatus of this second embodiment is described in detail based on FIGS. 41 through 50.

It should be noted that the second embodiment described an example of the edge folding device for forming a fold line on an edge of paper, but the second embodiment is not limited to the edge of the paper, and can be applied to a device for forming a fold line on any position on the paper.

Figure 41:
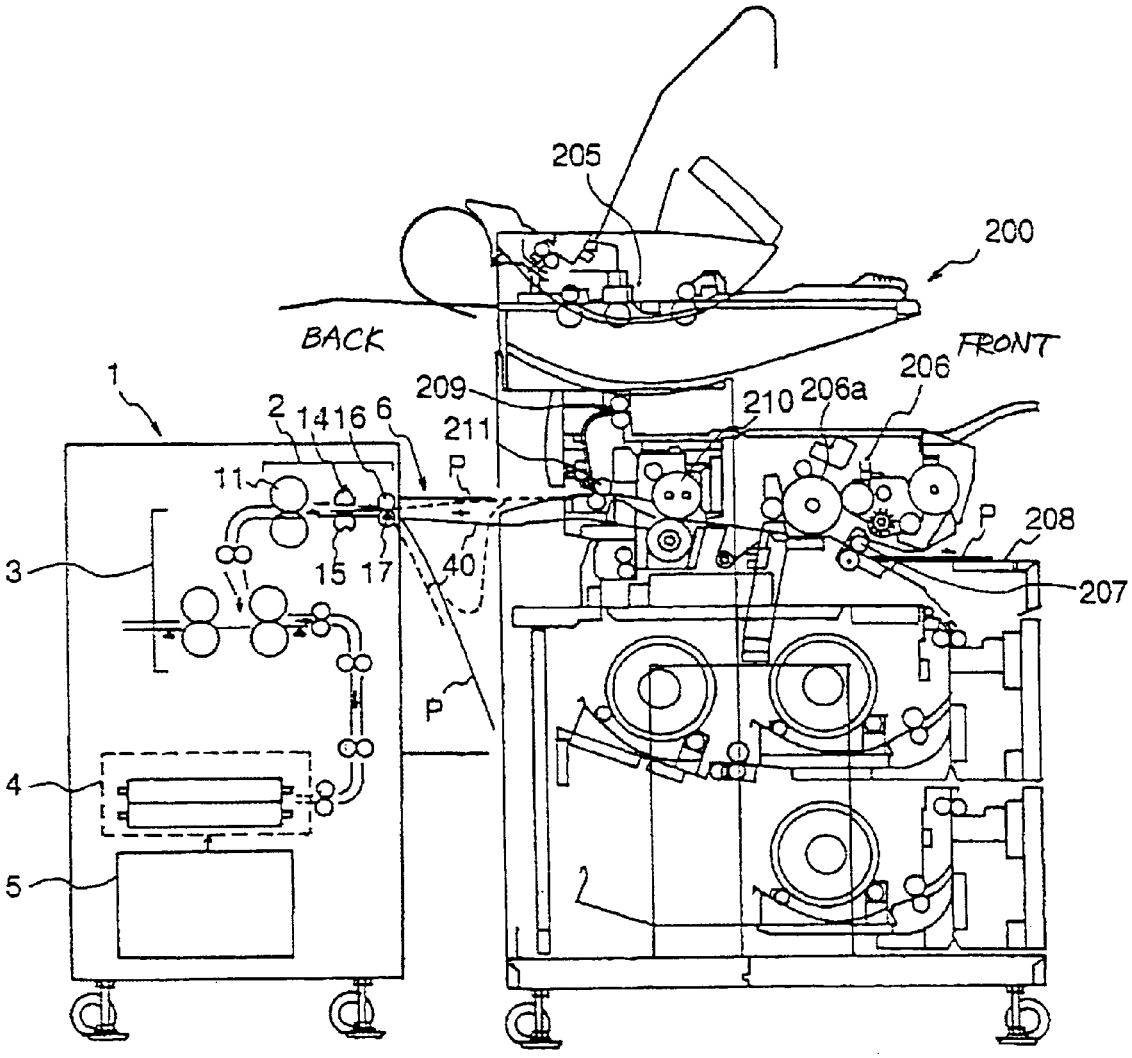
FIG. 41 is a cross sectional view showing a schematic configuration of an edge folding device (paper folding apparatus) and of a copying machine to which the edge folding device is coupled as a finisher according to a second embodiment of the present invention.

FIG. 41 shows a schematic configuration of an edge folding device (paper folding apparatus) of the second embodiment and of a copying machine to which the edge folding device is connected as a finisher. In this figure, reference numeral 200 indicates the copying device main body (image forming apparatus main body), reference numeral 1 indicates the edge folding device as a finisher which is coupled to the side face on the paper ejection side of the copying device main body 200. The edge folding device (paper folding apparatus) 1 comprises a coupling portion 6 connected to the device main body 200, an edge fold portion (paper fold portion) 2 for folding en edge at the leading edge of paper P, a bellows fold portion 3 for folding the paper in bellows in the conveyance direction, a cross fold portion 4 for folding the paper, which is folded in bellows by the bellows fold portion 3, into A4 sized paper in the vertical direction, and a stacker portion 5 for ejecting the paper folded into A4 size by the cross fold portion 4 and stacking same.

In the copying device main body 200, an image reading device 206 is disposed, below which a manual paper feeding tray 208 is disposed. When feeding paper which is set on the manual paper feeding tray 208, the paper is suspended by a resist roller 207, and is fed to an imaging unit 206 according to the timing. The imaging unit 206 is designed such that a latent image formed on a photoreceptor 206*a* so as to correspond to the image data is developed by toner, and the toner is transferred onto the paper and fixed by a fixing device 210. The recorded paper on which the toner is fixed by the fixing device 210 is then ejected to the paper folding apparatus 1 by a recorded paper ejection roller 211 when folding the paper. When folding of the paper is not performed, the paper is led to an upper ejection roller 209 by an unshown switching claw, and ejected into the core of the main body.

When folding the paper next, the paper P is sent to the edge folding device 1 by the recorded paper ejection roller 211, passes the coupling portion 6, and then the paper is sent by a pair of entrance conveying rollers 16 of the edge fold portion 2, and when folding the edge of the paper, the edge at the leading edge of the paper is folded by the edge fold portion 2. As the patterns of folding the edge of the paper, there are two patterns of folding the edge of the paper while conveying the paper, and folding the edge of the paper while temporarily stopping conveyance of the paper. When folding the edge while temporarily stopping conveyance of the paper by means of the edge fold portion 2, the rear end of the paper sometimes touches the copying device main body 200, thus, in such a case, while the copying device main body 200 continues to convey the paper, a movable entrance guide plate 40, which is provided in the coupling portion 6 and moves vertically, opens downward as shown with the dashed lines to let the middle portion and rear portion of the paper withdraw downward. Therefore, ejection of the paper P from the copying device main body 200 can be continued while conveyance of the leading edge of the paper P is stopped.

After the edge at the leading edge of the paper P is folded b the edge fold portion 2, the paper is folded in bellows in the conveyance direction by the bellows fold portion 3, and the paper is further folded into A4 size paper by the cross fold portion 4 and stacked by the stacker 5.

Next, the edge fold portion 2 is described.

Figure 48:
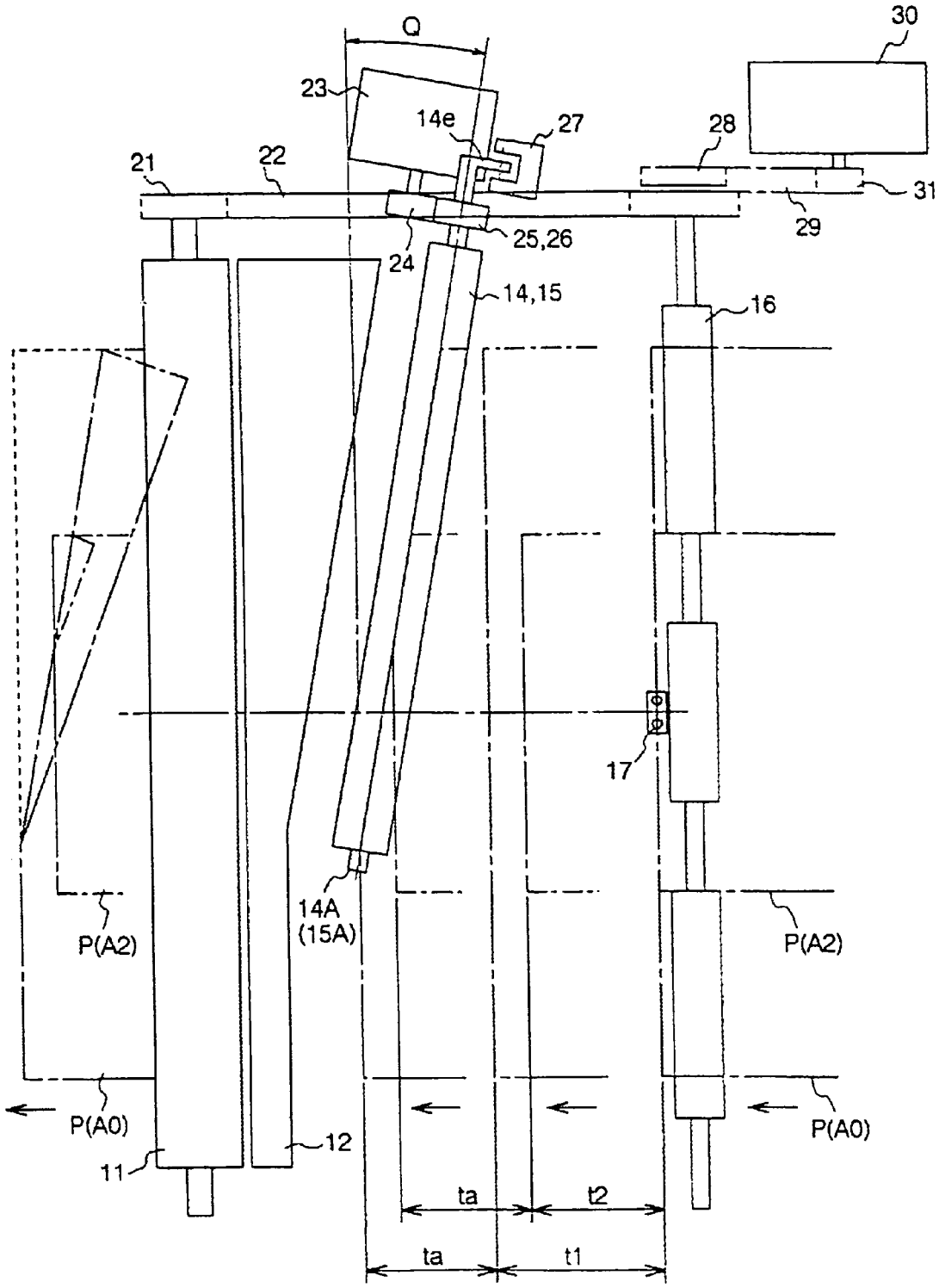
FIG. 48 is a plan view showing a configuration of the edge folding device.
Figure 49:
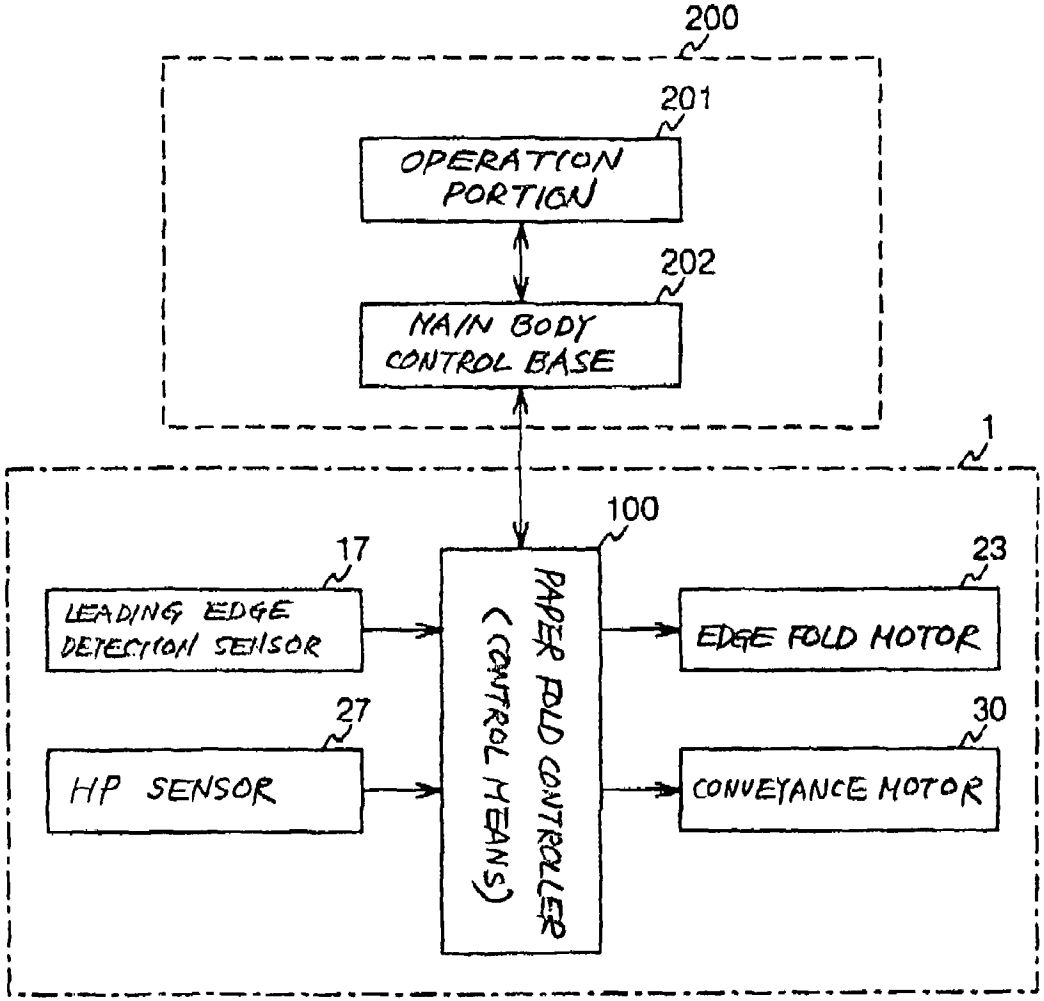
FIG. 49 is a block diagram showing a configuration of a control system of the edge folding device.
Figure 50:
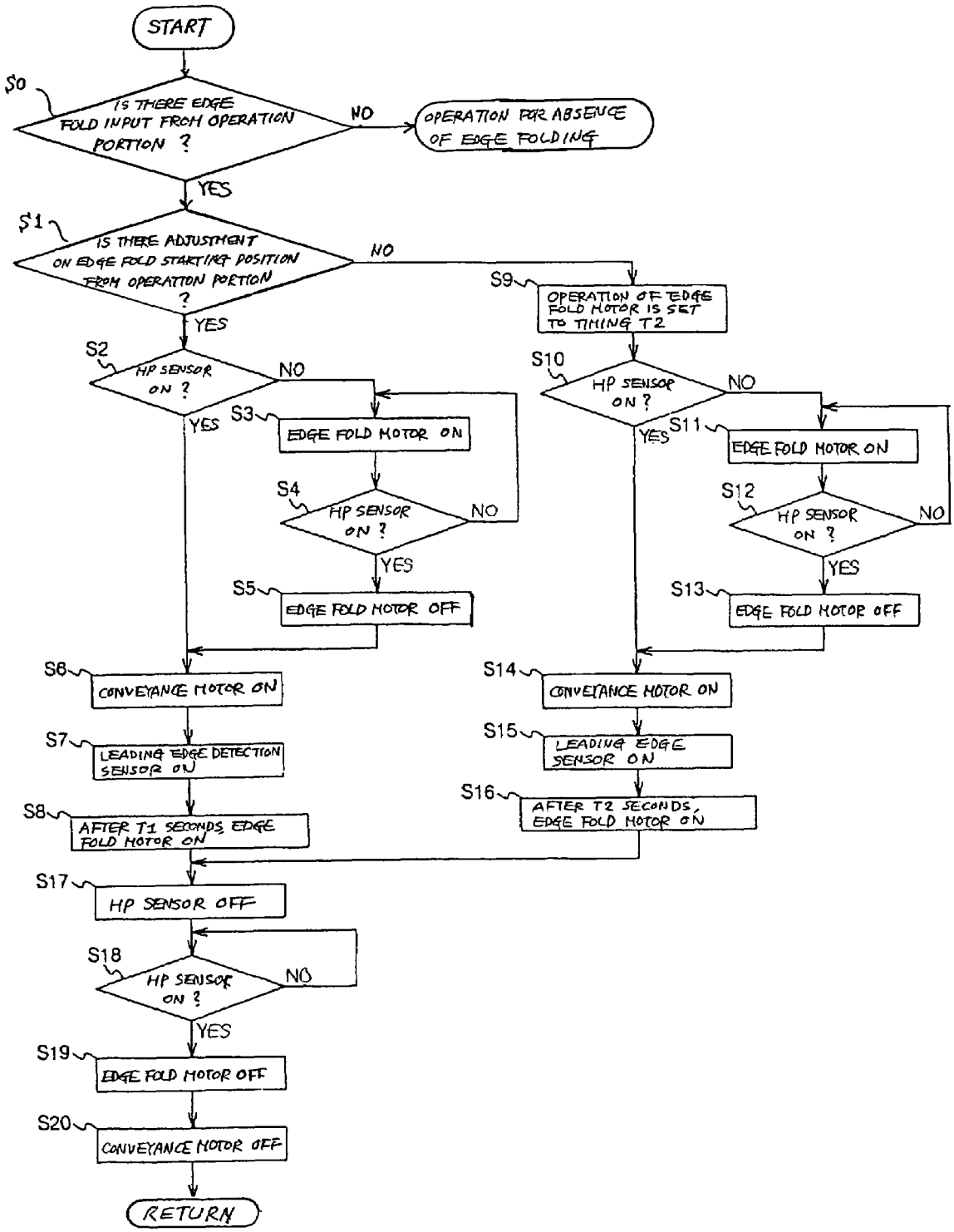
FIG. 50 is a flow chart showing an operation according to the second embodiment.

As shown in FIG. 48, a leading edge detection sensor 17 for detecting a leading edge position of paper is arranged downstream and in the vicinity of the center in the axial direction of the entrance conveying roller (paper conveying means) 16. Moreover, there are arranged further downstream an edge fold roller (first paper fold roller, first paper folding means) 14 in which a roller shaft center is disposed so that an angle Q (angle between the conveyance direction and the with direction perpendicular to the conveyance direction) of a fold line of the folded edge, and an edge fold roller (second paper fold roller, second paper folding means) 15. Further, there is disposed further downstream a pair of fold rollers (paper conveying means) 11 in which the paper conveyance direction which is at right angles with the roller shaft center. Specifically, while the pair of fold rollers 11 extend in parallel (conveyance direction and orthogonal direction) with the width direction, the edge fold rollers 14, 15 are configured so as to intersect with each other by the angle Q. it should be noted that, as shown in FIG. 48, in the edge fold rollers 14, 15 an axial end portions 14A, 15A are pivotally supported in a lateral direction, thus the edge fold rollers 14, 15 turn within a predetermined angle switch range, with the axial end portions 14A, 15A as the turning centers, whereby the angle Q with respect to the width direction can be switched.

It should be noted that the paper conveying means is a conveying path inside the edge folding device, which includes the conveying path running from, for example, the pair of rollers 16 to the pair of rollers 11.

In the other axial end portion of the entrance conveying roller 16, a pulley 28 is fixed by the center of axis thereof, and in the other axial end portion of the fold roller 11 a pulley 21 is fixed. The pulleys 21, 28 are coupled to each other by a drive belt 22, and receive transmission of the driving force.

Furthermore, the pulley 28 of the entrance conveying roller 16 is coupled to a pulley 31 fixed by an output shaft of a conveyance motor (paper conveying means) 30 via a drive belt 29, and the fold roller 11 and the entrance conveying roller 16 are rotated and stopped by the conveyance motor 30.

The edge fold rollers 14, 15 are not in the shape of a complete cylinder and have different shapes. The edge fold roller (convex roller) 14 has a convex portion (fold line formation portion) 14*a* protruding at a sharp angle from a part of the periphery, an inclined-side face 14*b* in which an inclined face located downstream in the rotation direction of the convex portion 14*a* is extended, a flat surface portion 14*c* in which the other edge of the inclined-side face 14*b* is bent, and a circular arc portion 14*d* for coupling the flat surface portion 14*c* to the other inclined-side bottom portion of the convex portion 14*a*. the portions 14*b*, 14*c* other than the convex portion 14*a* are configured so as to fit in the round periphery in which the circular arc portion 14*d* is formed in an extended fashion. It should be noted that reference numerals 24, 25, 26 are gears shown in FIG. 48 as well.

Also it should be noted that the convex portion 14*a* is shown as a protrusion having a sharp angle in this example, but this is merely an example, so the entire shape and the shape of the leading edge of the convex portion 14*a* can be changed variously according to the shape of a fold line to be formed. Therefore, for example, the leading edge may be formed to be even or into a circular arc, or the entire shape may be formed to have a blunt angle or into a rectangle.

In the edge fold roller (concave roller) 15, a part of the periphery is a concave portion (fold line formation portion) 15*a* configured so as to fit into the convex portion 14*a* of the edge fold roller 14, in which a flat surface portion 15*c* is formed in a position (periphery) which faces the convex portion 15*a*, and a circular arc portion 15*b* is formed between the concave portion 15*a* and the flat surface portion 15*c*. the shape of the concave portion 15*a* can be changed in accordance with the change of the shape of the convex portion 14*a*.

It should be noted that the surfaces of the flat surface portions 14*c*, 15*c* do not have to be flat and not bother each other in a waiting state, and may be somewhat convex and concave as long as a gap, which is big enough to allow the paper pass through, is formed.

Figure 42:
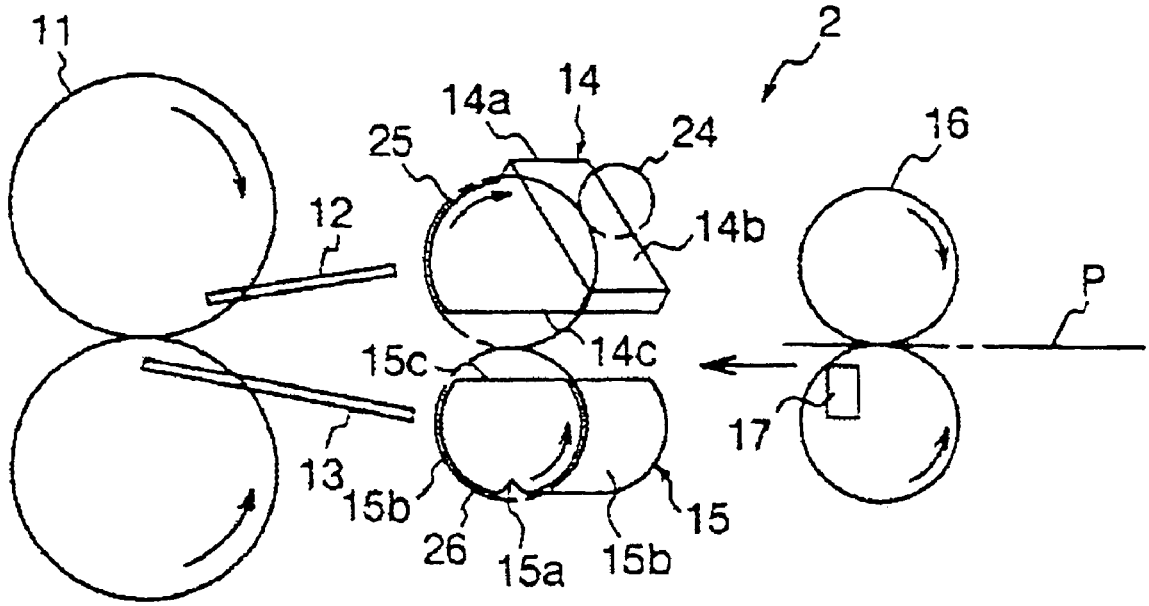
FIGS. 42 through 45 are front views for explaining the operation of the edge folding device.
Figure 43:
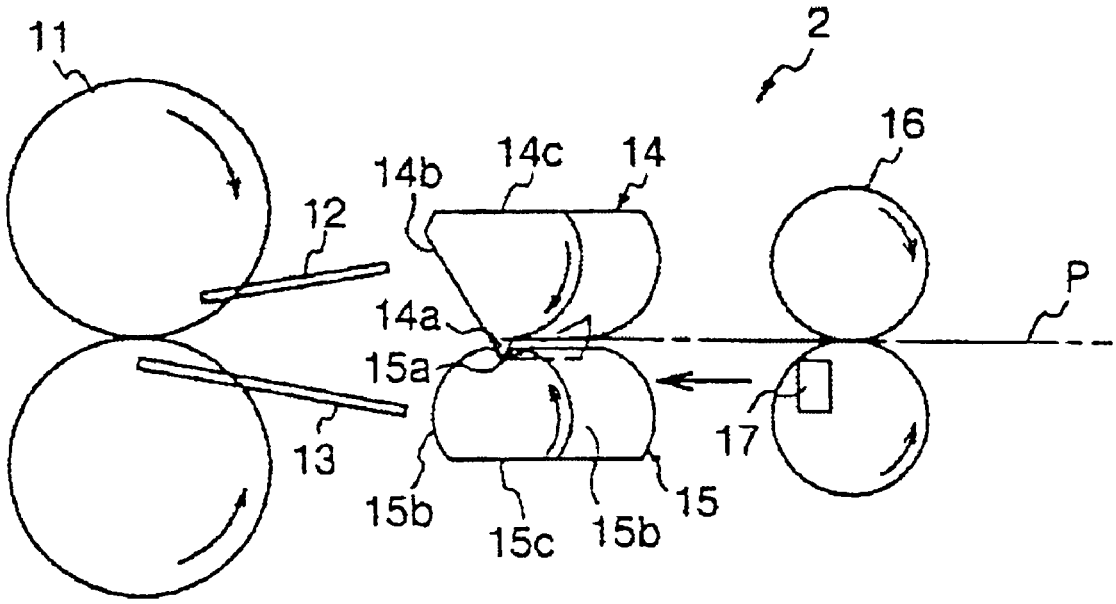

The convex portion 14*a* and the convex portion 15*a* fit to each other, as shown in FIG. 43, to form a fold line on the edge of the paper. Further, the flat surface portions 14*c*, 15*c* provided on the edge fold rollers 14, 15 face each other in parallel with respect to the paper conveying path in the normal waiting position as shown in FIG. 42, thereby forming a paper conveyance gap, so as to protect conveyance of the paper. Therefore, when the edge is not folded, the edge fold rollers 14, 15 remain in the waiting position shown in FIG. 42. Further, the gear 25 is fixed in the axial end of the edge fold roller 14, and the gear 26 is fixed in the edge fold roller 15, and the both gears 25, 26 are engaged with each other. The gear 25 is further coupled to the gear 24 which is fixed to an output shaft of an edge fold motor (paper fold motor) 23. Therefore, the edge fold rollers 14, 15 are rotated and stopped by the edge fold motor 23 and are subjected to control of drive.

As further shown in FIG. 48, the edge fold roller 14 (or the edge fold roller 15) has a light protection portion 14*e* at the axial end portion, the light protection portion protruding to the external diameter direction. The light protection portion 14*e* protects a hone position sensor 27 ("HP sensor" hereinafter) from light at the waiting position of the edge fold roller 14, 15, and the HP sensor 27 transmits an ON signal at this moment, whereby the controlling means detects the waiting position. Specifically, the protruding angle of the light protection portion 14*e* is set such that the HP sensor 27 can detect whether or not the flat surface portions 14*c*, 15*c* of the edge fold rollers 14, 15 face each other in parallel (state shown in FIG. 42).

Moreover, as a configuration of the control system, as shown in FIG. 48, the operation portion 201 equipped in the copying device main body 200 performs selection on whether the user folds paper or not, and, when the user folds paper, an input operation for folding or not folding the edge. The input signal is transmitted to the main body control base (controlling means) 202, and to the paper fold controller (controlling means) 100 equipped in the edge folding device 1, and control for executing paper fold operation is performed. Further, the edge fold operation is controlled by the paper fold controller 100, and rotation and stop control of the edge fold motor 23 and conveyance 30 are performed based on the input signal of the edge detection sensor 17 and HP sensor 27.

Next, the operation of the second embodiment is described according to the FIGS. 41 through 45, 49, and 50.

First, when an edge fold signal is output by operation of the operation portion 201 on the main body side (step S0 in FIG. 50), the signal is input to the paper fold controller 100 via the main body control base 202. Next, when folding the edge, selection is made for the size of the paper on which the edge is folded, and for whether or not to adjust the a starting position for folding the edge of the paper (S1), and a signal for a result of selection is input to the paper fold controller 100.

Here, when the starting position for forming a fold line is not performed, the paper fold controller 100 checks whether or not the edge fold rollers 14, 15 are in the waiting position, based on the signal of the HP sensor 27 (S2). When the HP sensor 27 is not ON, the edge fold motor is rotated (S3). When the edge fold rollers 14, 15 come to the waiting position, the HP sensor 27 is switched ON (S4), and he edge fold motor is stopped (S5). In this state the conveyance motor 30 starts to rotate (S6), the fold roller 11 and entrance conveying roller 16 rotate in the directions of the arrow as shown in FIG. 42 to wait for the recorded paper to be sent by the ejection roller 211 of the copying machine main body 200. When the paper reaches the entrance conveying roller 6 as shown in FIG. 42, and the leading edge of the paper switches ON the leading edge detection sensor 17 (S7), t1 seconds thereafter, the edge fold motor 23 also starts to rotate such that the indented portions of the edge fold rollers 14, 15 fit to each other in the position for forming a fold line on the paper, and the edge fold rollers 14, 15 start to rotate in the directions of the arrows shown in FIG. 42 (S8). After ta seconds, the indented portions of the edge fold rollers 14, 15 fit to each other in the position for forming a fold line on the paper as shown in FIG. 43, and a predetermined length of the paper is folded from the edge at a predetermined angle.

When adjusting the starting position for folding the edge at the leading edge of the paper, the operation portion 201 of the copying machine main body 200 performs input operation for adjusting the starting position for folding the edge, and a signal for it is input into the paper old controller 100. An operation start timing t2 of the edge fold motor 30 is calculated based on the input value, and this timing is set in the memory of the paper fold controller 100 (S9). Then, the operation is carried out as in the steps S10 through S15 as in the case where the starting position is not adjusted (S2 through S7). Specifically, the paper fold controller 100 checks whether or not the edge fold rollers 14, 15 are in the waiting position, based on the signal of the HP sensor 27 (S10). If the HP sensor 27 is not ON, the edge fold motor is rotated (S11). When the edge fold rollers 14, 15 come to the waiting position, the HP sensor 27 is switched ON (S12), and the edge fold motor is stopped (S13). In this state the conveyance motor 30 starts to rotate (S14), and the fold roller 11 and entrance conveying roller 16 rotate in the directions of the arrow as shown in FIG. 42 to wait for the recorded paper to be sent by the ejection roller 211 of the copying machine main body 200. When the paper reaches the entrance conveying roller 16 as shown in FIG. 42, and the leading edge of the paper switches ON the leading edge detection sensor 17 (S15), t2 seconds thereafter, the edge fold motor 23 also starts to rotate such that the indented portions of the edge fold rollers 14, 15 fit to each other in the position for forming a fold line on the paper, and the edge fold rollers 14, 15 start to rotate in the directions of the arrows shown in FIG. 42 (S16). After a lapse of ta seconds since t2 seconds elapsed after the leading edge is detected by the leading edge detection sensor, the indented portions of the edge fold rollers 14, 15 fit to each other in the position for forming a fold line on the paper as shown in FIG. 43, and a predetermined length of the paper is folded from the edge at a predetermined angle.

Figure 44:
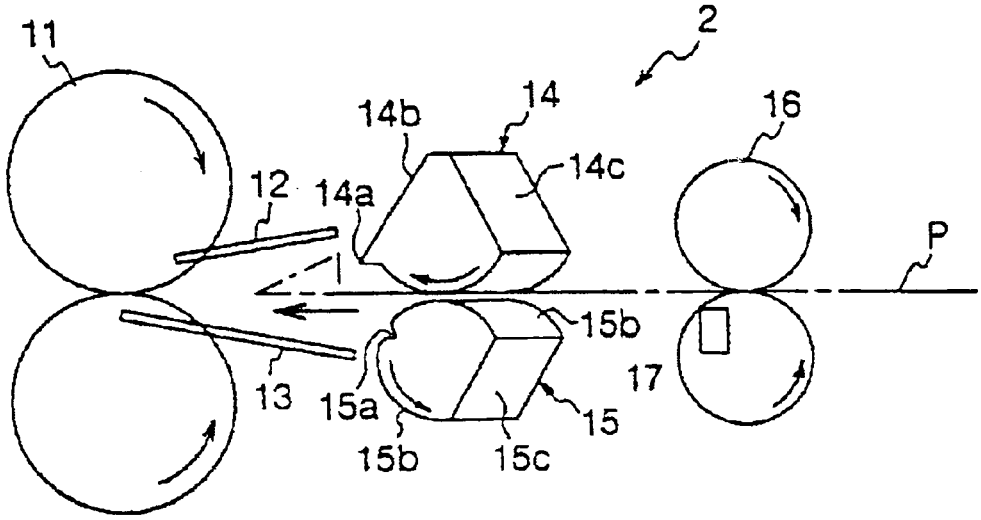
Figure 45:
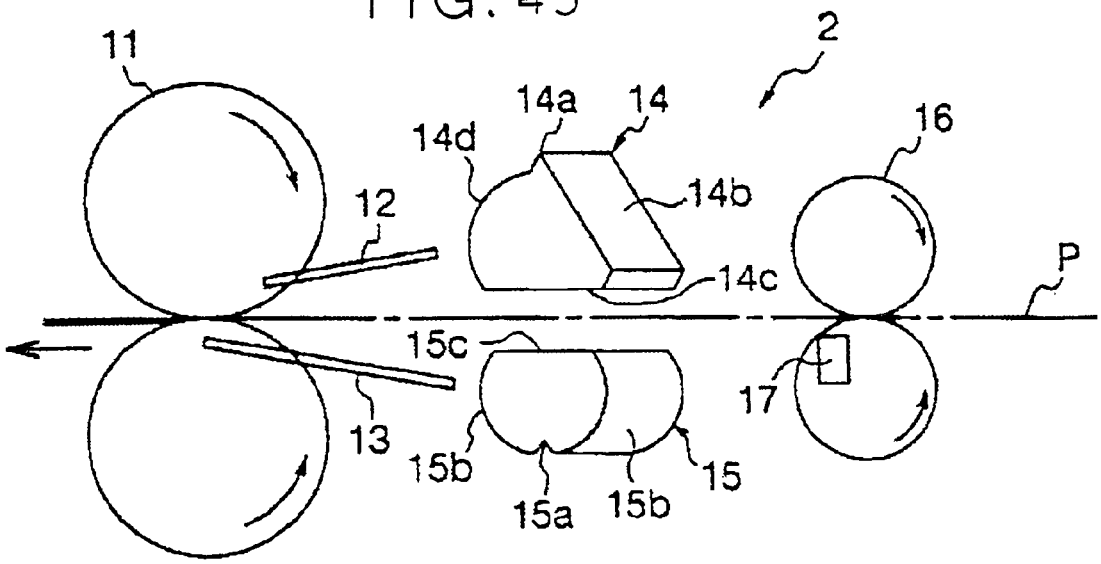
Figure 47:
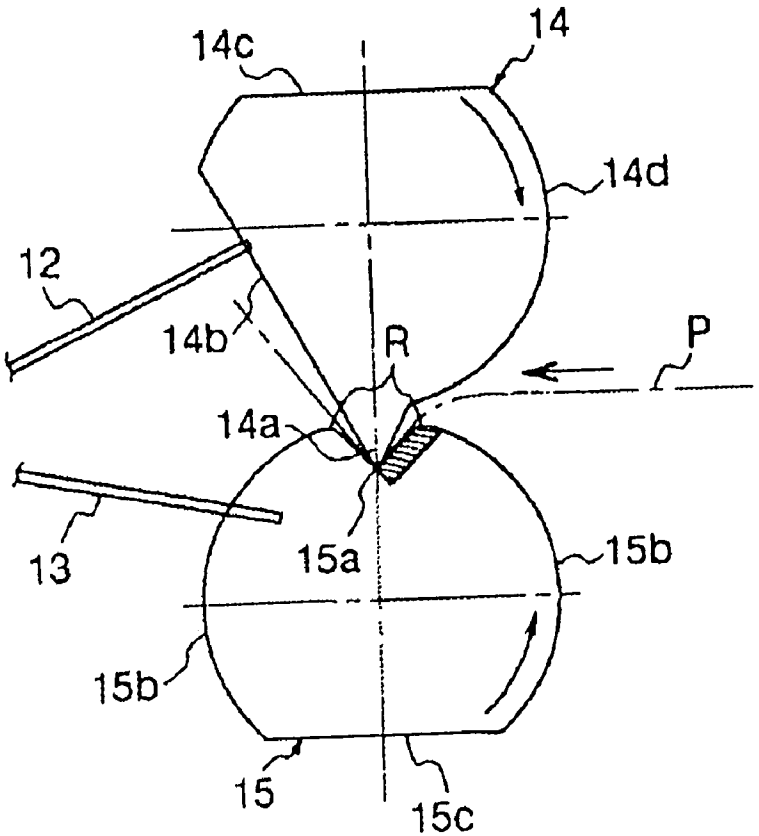
FIGS. 46 and 47 are figures for explaining a situation where the edge fold roller forms a fold line on paper.
Figure 46:
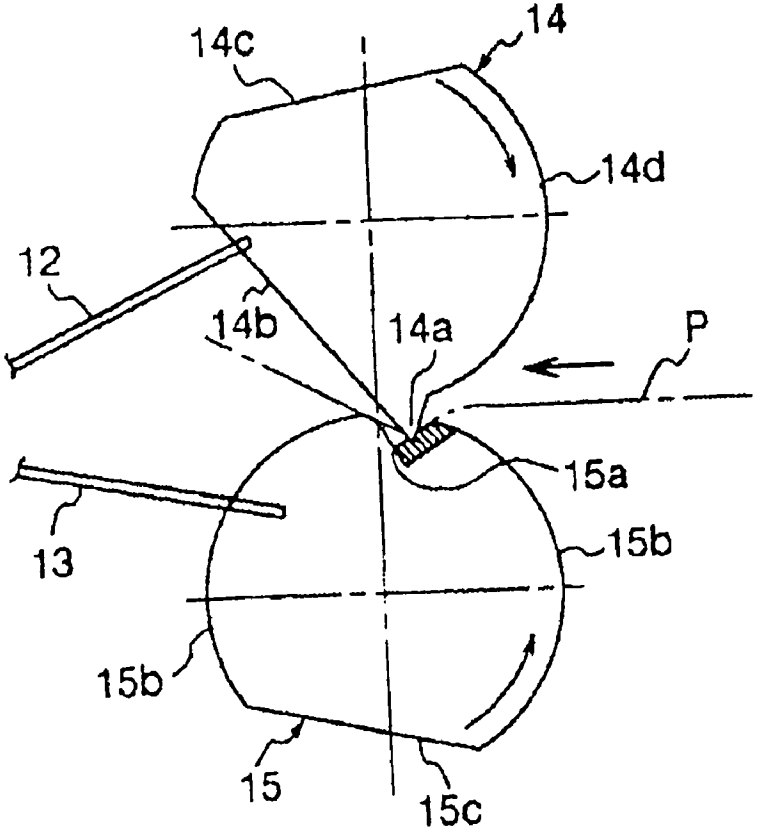

Thereafter, the starting position for folding the edge is adjusted, or, regardless of adjusting or not, a fold line is formed on the paper as shown in FIG. 44, the conveyance motor 30 and he edge fold motor 23 rotate to continue conveying the paper, and the paper gradually enters the fold roller 11 from the portion where the fold line is formed. When the portion where the fold line is formed on the edge passes through the nip of the fold roller 11 as shown in FIG. 45, the fold of the edge is folded back completely. At the same time, the paper fold controller 100 monitors whether or not the edge fold rollers 14, 15 reach the waiting position and the HP sensor 27 is ON (S18), and when the HP sensor 27 is switched ON the edge fold motor 23 is stopped (S19), and the edge fold rollers 14, 15 remain in the waiting position. Thereafter, the conveyance motor 30 is stopped at the timing when the rear end of the paper passes through the nip of the fold roller 11 (S20).

In the second embodiment, edge fold starting position changing means (changing means) for determining and changing the edge fold starting position of the leading edge of the paper by means of the edge folding means is realized by collaboration of the paper fold controller 100, leading edge detection sensor 17, edge fold motor 23, and conveyance motor 30. the paper fold starting position, which differs according to the size of the paper, is determined based on the input information on the size of the paper, which is input from the operation portion 201, and control for realizing the determined paper fold starting position is performed. Concretely, when changing the fold starting position, conveyance of the paper is started by the conveyance motor 30, and after a lapse of a predetermined time of t2 seconds since the detection of the leading edge of the paper performed by the leading edge detection sensor 17, drive of the edge fold motor 23 is started, and after ta seconds since the start of the drive of the edge fold motor 23, a predetermined location on the paper is nipped by the fold line formation portion of the edge fold rollers 14, 15 to form a fold line.

Moreover, in the second embodiment, by providing the edge fold starting position changing means, folding of the edge can be performed on paper of all size to perform folding of paper, at a suitable position.

Furthermore, the present invention is configured such that changing the edge fold starting position can be realized by operation from the operation portion, the edge fold starting position can be changed easily by an input from the operation portion.

In addition, the second embodiment is configured such that the changing means for changing the edge fold starting position can be changed according to the amount of paper to be sent (the drive start timing of the edge fold rollers 14, 15 by the edge fold motor 23). Therefore, the edge fold starting position can be changed freely by controlling n edge sending motor, without adding a part.

In the second embodiment, the fold line formation position can be changed automatically according to the operation of the operation portion, or the information on the size of the paper which is input by the operation portion. Particularly, the fold line formation position can be adjusted by adjusting the amount of paper to be fed for the fold line forming means, or adjusting the timing for sending the paper for the drive start timing of the fold line forming means. In the conventional paper folding apparatus, the state of the folded papers sometimes do not correspond to the filing to a file, stapling, or punching. This is due to an wrong position of a fold line formed on the edge of the paper. Especially when the size of the paper is changed, the fold line formation position could not be change without exchanging a part, although the fold line formation position had to be changed.

Third Embodiment

The third embodiment is described hereinafter with reference to the drawings.

Figure 51:
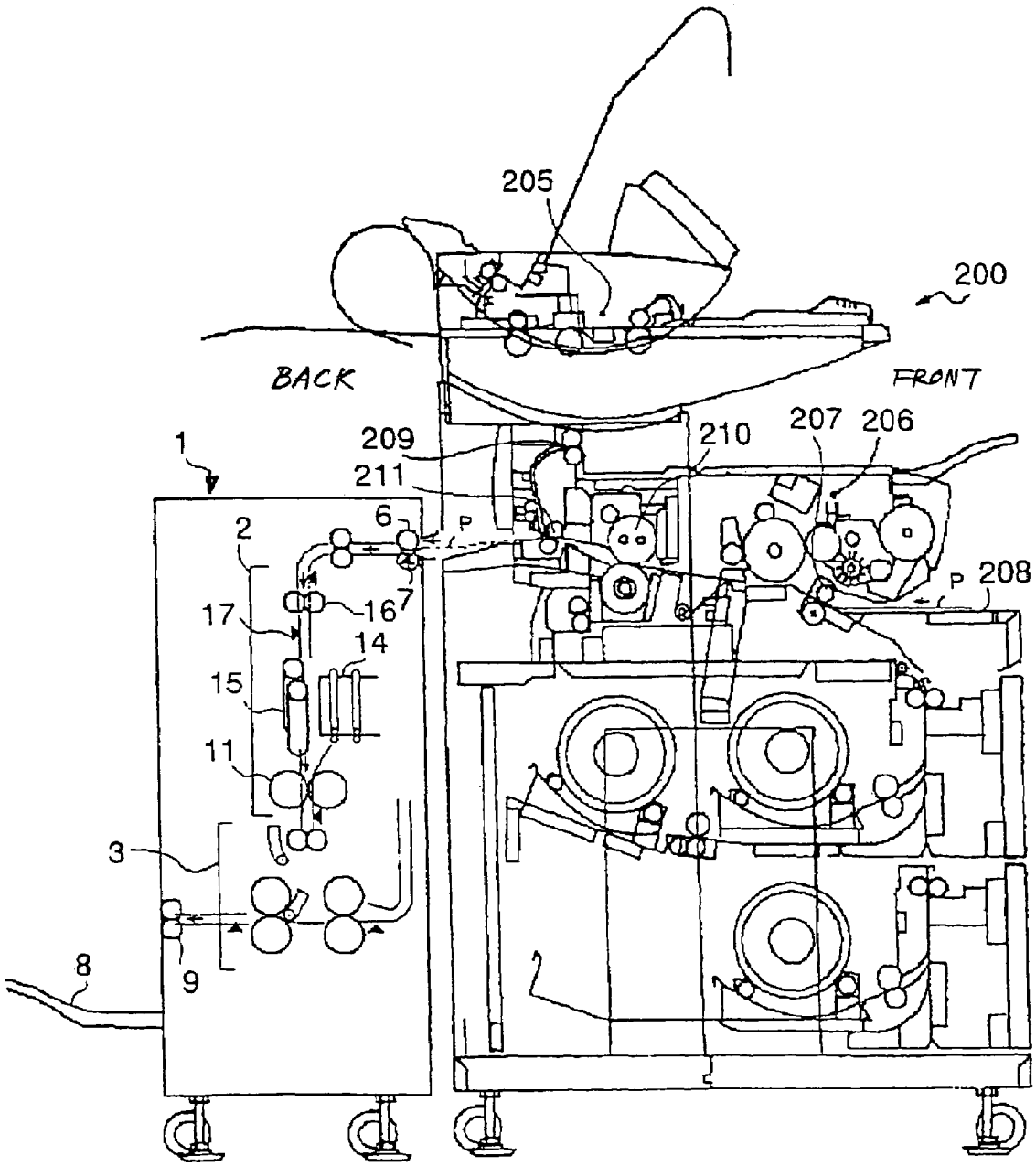
FIG. 51 is a side view showing a configuration of the a copying machine device main body, and of a paper folding machine which is coupled to the copying machine, according to a third embodiment of the present invention.

FIG. 51 shows a schematic system configuration of a copying machine which is mounted with a paper folding machine. As shown in the figure, this copying machine system comprises a copying machine device main body 200 and a paper folding machine 1, wherein the paper folding machine 1 coupled to the back of the copying machine device main body 200. The paper folding machine 1 comprises a coupling portion 6 which is coupled to the main body, an end section fold portion 2 for folding an end section at the leading edge of the paper, a bellows fold portion 3 for folding the paper in bellows in the conveyance direction, and a tray 8 for ejecting the paper folded in bellows and stacking it.

In the copying machine device main body 200, an image reading device 206 is disposed, below which a manual paper feeding tray 208 is disposed. Paper is set on the manual paper feeding tray 208, suspended by a resist roller 207, and fed to the imaging unit 206 according to the timing. The imaging unit 206 is designed such that a latent image corresponding to the image data is formed on an unshown photoreceptor, the obtained latent image is developed by toner, and the toner is transferred onto the paper and fixed by a fixing device 210. The recorded paper on which the toner is fixed by the fixing device 210 is then ejected to the paper folding apparatus 1 by a recorded paper ejection roller 211 when folding the paper. When folding of the paper is not performed, the paper is led to an upper ejection roller 209 by an unshown switching claw, and ejected into the core of the main body.

When folding the paper, the paper is sent to the edge folding device 1 by the recorded paper ejection roller 211, passes the coupling portion 6 and an entrance sensor 7, and then the paper is sent by a pair of entrance conveying rollers 16 of the edge fold portion 2, and when folding the edge of the paper, the end section at the leading edge of the paper is folded by the edge fold portion 2. At this moment the end section of the paper is folded while the paper is conveyed. After the edge at the leading edge of the paper P is folded b the edge fold portion 2, the paper is folded in bellows in the conveyance direction by the bellows fold portion 3, ejected by an ejection roller 9, and stacked on the tray 8.

Figure 52:
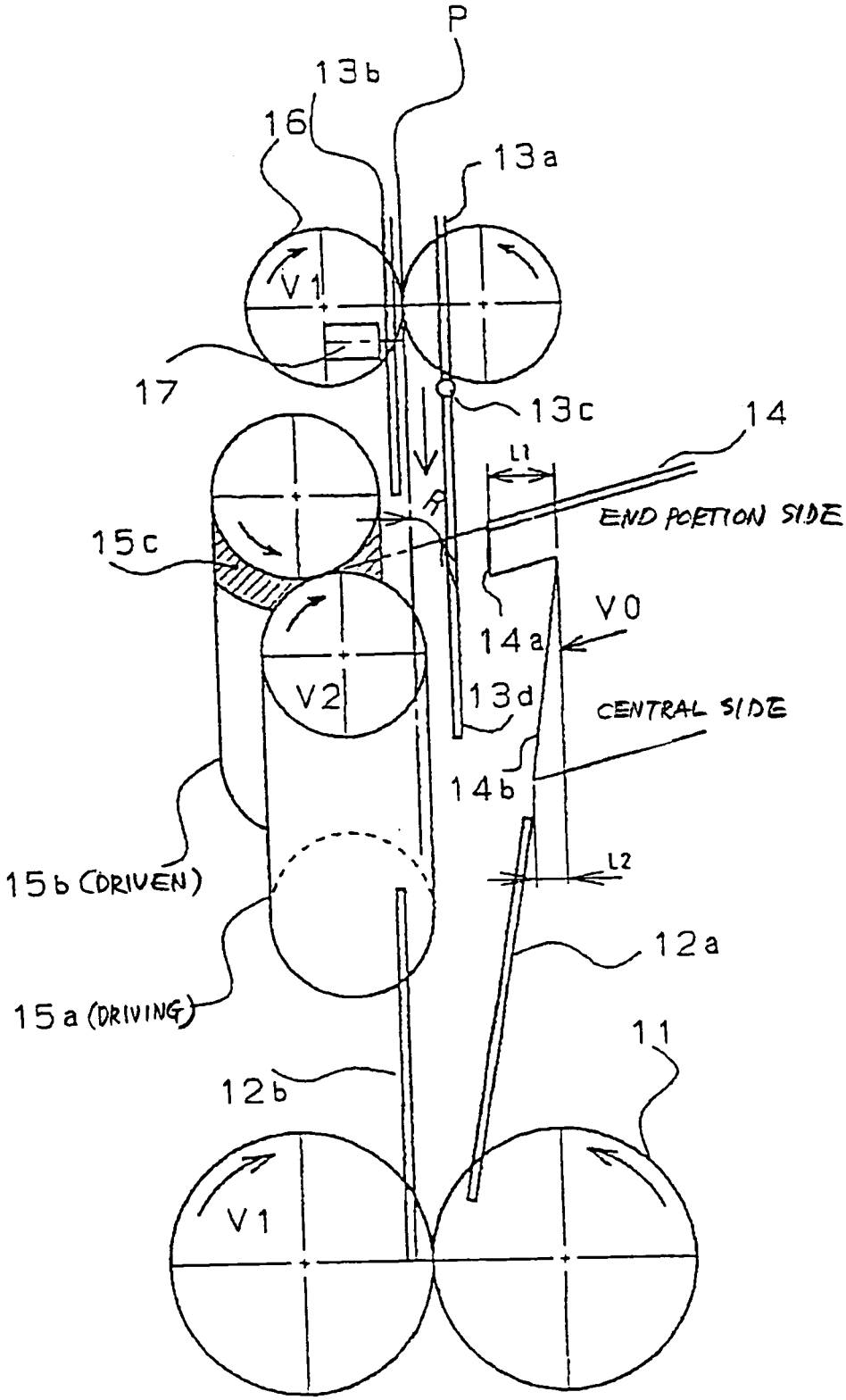
FIGS. 52 through 55 are side view showing the operation of the paper folding machine.
Figure 56:
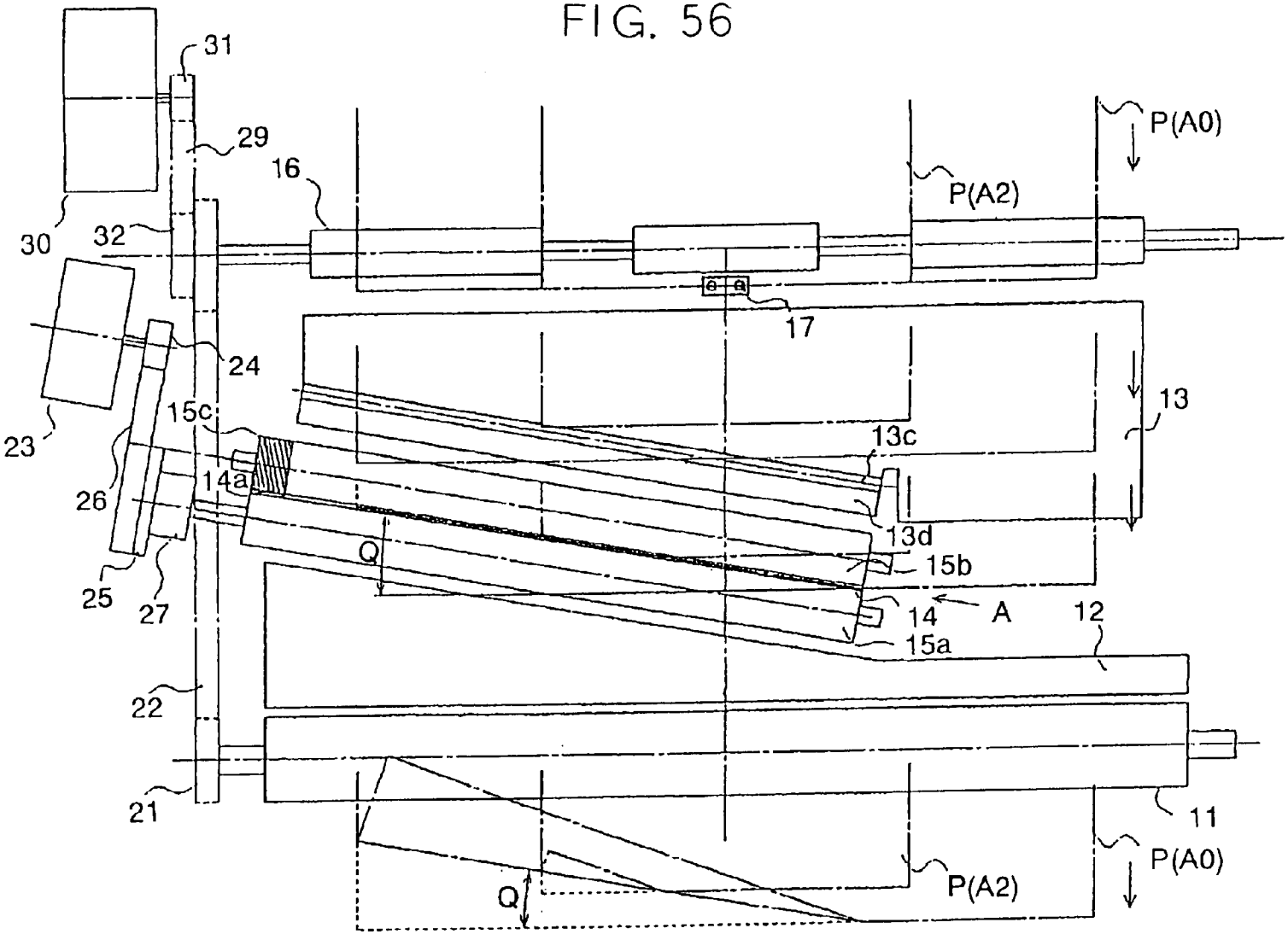
FIG. 56 is a front view showing a configuration of the paper folding machine.

FIGS. 52 and 56 show the enlarged configuration of an end section fold portion 2 of the end section folding machine 1. As shown in FIG. 56, a leading edge detection sensor 17 for detecting a leading edge position of paper is arranged downstream and in the vicinity of the center of the entrance conveying roller 16. Moreover, there are arranged further downstream a pair of end section fold rollers 15 in which a roller shaft center is disposed in the angle same as an angle Q with respect to the paper conveyance direction, and a convex member 14 for guiding a fold line position of the paper to the pair of end section fold rollers 15 (see FIG. 51). A pair of exit conveying rollers 11 are arranged downstream. A pulley 32 is fixed to the entrance conveying roller 16, and a pulley 21 is fixed to an exit conveying roller 11. The pulleys 21, 32 are coupled to each other by the drive belt 22. The pulley 32 is coupled to a pulley 31 fixed to the conveyance motor 30 via the drive belt 29, and the exit conveying roller 11 and entrance conveying roller 16 are driven by the conveyance motor 30. Accordingly the entrance conveying roller 16 and exit conveying roller 11 are driven and stopped.

Figure 57:
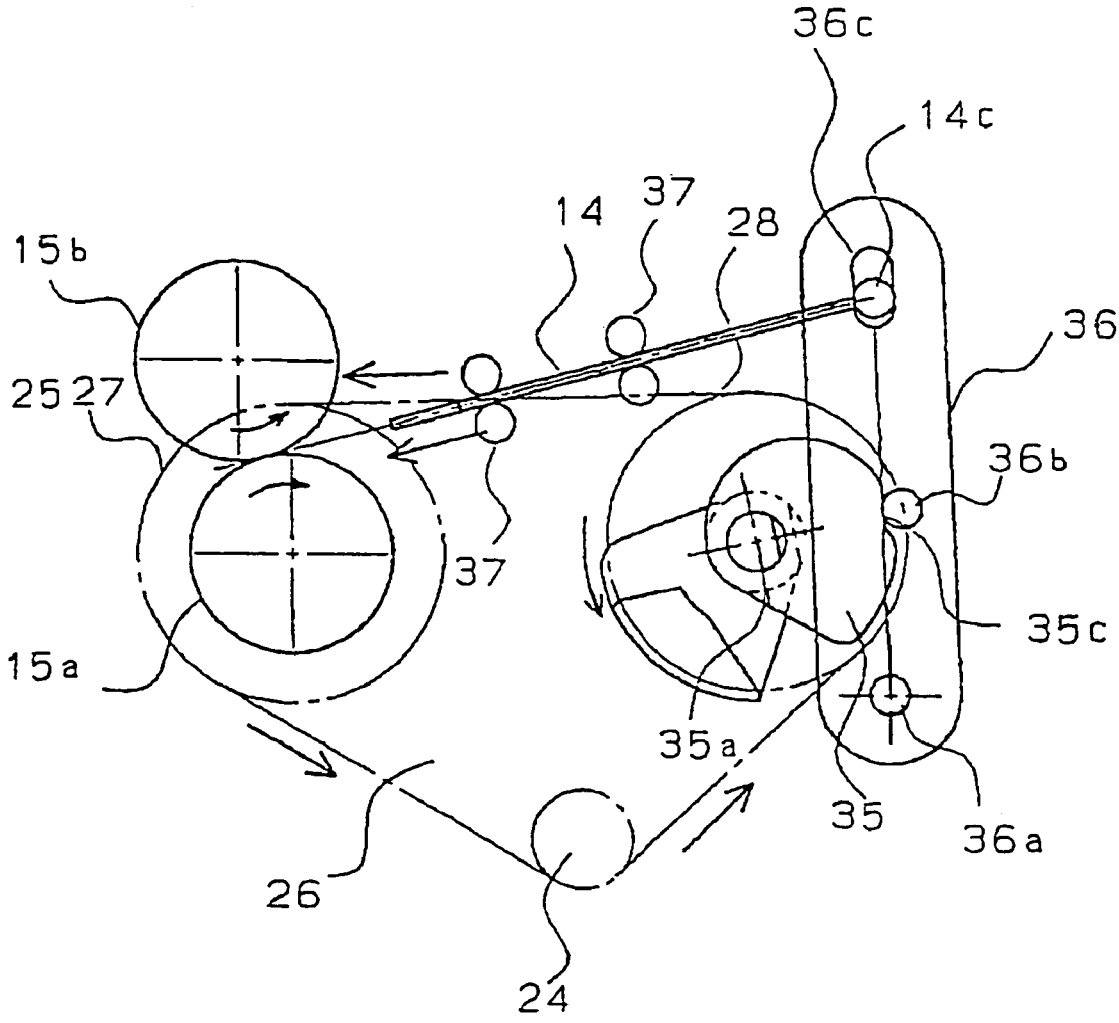
FIGS. 57 and 58 are figures for explaining the operation of a convex member of the paper folding machine.
Figure 58:
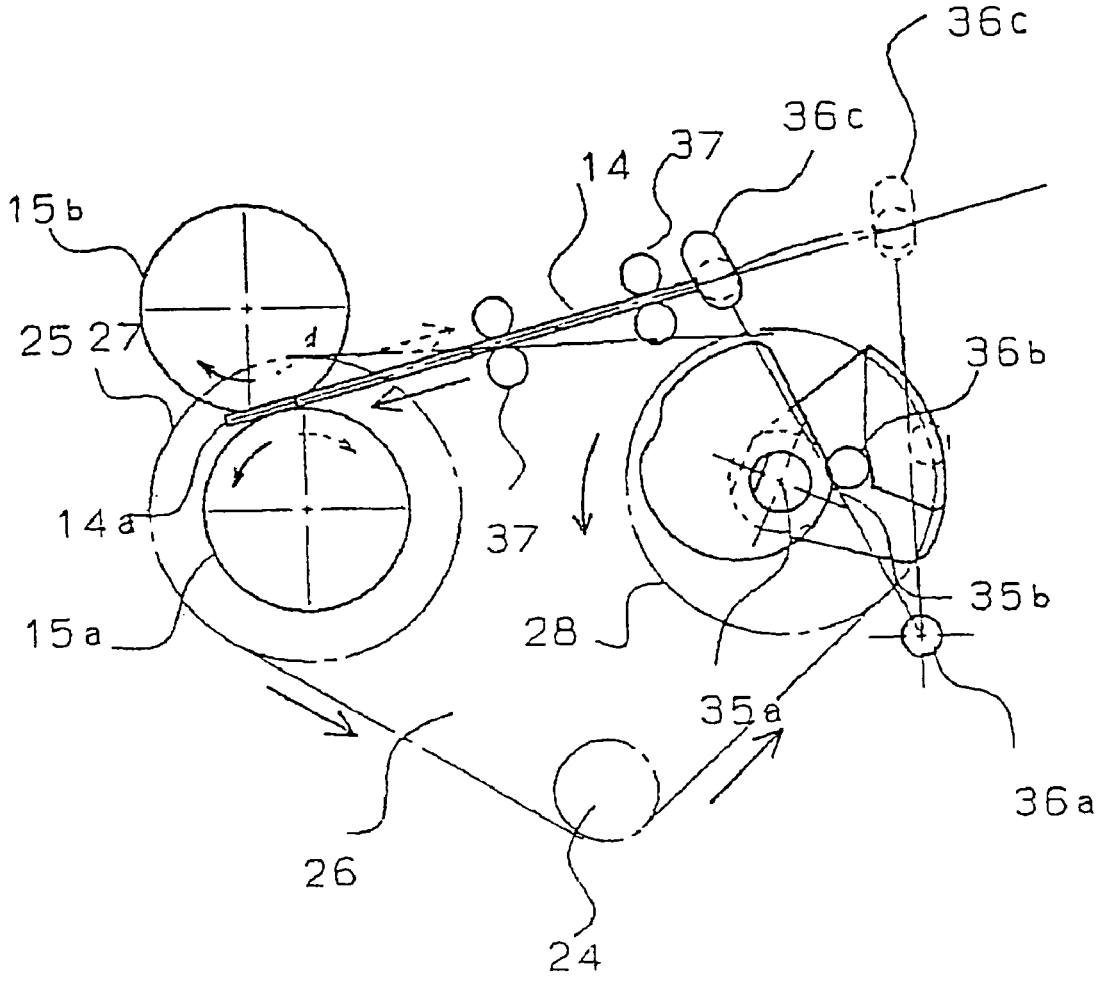

FIGS. 57 and 58 are figures in which the pair of end section fold rollers shown of FIG. 56 are viewed from the direction of the arrow A. In the pair of end section fold rollers of FIG. 56, the end section fold roller located downstream is a driving roller 15*a*, and the end section fold roller located upstream is a driven roller 15*b* which is pressurized by unshown biasing means. The driving roller 15*a* is configured such that the surface there of is a high friction roller, and the driven roller 15*b* is configured such that the surface thereof is a low friction roller. The driving roller 15*a* as a surface high friction roller is constituted by a two-layered roller in which the surface thereof is coated with urethane, and the driven end section fold roller 15*b* is constituted by a resin roller with high degree of hardness.

The end section fold driving roller 15*a* is coupled coaxially to a driving pulley 25 via a torque limiter 27 fixed coaxially. The driving pulley 25 is rotary driven by the end section fold motor 23 via a pulley 24 coaxially and a drive belt 26.

Furthermore, the convex member 14 for guiding a fold line position of the paper to the pair of end section fold rollers 15, as shown in FIG. 56, is support by a wheel 37 of FIG. 7 which is viewed in the direction of the arrow A, and moves in a straight line towards the nip of the pair of end section fold rollers 15 in the direction of the arrow. A shaft 14*c* configured in the end portion of the convex member 14 is coupled to a groove 36*c* of a swing lever 36 which rotary swings with respect to a supporting point 36*a* as the center. As a result, when the swing lever 36 rotary swings, the convex member 14 moves in a straight line. Further, an operating pin 36*b* of the swing lever 36 abuts on the outer periphery of a cam 35, and when the cam 35 rotates, the abutting position repeats movement from a cam rotation center 35*a* to a proximate position 35*b* (see FIG. 58) and distant position 35*c*, whereby the swing lever 36 rotary swings. It should be noted that P (A2), P (A0) in FIG. 56 indicate the paper and the size of the paper.

The end section fold motor 23 rotary drives the pulley 24 in FIG. 7, and also a pulley of a one-rotation clutch 28 fixed coaxially to the cam 35 via the drive belt 26. When the one-rotation clutch 28 is switched ON/OFF, the cam 35 is rotated once and stopped. Specifically, when the one-rotation clutch 28 is switched ON/OFF, the convex member 14 makes one reciprocating motion by abutting on the pair of end section fold rollers 15 from the waiting position, and returning to the waiting position again.

Next, as shown in FIG. 57, the pulley 24 of the end section fold motor 23 and the drive belt 26 rotate counterclockwise, and the pair of end section fold rollers 15 rotate in the directions of the arrows for sending out the paper and the convex member 14. However, when the convex member 14 abuts on the pair of end section fold rollers 15, the torque limiter 27 fixed coaxially to the end section fold driving roller 15*a* acts, and follows the movement of the convex member 14 in the same direction at the same speed.

Moreover, as shown in FIG. 52, the end portion of the convex member 14 is formed into a protrusion shape with a length L1, and functions as a protrusion shape portion 14*a*. The protrusion shape portion 14*a* is configured outer side than the width of the paper as shown in FIG. 56. The end section fold driven roller 15*c* in the portion which abuts on the protrusion shape portion 14*a* is configured with a material of hardness lower than that in the portion where the paper is held. Further, the protrusion shape portion 14*a* is disposed at an angle R in which the roller nip conveyance direction of the pair of end section fold rollers 15 is inclined in the direction of the conveying roller located somewhat upstream at right angles or more with respect to the paper conveyance direction of the pair of entrance conveying rollers 16 (see FIG. 52). In other words, the angle between the nip conveyance direction of the fold roller 15 and the paper conveyance direction of the conveying roller 16 located upstream is set to be an angle (180−R)° which is somewhat larger than a right angle. A paper fold portion 14*b* of the convex member 14 has an inclination L2 as shown in FIG. 2, and is set in the vicinity of the pair of end section fold rollers 15 on the center side.

In FIG. 52 and FIG. 56, guide plates 13*a*, 13*b* (hereinafter indicated by reference numeral 13 as a whole) located upstream of the pair of end section fold rollers 15 comprise a guide plate 13*d* which can rotary swing, with a rotation supporting shaft 13*c* as the center which is configured in parallel with the pair of end section fold rollers 15. Further, the guide plates are biased in the direction of rotation by an unshown spring.

Figure 59:
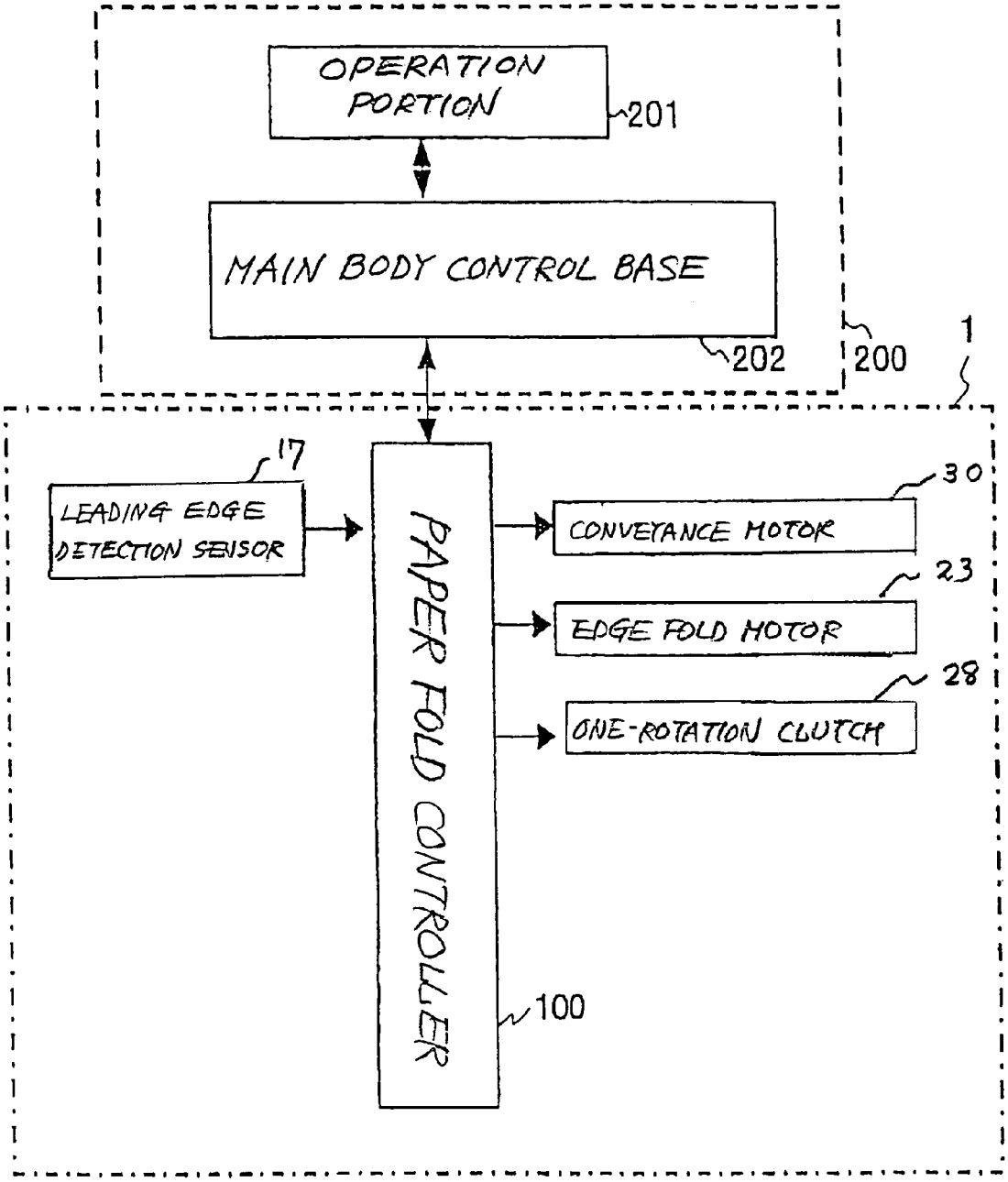
FIG. 59 is a block diagram showing a configuration of a control system of the paper folding machine coupled to the copying machine device main body.
Figure 60:
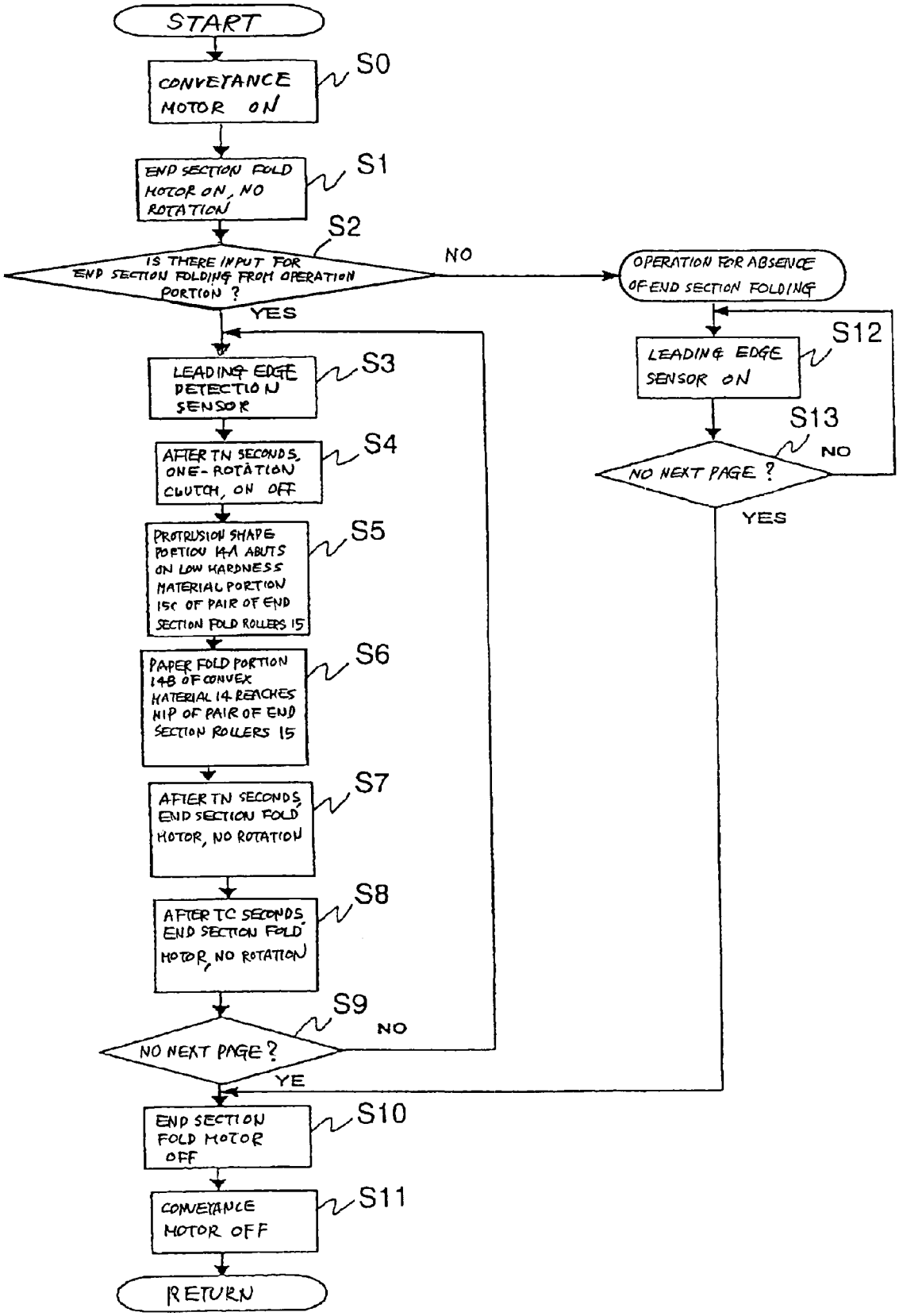
FIG. 60 is a flow chart showing a control procedure in the third embodiment.

FIG. 59 shows a configuration of a control system according to the third embodiment. As is clear from the figure, the copying machine main body 200 is provided with the operation portion 201 and main body control base 202, and the end section folding machine 1 is provided with the paper fold controller 100, leading edge detection sensor 17, conveyance motor 30, end section fold motor 23, and one-rotation clutch 28.

In the control system configured schematically as above, the operation portion 201 of the copying machine device main body 200 performs selection on whether the operator folds paper or not, and, when the operator folds paper, an input operation for folding or not folding the end section. An input signal from the operation portion 201 is input to the main body control base 202, and further input to paper fold controller 100 of the paper folding machine 1, and paper fold operation is controlled by the paper fold controller 100. Therefore, folding of the end section is controlled by the paper fold controller 100, and rotation and stop control of the end section fold motor 23 and conveyance motor 30, and also ON/OFF control of the one-rotation clutch 28 are performed based on a detection signal from the leading edge detection sensor 17.

The speed of the conveyance motor 30 is controlled by the paper fold controller 100 in the manner described above, so setting of the paper conveying speed of each of the rollers is described hereinafter.

In FIG. 52, the exit conveying roller 11 and entrance conveying roller 16 are rotated in the directions of the arrows at an equal fixed conveying speed of V1 to convey the paper. Next, the pair of end section fold rollers 15 rotate in the directions of arrows at a fixed conveying speed of V2 in a waiting state where the convex member 14 does not abut on the pair of end section fold rollers 15 or until the convex member 14 abuts on the pair of end section fold rollers from the waiting state. At this time, the speed of V2 is set to a conveying speed of the conveying speed V1 of the entrance conveying roller 16 or more (V2≧V1). Then, rotary drive of the pair of end section fold rollers 15 is performed at the speed of the movement of the convex member 14 between the time when the convex member 14 starts to abut on the pair of end section fold rollers 15 and the time when entrance is stopped, as shown in FIG. 3, because the torque limiter 27 fixed coaxially acts and follows the movement of the convex member 14 in the same direction at the same speed.

The speed of the movement of the convex member 14, V0, fluctuates depending on the rotation operation of the cam 35, but is always set to a speed which is slower than the conveying speed V1 of the entrance conveying roller 16 (V1>V0). Further, between the time when the convex member 14 starts to pull and stops in the waiting position after enter the pair of end section fold rollers 15 and stopping, the rotating speed of the end section fold motor 23 is raised from N0 to N0' as shown in FIG. 4, and the pulling seed of the convex member 14, V0', is raised, whereby control is performed such that the pulling seed V0' becomes faster than the entrance speed V0 of the convex member 14 (V0<V0') During the period of time in which rotating speed of the end section fold motor 23 is raised, the speed of rotation of the pair of end section fold rollers 15 is also raised to V2' (V2<V2'), and the speed of rotation is changed from V0' to V2' at the moment when the convex member 14 separates from the pair of end section fold rollers 15 as shown in FIG. 5.

The operation of the third embodiment is described with reference to FIGS. 52 through 55, 59 and 60.

First, when a paper fold signal is input to the operation portion 201 on the main body side, the signal is then input to the paper fold controller 100 via the main body control base 202. The paper fold controller 100 then starts rotary drive of the conveyance motor 30, the pair of entrance conveying motors 16 and the pair of exit conveying rollers 11 rotate in the directions of arrows as shown in FIG. 52 (step S0 in FIG. 60), the end section fold motor 23 starts to rotate at a speed of rotation of N0, and the pair of end section fold rollers 15 also start to rotate in the directions of arrows (step S1).

Folding of the end section is selected by the operation portion 201 on the main body side (step S2), the paper is sent to the paper folding machine 1 by the ejection roller 211 of the copying machine device main body 200 as shown in FIG. 51, passes through the coupling portion 6, and sent by he pair of entrance conveying rollers 16 of the end section fold portion 2. The leading edge of the paper passes on the leading edge detection sensor 17 as shown in FIG. 52, and when the leading edge detection sensor 17 is switched ON (step S3), the one-rotation clutch 28 is switched ON/OFF after tn seconds of the timing when the paper fold portion 14*b* of the convex member 14 abuts in the position of a fold line of the end section in the nip of the pair of end section fold rollers 15, and when the cam 35 rotates, the operating pin 36*b* of the swing lever 36, which abuts on the distant position 35*c*, moves to the proximate position 35*b* from the cam rotation center 35*a* as shown in FIG. 57, and the convex member 14 moves from the waiting position toward the nip of the pair of end section fold rollers 15 (step S4).

Figure 53:
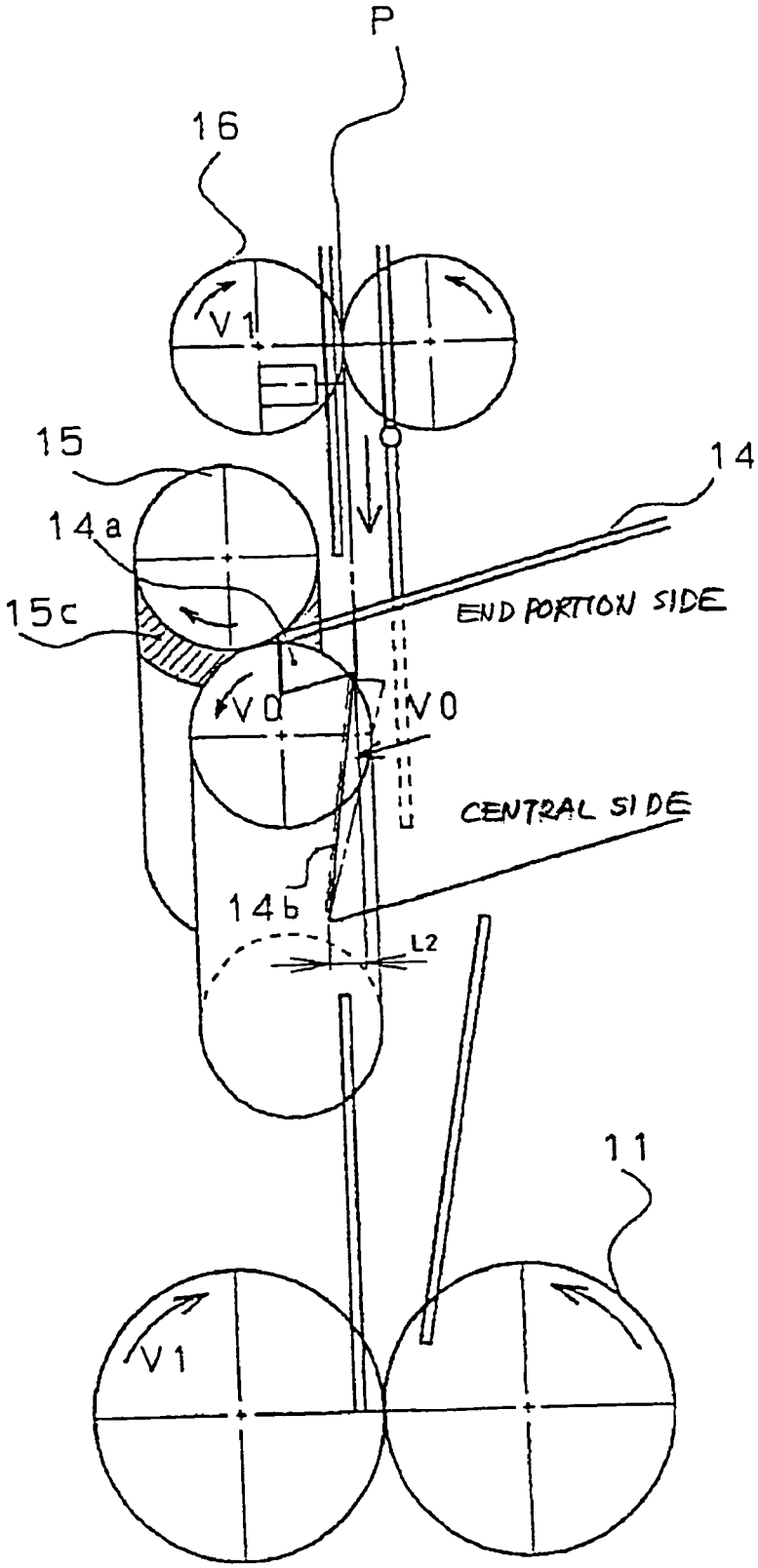
Figure 54:
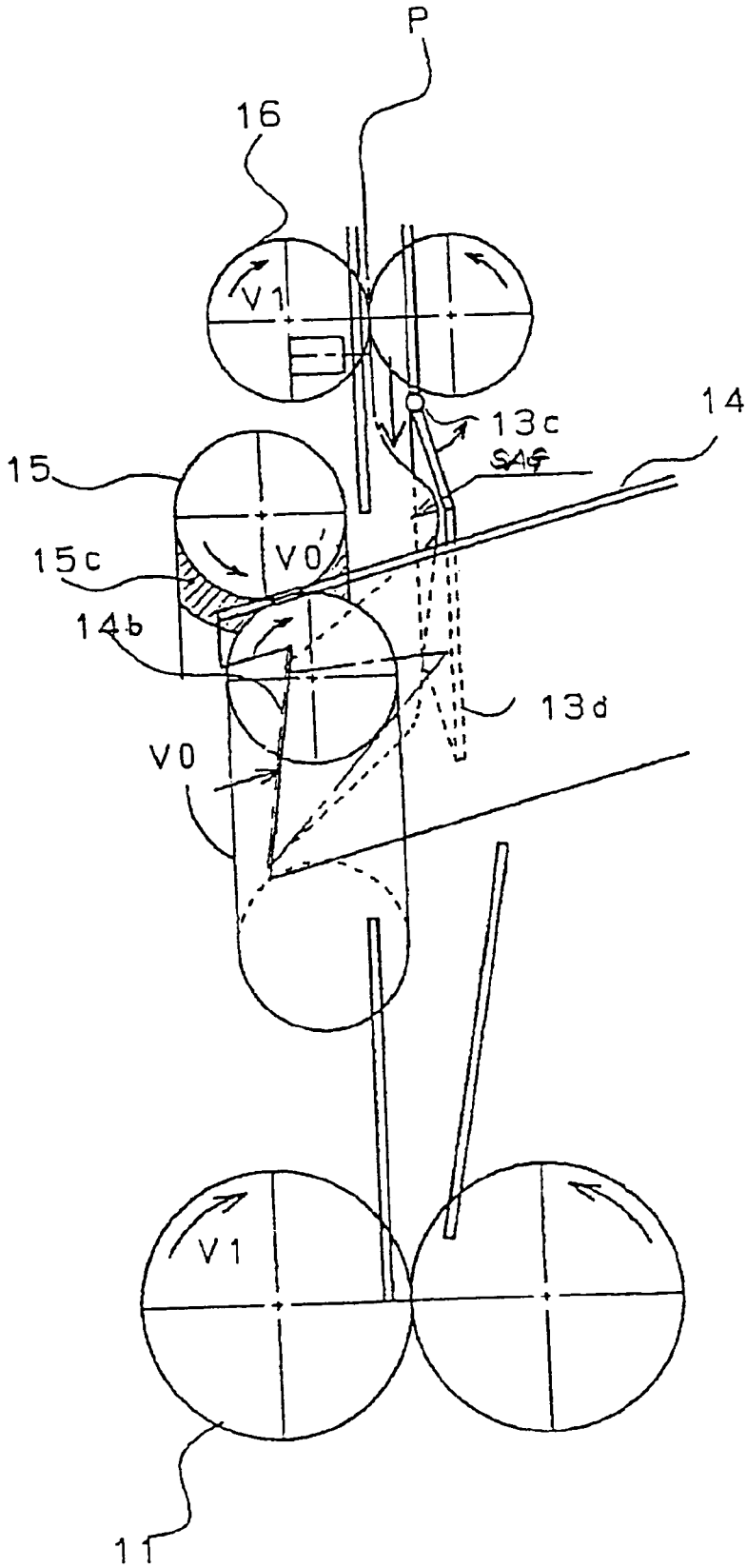

On the other hand, as shown in FIG. 53, the length L1 is set such that he protrusion shape portion 14*a* of the convex member 14 after the leading edge of the paper passes through the nip of the pair of end section fold rollers 15 abuts on the low hardness material portion 15*c* of the pair of end section fold rollers 15, and, after abutting, the torque limiter 27 acts, and further the directions of rotation of the pair of end section fold rollers 15 are changed to the directions of arrows to hold the paper as shown in FIG. 53 (step S5). Thereafter, as shown in FIG. 58, when the cam 35 rotates, the operating pin 36*b* of the swing lever 36 in the abutting position reaches the proximate position 35*b* from the cam rotation center 35*a*, and at the same time the central side of the paper fold portion 14*b* of the convex member 14 abuts on the paper as shown in FIG. 53. The abutting position gradually moves to the end portion side, and the paper fold portion 14*b* of the convex member 14 eventually moves in the direction of the solid arrow as shown in FIG. 8, and then reaches the nip of the pair of end section fold rollers 15 rotating in the directions of solid arrows from the central side to the entire range of the end portion. At this moment, as shown in FIG. 54, the paper fold portion 14*b* holds the end section fold line position of the paper between the pair of end section fold rollers 15, whereby the end section of the paper is folded back. At this time, the movement speed V0 of the convex member 14 changes as a result of the rotation of the cam 35. However, the speed of rotation of the entrance conveying roller 16 is always set a speed slower than the speed V1 (V1>V0), thus the when the paper fold portion 14*b* holds the end section fold line position of the paper between the pair of end section fold rollers 15 to fold back the end section of the paper, sag is generated as shown in FIG. 54 (step S6).

Figure 55:
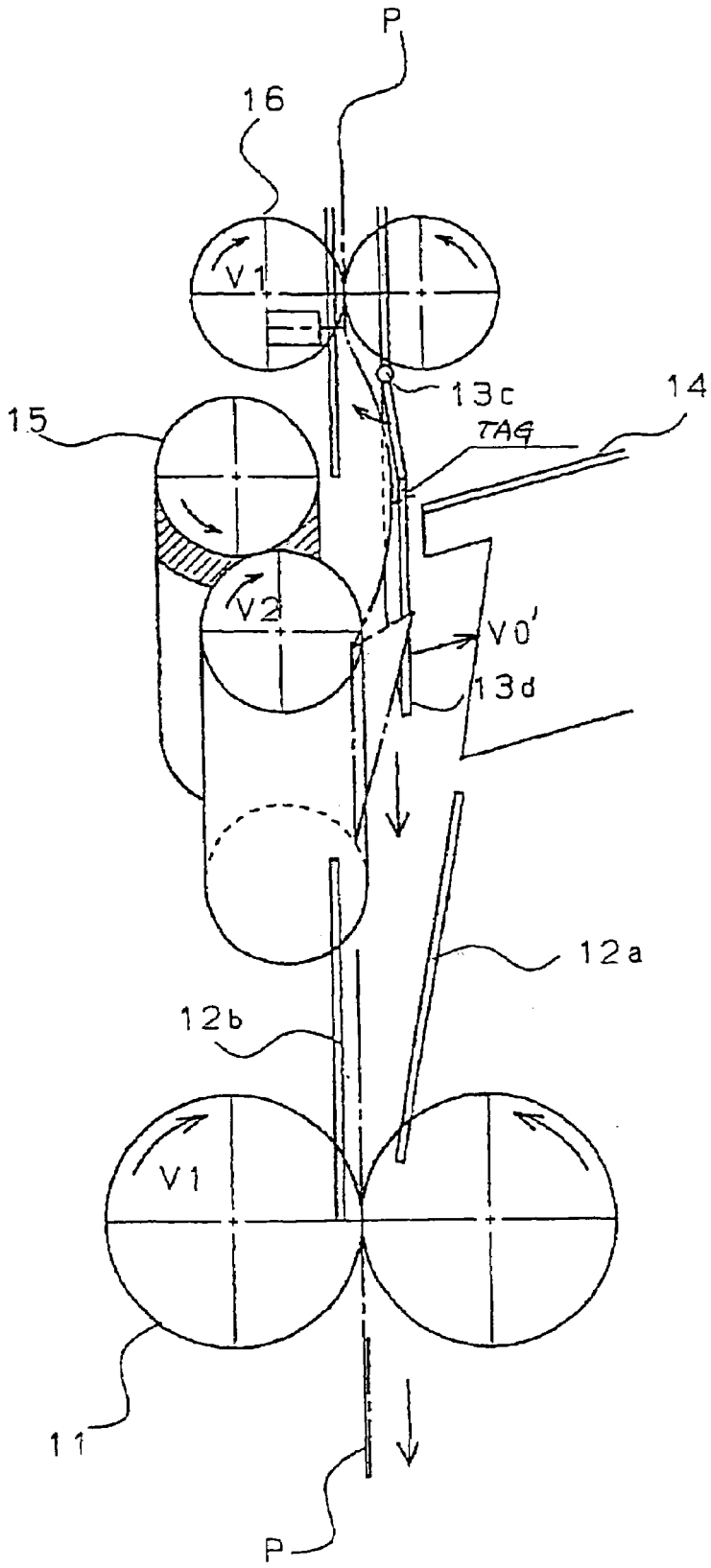

Due to this paper sag, the guide plate 13*d* swings in the direction of the arrow, with the rotation supporting shaft 13*c* of the guide plate 13 configured in parallel with the pair of end section fold rollers 15 as the center. As shown in FIG. 58, immediately after the operating pin 36*b* of the swing lever 36 in the abutting position reaches the proximate position 35*b* from the cam rotation center 35*a* by rotation of the cam 35 (after tb seconds since the leading edge detection sensor 17 is switched ON), the speed of rotation of the end section fold motor 23 is raised from N0 to N0' (step S7). At the same time, as shown in FIG. 58, the operating pin 36*b* of the swing lever 36 in the abutting position starts to move from the cam rotation center 35*a* to the distant position 35*c* by rotation of the cam 35. The paper fold portion 14*b* of the convex member 14 moves in the direction of a thin dashed line in the pulling direction, the pair of end section fold rollers 15 also rotate in the directions of thin dashed arrows in which the end section fold line is ejected, and the convex member 14 an the pair of end section fold rollers 15 rotate in the directions of arrows at the speed V0' as shown in FIG. 54 to move the paper in the ejection direction. Furthermore, the protrusion shape portion 14*a* of the convex member 14 separates from the low hardness material portion 15*c* of the pair of end section fold rollers 15, the speed of the pair of end section fold roller 15 is raised to V2' as shown in FIG. 55, the guide plate 13*d* pushes back the paper sag in the direction of the arrow, with the rotation supporting shaft 13*c* of the guide plate 13 configured in parallel with the pair of end section fold rollers 15 as the center, and the end section fold line of the paper is ejected along the surfaces of the pair of end section fold rollers 15, and conveyed toward the exit conveying roller 11.

Thereafter, as shown in FIG. 58, the operating pin 36*b* of the swing lever 36 in the abutting position moves from the cam rotation center 35*a* to the proximate position 35*b* and to the distant position 35*c* by rotation of the cam 35, the convex member 14 returns to the waiting position, the one-rotation clutch 28 idles when the cam 35 rotates once, the cam 35 stops, and the convex member 14 stop at the waiting position. Further, before the leading edge of the paper reaches the exit conveying roller 11 (after tc seconds since the leading edge detection sensor 17 is switched ON), the speed of rotation of the end section fold motor 23 is reduced from N0' to N0 (step S8). Thereafter, as shown in FIG. 55, the fold line of the leading edge of the paper reaches the exit conveying roller 11 and nipped, and the end section is folded complete.

If there is a next page, the leading edge of the paper passes over the leading edge detection sensor 17 again, and when the leading edge detection sensor 17 is switched ON (step S3), the subsequent operations are repeated (step S9). If there is no next page, the paper fold controller 100 stops the pair of end section fold rollers 15 (step S10), and further stops the conveyance motor 30 to end the process (step S11).

On the other hand, folding of the end section is not selected by the operation portion 201 of the copying machine main body 200, the paper is sent to the paper folding machine 1 by the ejection roller 211 of the copying machine device main body 200 as shown in FIG. 51, passes through the coupling portion 6, and sent at the pair of entrance conveying rollers 16 of the end section fold portion 2, and the leading edge of the paper passes over the leading edge detection sensor 17 as shown in FIG. 52, the leading edge detection sensor 17 is switched ON, and the leading edge of the paper passes over the pair of end section fold rollers 15. At this moment the pair of end section fold rollers 15 rotate in the directions of arrows for ejecting the paper at a fixed speed of at lest the conveying speed of the entrance conveying roller 16, V1 (V2≧V1). The leading edge of the paper then reaches the exit conveying roller 11 and passes through (step S12). Then, if there is a next page, the leading edge of the paper passes over the leading edge detection sensor 17 again, and when the leading edge detection sensor 17 is switched ON (step S12) the subsequent operations are repeated (step S9). If there is no next page (step S13), the paper fold controller 100 stops the pair of end section fold rollers 15 (step S10), and further stops the conveyance motor 30 to end the process (step S11).

Figure 61:
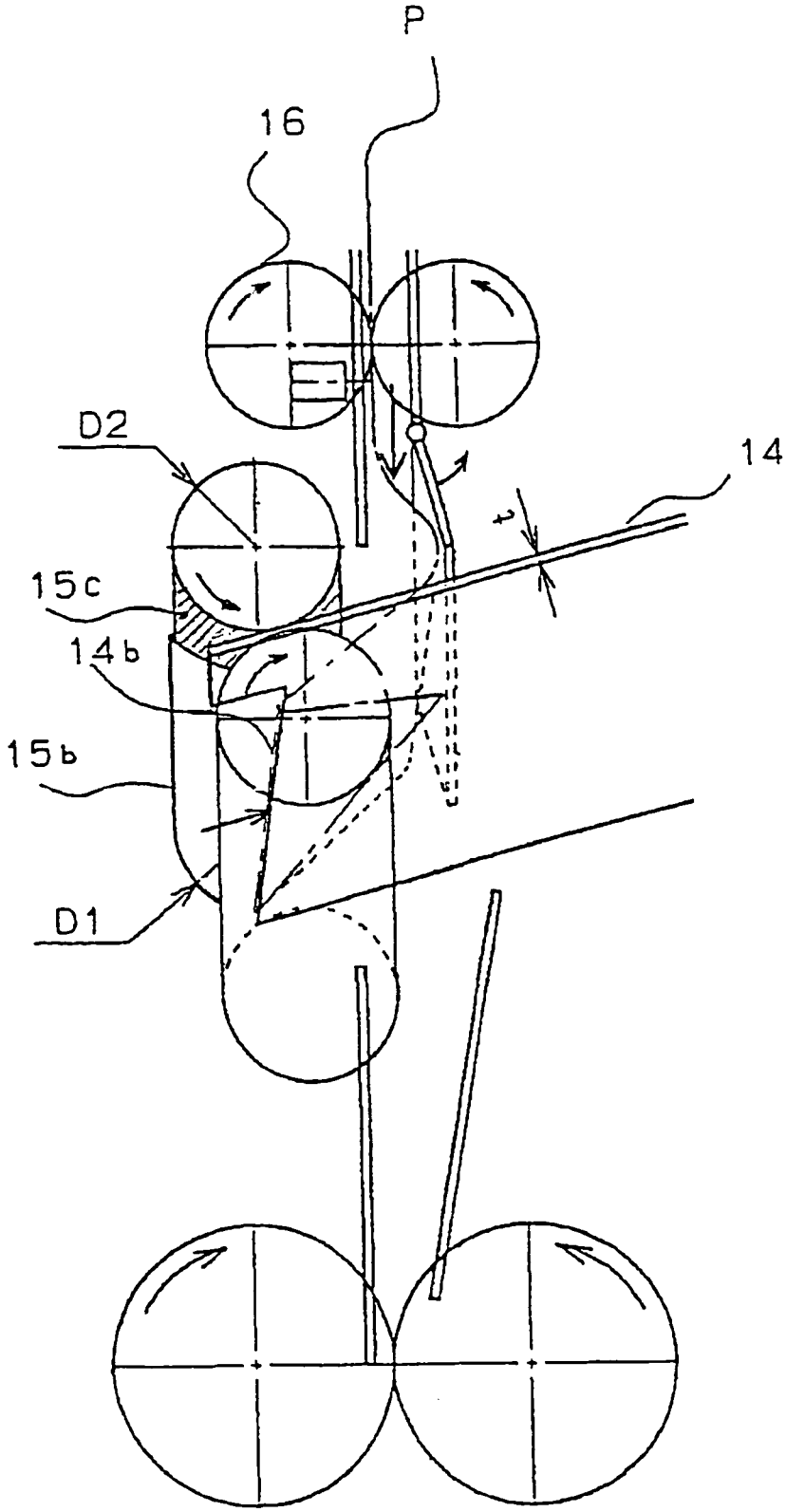
FIG. 61 is a side view showing an example of the operation of the third embodiment.

It should be noted that, as shown in FIG. 61, the diameter D2 of the driven roller 15*c* may be smaller than the diameter D1 of the driven roller 15*b*. Specifically, the convex member 14 has the protrusion shape portion 14*a* with the end portion length L1, and the diameter D2 of the end section fold driven roller 15*c* in the portion abutting on the protrusion shape portion 14*a* is set smaller than the diameter D1 of the driven roller 15*b* in the portion for holding the paper, and the difference of the diameter between the driven rollers is less than or equal to the thickness of the convex member 14. By configuring in this manner, when only the portion of the convex member 14, which is outer side from the width of the paper enters the nip between the two fold rollers 15, the two fold rollers 15 hold position of the fold line at the end section of the paper evenly, while abutting in the paper width portion of the two fold rollers 15 according to the difference of the diameters, whereby generation of wrinkles due to formation of the fold line, and insufficient formation of the fold line can be prevented.

It should be noted that the third embodiment is explained by raising an example of a copying machine having an electrophotographic image forming unit, but an image forming apparatus itself with a copying machine may be an apparatus having a known image forming function such as an inkjet image forming apparatus.

According to the third embodiment, the following effects are achieved.

(1) The nip of the two fold rollers 15 is arranged in an angle of the end section fold line, the convex member 14 for forming a fold line pushes the paper into the nip of the two fold rollers 15 to form a fold line at e timing in which the position of the end section fold line of the paper is conveyed to the nip of the two fold rollers 15, whereby fold line of the end portion on the paper can be pressed in the direction of folding the paper, the angle of folding along the fold line can be at least a right angle, and a paper jam can be prevented without forming double fold lines due to a mismatch between the fold line of the second folding means and the fold line of the first folding means. Moreover, the fold line at the end section is folded strongly, thus, in the case where the folded part is stacked, when filing the paper, the papers can be stored as much as possible. Further, fluctuation of a load of drive of the pair of fold rollers 15 can be reduced, the size of the motor can be reduced, the end section can be folded completely by the two fold rollers 15, and the roller 11 located downstream of the pair of fold rollers 15 for forming a fold line can be taken as a normal conveying roller instead of the fold roller 15. Accordingly, the cost can be reduced.

(2) When the convex member 14 enters the fold rollers 15, the fold rollers 15 rotate in the direction of entrance, and when the convex member 14 pulls out from the fold rollers 15, the fold rollers 15 rotate in the direction in which the convex member 14 pulls out, whereby the position of the fold line on the paper can be pushed into the nip of the two fold rollers 15 correctly to form a fold line, and positional accuracy of the position of the end section fold line can be improved.

(3) Since the fold rollers 15 are driven via the torque limiter 27, the directions of rotation of the fold rollers 15 can be changed with a simple configuration, whereby the cost can be reduced.

(4) Drives of the fold rollers 15 and the convex member 14 are taken as the same drive source, and the timing of driving the convex member 14 is controlled by the one-rotation clutch 28, whereby the convex member 14 for forming a fold line can push the paper into the two fold rollers 15 to form a fold line, and the cost can be reduced.

(5) The time for the convex member 14 to push the paper not the nip of the two fold rollers 15 to form a fold line is not lost too much, thus a fold line can be formed while conveying the paper, whereby productivity is increased.

(6) Since the conveyance direction of the nip of the fold rollers 15 is inclined by a right angle or more with respect to the paper conveyance directing of the conveying roller 16 located upstream, or inclined to the direction of the upstream conveying roller 16, the angled part of the folded end section is held by the nip of the downstream rollers 11, thus bad folding of the end section and a paper jam can be prevented.

(7) The driving side fold roller 15*a* is a roller arranged downstream and having high friction at its surface, and the driven side fold roller 15*b* is a roller arranged upstream and having low friction at its surface, thus, when the end section is not folded, even if the leading edge of the paper contacts the surface of the driving side fold roller 15*a* since the leading edge is curled, it is flipped since the roller rotate in the ejection direction. Further, even if the leading edge of the paper contacts the driven side fold roller 15*b*, the leading edge is pulled in the conveyance direction, but the coefficient of friction is low, thus skew is not generated because of the small conveying power, whereby stable paper conveyance can be performed.

(8) A metallic material with high degree of hardness is used for the driving side end section fold roller 15*a* to have a two-layered roller having high friction and in which the surface thereof is coated with urethane, and the driven side end section fold roller 15*b* is formed as a resin roller with high degree of hardness, whereby the width of the nip of the two fold rollers 15 can be set to be narrow, and the pressure for forming a fold line on the paper can be made large, whereby the end section can be folded complete by means of the two fold rollers only.

(9) In the convex member 14, since the convex portion (fold portion 14*b*) is provided with an inclination so that the paper abutting portion becomes near the downstream conveying roller on the central side, thus the convex member 14 can gradually hold the paper from the central side to the fold roller nip. Accordingly, pressure is applied concentrating on the fold roller nip from the central side to the end portion, and large pressure can be applied to a portion on the paper where a fold line is formed, whereby the end section can be folded by means of the two fold rollers only.

(10) For the portion 15*c* outside the paper width of the fold rollers 15, by using a material with hardness lower than that of the material of the roller abutting on the paper, when only the portion outside the paper width of the convex member 14 enters the nip of the two fold rollers 15, the material with low hardness sags by the thickness of the convex member. Also in the paper width portion of the two fold rollers 15 the rollers hold the position of the end section fold line of the paper evenly, thus generation of wrinkles due to formation of a fold line, or insufficient formation of the fold line can be prevented.

(11) For the portion 15*c* outside the paper width of the fold rollers 15, by setting the diameter of the roller abutting on the paper to be small, and setting the diameter difference to be less than or equal to the thickness of the convex member, when only the portion outside the paper width of the convex member 14 enters the nip of the two fold rollers 15, because of the difference in diameter the material with low hardness sags by the thickness of the convex member. Also in the paper width portion of the two fold rollers 15 the rollers hold the position of the end section fold line of the paper evenly, thus generation of wrinkles due to formation of a fold line, or insufficient formation of the fold line can be prevented.

Next, a first modification of the third embodiment is described.

The first modification differs from the third embodiment in terms of the operation procedure, thus like reference numerals are used to indicate the same portions, and an overlapping explanation is omitted.

Figure 62:
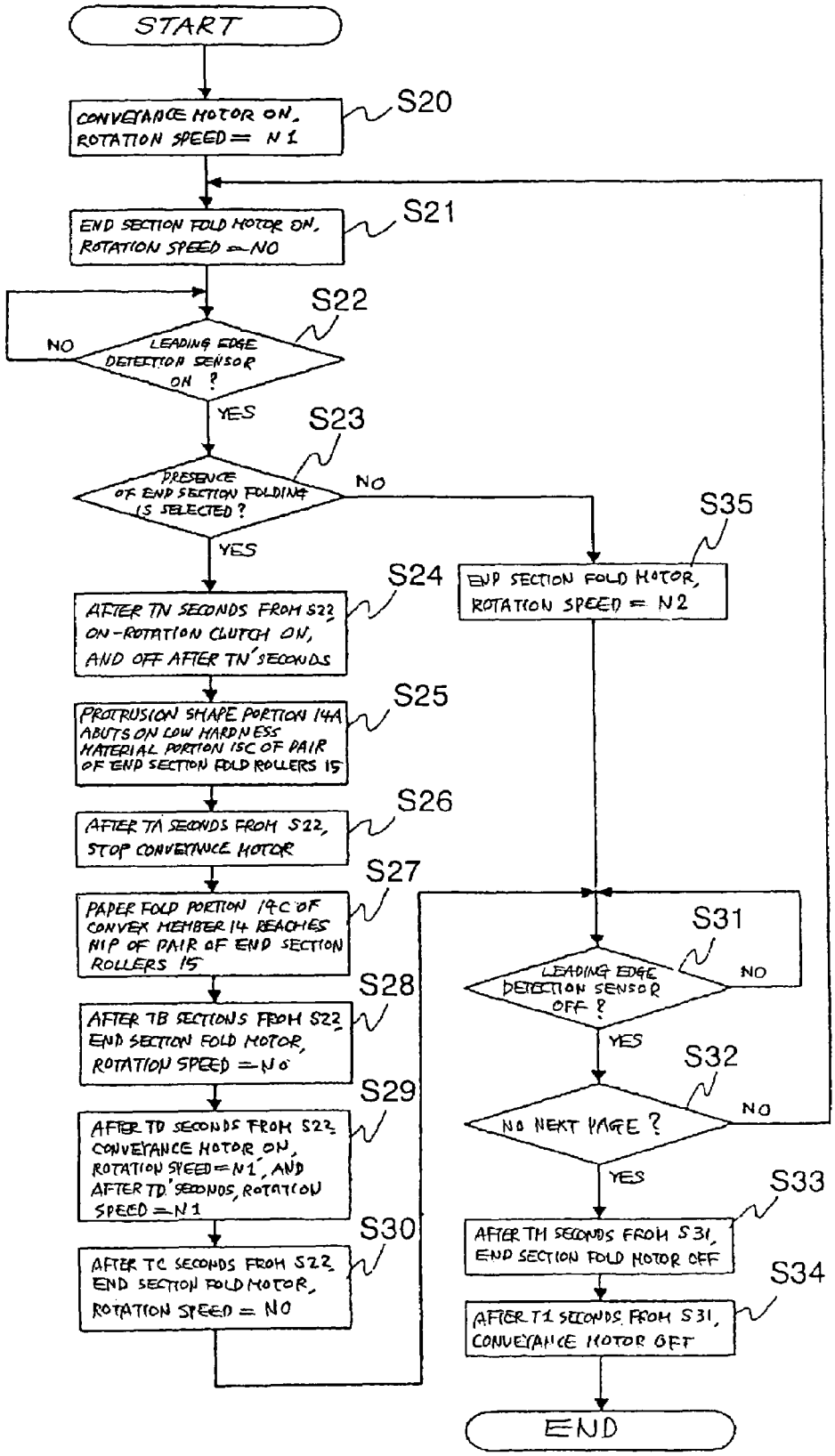
FIG. 62 is a flow chart showing an operation procedure in a first modification of the third embodiment.

FIG. 62 is a flow chart showing an operation procedure in the first modification. Hereinafter, the operation shown in the flow chart of FIG. 62 is explained with reference to FIGS. 52 though 55 and 59.

First of all, when a paper fold signal is input to the operation portion 201 on the main body side, the signal is then input to the paper fold controller 100 via the main body control base 202. Then, the paper fold controller 100 starts to rotate the conveyance motor 30 at the speed of rotation N1 so that the conveying speed becomes V1. Accordingly, as shown in FIG. 52, the pair of entrance conveying rollers 16 and the pair of exit conveying rollers 11 rotate in the directions of arrows (S20), the end section fold motor 23 starts to rotate at the speed of rotation N0, and the pair of end section fold rollers 15 also rotate in the directions of arrows (S21). It should be note that the speed V1 equals to the speed at which the ejection roller 211 of the coupling copying device main body 200 ejects the paper.

Folding of the end section is selected by the operation portion 201 on the main body side (step S23 in FIG. 62), the paper is sent to the paper folding machine 1 by the ejection roller 211 of the copying machine device main body 200 as shown in FIG. 51, passes through the coupling portion 6, and sent by the pair of entrance conveying rollers 16 of the end section fold portion 2. Then, as shown in FIG. 52, the leading edge of the paper passes over the leading edge detection sensor 17, and when the leading edge detection sensor 17 is switched ON (S22), the one-rotation clutch 28 is switched ON/OFF after tn seconds of the timing at which the paper fold portion 14*b* of the convex member 14 fits to the nip of the pair of end section fold rollers 15 at the position of a fold line at the end section. Accordingly, as shown in FIG. 57, the operating pin 36*b* of the swing lever 36 in the abutting position moves from the cam rotation center 35*a* to the distant position 35*c* and to the proximate position 35*b* by rotation of the cam 35

(see FIG. 58), and the convex member 14 moves from the waiting position toward the nip of the pair of end section fold rollers 15 (S24).

Moreover, as shown in FIG. 53, at the timing after the leading edge of the paper passes through the nip of the pair of end section fold rollers 15, the length L1 is set such that the protrusion shape portion 14*a* of the convex member 14 abuts on the low hardness material portion 15*c* of the pair of end section fold rollers 15, after abutting, the torque limiter 27 acts, and, as shown in FIG. 53, the directions of rotation of the pair of end section fold rollers 15 are changed to the directions of arrows for holding the paper (S25). Thereafter, as shown in FIG. 58, when the cam 35 rotates, the operating pin 36*b* of the swing lever 36 in the abutting position reaches the proximate position 35*b* from the cam rotation center 35*a*, and at the same time the central side of the paper fold portion 14*b* of the convex member 14 abuts on the paper as shown in FIG. 53. The abutting position gradually moves to the end portion side, and the paper fold portion 14*b* of the convex member 14 eventually moves in the direction of the solid arrow as shown in FIG. 58, and then reaches the nip of the pair of end section fold rollers 15 rotating in the directions of solid arrows from the central side to the entire range of the end portion. It should be noted that the timing at which the paper reaches the nip of the pair of end section fold rollers 15 is measured, and after ta seconds sine detection is performed by the leading edge detection sensor 17, the conveyance motor 30 is stopped (S26). At this moment, as shown in FIG. 54, the paper fold portion 14*b* holds the end section fold line position of the paper between the pair of end section fold rollers 15, whereby the end section of the paper is folded back (S27).

Next, as shown in FIG. 58, immediately after the operating pin 36*b* of the swing lever 36 in the abutting position reaches the proximate position 35*b* from the cam rotation center 35*a* by rotation of the cam 35, that is, after tb seconds since the leading edge detection sensor 17 is switched ON, the speed of rotation of the end section fold motor 23 is raised from N0 to N0' (step S28).

At the same time, the operating pin 36*b* of the swing lever 36 in the abutting position starts to move from the proximate position 35*b* to the distant position 35*c* with respect to the cam rotation center 35*a* by rotation of the cam 35. The paper fold portion 14*b* of the convex member 14 moves in the pulling direction (the direction of a dashed arrow), the pair of end section fold rollers 15 also rotate in the directions of dashed arrows in which the end section fold line is ejected. Accordingly, the convex member 14 an the pair of end section fold rollers 15 rotate in the directions of arrows at the conveying speed V0' as shown in FIG. 54 to move the paper in the ejection direction. Furthermore, the protrusion shape portion 14*a* of the convex member 14 separates from the low hardness material portion 15*c* of the pair of end section fold rollers 15. The conveying speed of the pair of end section fold roller 15 is raised to V2' as shown in FIG. 55, and the end section fold line of the paper is ejected along the surfaces of the pair of end section fold rollers 15, and conveyed toward the exit conveying roller 11.

Thereafter, in other words after td seconds since the leading edge detection sensor 17 is switched ON, rotation of the stopped conveyance motor 30 is started again at the speed of rotation N3 so that the paper conveying speed becomes V3. Here, by stopping the paper conveyance motor 30 (S26), ejection of the papers continues from the coupled copying machine device main body 200 in the upstream of the pair of entrance conveying rollers 16. Therefore, although sag is generated, the conveyance motor 30 is rotated at the speed of rotation N2 such that the rotating speed of the conveyance motor becomes the speed V2 which is faster than the initial paper conveying speed V1, to eliminate the sag formed upstream of the pair of entrance conveying rollers 16. after a lapse of td' seconds, which is long enough to eliminate the sag, the rotating speed of the conveyance motor 30 is returned to the initial rotating seed N1, and the conveying speed of the paper is made be equal to the original conveying speed of the copying device main body 200 (S29).

If a series of processing from suspending the conveyance motor (S26) to increasing the speed to rotate it again, and to return the speed to the initial speed (S29) is not carried out, as shown in FIG. 54 and FIG. 55 sag is generated on the paper in the vicinity of the pair of end section fold rollers 15, and a paper jam or wrinkles of the paper may be generated due to the sag, depending on the type of paper. On the other hand, even if sag is generated upstream of the pair of entrance conveying rollers 16 after suspending the conveyance motor (S26), possibility that a paper jam and wrinkles occur can be reduced by sufficiently securing the gap on the conveyance path so as not go involve the sag. Thereafter, as shown in FIG. 58, the position in which the operating pin 36*b* of the swing lever 36 abuts on the cam 35*a* moves from the cam rotation center 35*a* to the proximate position 35*b* and to the distant position 35*c* by the rotation of the cam 35*a*, the convex member 14 returns to the waiting position, the one-rotation clutch 28 idles after the cam 35 rotates once, the cam 35 stops, and the convex member 14 stops at the waiting position. Further, before the leading edge of the paper reaches the exit conveying roller 11, that is, after tc seconds since the leading edge sensor 17 is switched ON, the speed of rotation of the end section fold motor 23 is reduced from N0' to N0 (S3). Thereafter, as shown in FIG. 55, the fold line at the leading edge of the paper reaches the exit conveying roller 11 and nipped, and the end section of the paper is folded completely.

These are the steps for folding, the end section. However, after these steps, when the leading edge detection sensor 17 is switched OFF (S31), it is judged if there is a next page or not (S32). If there is no next page the end section fold motor 23 and the conveyance motor 30 are turned OFF sequentially (steps S33, S14), and the processing is ended. When it is judged in step S32 that there is a next page, the processing returns to step S21 to repeat the subsequent operations.

On the other hand, if folding of the end section is not selected by the operations portion 201 on the main body side in step S23, the paper is sent to the paper folding machine 1 by the ejection roller 211 of the copying device main body 200 (see FIG. 51), and passes through the coupling portion 6, and is send by the pair of conveying rollers 16 of the end section fold portion 2, and the leading edge of the paper passes over the leading edge detection sensor 17, as shown in FIG. 52. When the leading edge detection sensor 17 is switched ON when the leading edge of the paper passes through, the leading edge of the paper passes over he pair of end section fold rollers 15. At this moment, the pair of end section fold rollers 15 rotate in the directions of arrows for ejecting the paper at the fixed speed V2 at lest the speed V1 of the entrance conveying roller 16 (V2≧V1) (step S35). The speed of rotation of the end section fold motor 23 at this moment is N2. Thereafter, the leading edge of the paper reaches the exit conveying roller 11, is conveyed by the exit conveying roller 11, and the paper leading edge detection sensor 17 is switched OFF (step S31). When folding of the end section is not selected, the subsequent steps according to presence or absence of the next page in step S32 are omitted since they are same as in the case of folding the end section.

Other parts which are not particularly explained are configured and function in the same way as in the third embodiment.

The following effects are achieved according to the first modification.

(1) When pushing the convex member 14 into the nip of the two fold rollers 15*a*, 15*b*, the timing for abutting on the convex member to the paper is set based on the time since the leading edge of the conveying paper switches ON the paper leading edge detection sensor. Immediately before this, the protrusion shape portion 14*a* for changing the directions of rotation of the pair of fold rollers is provided outside the paper conveyance width, thus the position of folding the end section can be made with high accuracy (2) The two fold rollers 15*a*, 15*b* are rotated in the paper conveyance direction until the leading edge of the paper passes through, and conveyance of the paper is not interrupted. After the leading edge of the paper passes through the pair of fold rollers 15*a*, 15*b*, the protrusion shape portion 14*a* of the convex member 14 pushes the paper into the nip of the pair of rollers to change the directions of rotation of the pair of fold rollers 15*a*, 15*b* to a direction for forming a fold line for folding the end section, thus the leading edge of the paper is not held by the nip of the pair of fold rollers by mistake. As a result, a paper jam can be prevented.

(3) By making the speed of movement of the convex member 14 slower than the conveying speed of the paper, the convex member 14 does not pull he paper when abutting on the paper, thus the fold line on the end section is not decentered, or the paper is not damaged.

(4) After pushing the convex member 14 into the nip of the pair of fold rollers 15*a*, 15*b*, the speed at which the paper is pulled is set to a speed faster than the conveying speed. Therefore, the fold line on the end section is ejected immediately along the surfaces of the pair of fold rollers, and sag is not generated on the back side from the fold line of the paper end section. Accordingly, a paper jam due to the sag can be prevented.

(5) For the paper in which the end section thereof is not folded, when, for example, only bellows folding is performed at the bellows fold portion which is disposed after the end section folding apparatus, the pair of fold rollers 15*a*, 15*b* are always rotated in the paper ejection direction during conveyance of papers, thus the leading edge of the paper is not held in the nip of the pair fold rollers 15*a*, 15*b* by mistake. Therefore, a paper jam can be prevented.

(6) For he paper in which the end section thereof is not folded, by always rotating the pair of fold rollers 15*a*, 15*b* at the speed faster than the speed of conveying the paper during conveyance of papers, the pair of fold rollers 15*a*, 15*b* do not become load in conveyance of the papers. As a result, a paper jam can be prevented, and cause of delay in conveyance is prevented.

(7) When pushing the paper into the nip of the pair of fold rollers 15*a*, 15*b* by means of the convex member 14 to fold the end section of the paper, the conveyance motor is stopped, and conveyance of the paper by means of the pair of entrance conveying rollers 16 is stopped, thus sag is not generated on the paper from the pair of entrance conveying rollers 16 to he pair of fold rollers 15*a*, 15*b*. Accordingly, generation of wrinkles on the paper, and a paper jam can be prevented.

(8) Although paper sag is generated above the pair of entrance conveying rollers 16 when the pair of entrance conveying rollers 16 are stopped, the pair of entrance conveying rollers 16 are rotated at high speed for a fixed amount of time after forming a fold line on the end section, thus the paper sag can be eliminated. Accordingly, generation of wrinkles on the paper or paper jam can be prevented.

Next, a second modification of the third embodiment is described.

The second modification differs from the third embodiment in the configuration of the end section fold portion 2, thus like reference numerals are used to indicate the same portions, and an overlapping explanation is omitted.

The end section fold portion 2 of the paper folding machine according to the second modification is described.

Figure 63:
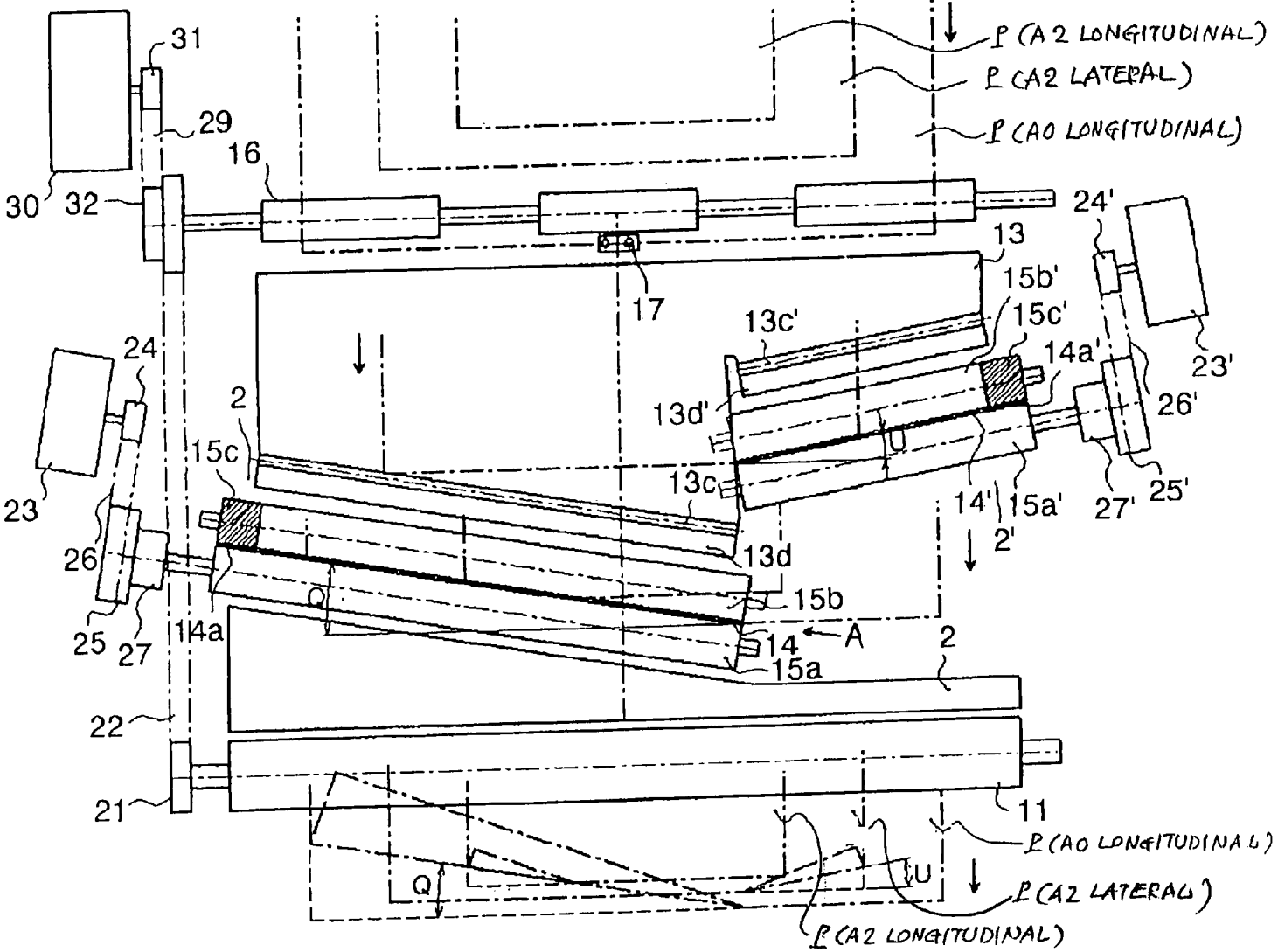
FIG. 63 is a front view showing a configuration of the paper folding machine according to a second modification of the third embodiment.

In FIG. 63, a leading edge detection sensor 17 for detecting a leading edge position of paper is arranged downstream and in the vicinity of the center of the entrance conveying roller 16. Moreover, there are arranged further downstream two pairs of end section fold rollers 15*a*, 15*b*, and 15*a*', 15*b*' in which a roller shaft center is disposed in the angles same as angles Q and U of fold lines of the end sections respectively, and two convex members 14, 14' for guiding the fold line positions of the papers to the pairs of end section fold rollers 15*a*, 15*b*, and 15*a*', 15*b*'. A pair of exit conveying rollers 11 are arranged downstream. A pulley 32 is fixed to the entrance conveying roller 16, and a pulley 21 is fixed to an exit conveying roller 11. The pulleys 21, 32 are coupled to each other by the drive belt 22. The pulley 32 is coupled to a pulley 31 fixed to the conveyance motor 30 via the drive belt 29, and the exit conveying roller 11 and entrance conveying roller 16 are driven by the conveyance motor 30.

It should be noted in the second modification that there are the two pairs of end section fold rollers in the third embodiment, and there are two end section fold portions 2, 2' on the left and right with respect to the paper conveyance direction, in which the direction of paper conveyance on the observer's left in the figure is for longitudinal feed, and the direction of paper conveyance on the observer's left is for lateral feed. Therefore, the angle Q and angle U of the end section folds are different. In this case, the angle from the direction perpendicular to the paper conveyance direction of the axial directions of the pair of rollers 15*a*, 15*b* in the end section fold portion 2 for longitudinal conveyance of the paper, in other words, the arrangement angle is Q, and the arrangement angle of the end section fold portion 2' for lateral conveyance is U, in which U>Q, and (90−Q)>U (degrees). By performing such settings, the angles for the fold line of the end section fold portions can be made equal to each other even when the direction of paper conveyance is the longitudinal direction or lateral direction, the end section fold portion for latent direction can be made smaller, thus the end section fold portion does not stand in the way when viewing the figure.

Moreover, as shown in FIG. 63, by setting the arrangement angle Q in the pair of end section fold rollers 15*a*, 15*b* of the end section fold portion 2 for paper longitudinal conveyance, end sections of a plurality of types and sizes of papers can be folded while keeping the angle of Q the same. Further, it is not necessary to adjust the arrangement angle Q according to the size of the paper, thus a mechanism for changing the angle of end section folding means for paper size is not necessary.

In addition, since the edge portion of the height and width is folded, in the left and right end section fold portions 2, 2' , the lengths and the inclination directions of the pairs of fold rollers 15*a*, 15*b*, and 15*a*', 15*b*', and of the convex members 14, 14' are different, but the configurations thereof are the same. Therefore, in the figure, an apostrophe "'" as a reference mark is applied to the same part as with the left end section fold portion 2 in the. right end section fold portion 2', so an overlapping explanation is omitted. It should be noted that in claims the angle Q corresponds to an angle θ1, and the angle U corresponds to an angle θ2.

Figure 64:
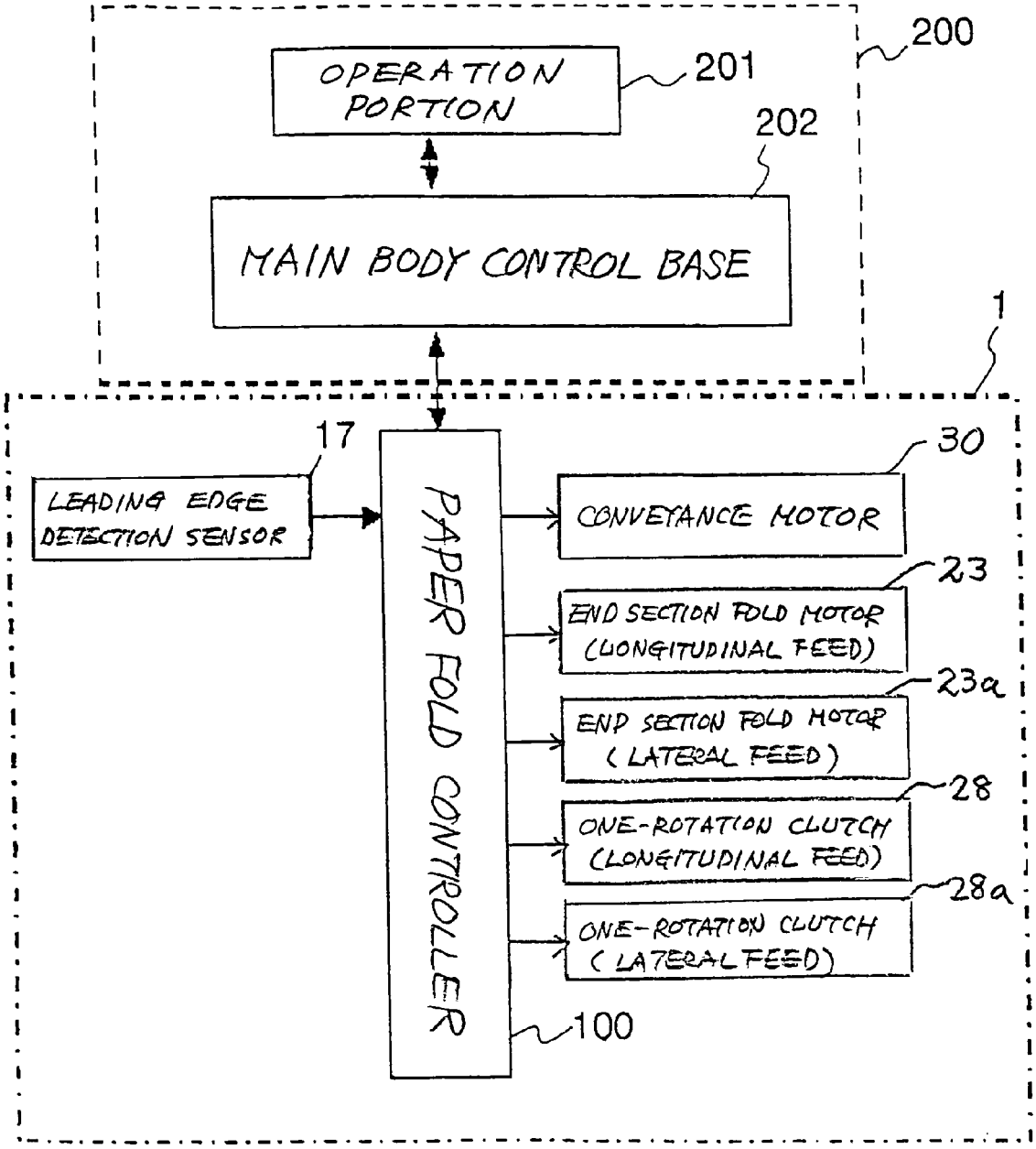
FIG. 64 is a block diagram showing a configuration of a control system of the paper folding machine coupled to the copying machine device main body according to the second modification.

FIG. 64 shows a configuration of a control system according to the second embodiment. As is clear from the figure, the copying machine main body 200 is provided with an operation portion 201 and an main body control base 202, and the end section folding machine 1 is provided with a paper fold controller 100, leading edge detection sensor 17, conveyance motor 30, end section fold motors 23, 23*a* for longitudinal and lateral conveyance, and one-rotation clutches 28, 28*a* for longitudinal and lateral conveyance.

In the control system which is schematically configured as above, the operation portion 201 of the copying machine device main body 200 performs selection on whether the operator folds paper or not, and, when the operator folds paper, an input operation for folding or not folding the longitudinal or lateral end section. An input signal from the operation portion 201 is input to the main body control base 202, and input to the paper fold controller 100 of the paper folding machine 1, and the paper fold controller 100 performs control of the paper fold operation. Therefore, folding of the end section is controlled by the paper fold controller 100, and rotation and stop control of the end section fold motors 23, 23*a* and of the conveyance motor 30, and control of switching ON/OFF the one-rotation clutches 28, 28*a* are performed based on a detection signal from the leading edge detection sensor 17. By configuring in this manner, folding of the end section can be performed when sending the paper longitudinally or laterally.

Other parts which are not particularly described are configured and function in the same way as in the third embodiment.

The following effects are achieved according to the second modification.

(1) The end section fold portions 2, 2' are provided in the left and right locations with respect to the paper conveyance direction, and further the arrangement angles Q and U of the pairs of fold rollers 15*a*, 15*b*, and 15*a*', 15*b*' are different on the left and right. Therefore, application of pressure in formation of a fold line on the end portion of the paper is possible, and a bend angle by forming a fold line can be bent at least a right angle, whereby a paper jam can be prevented without forming double fold lines due to a mismatch between the fold line of the second folding means and the fold line of the first folding means.

(2) The fold line at the end section is folded strongly, thus, in the case where the folded part is stacked, when filing the paper, the papers can be stored as much as possible.

(3) Fluctuation of a load of drive of the pair of fold rollers can be reduced, the size of the motor can be reduced.

(4) The end section can be folded completely by the two fold rollers, and the roller located downstream of the pair of fold rollers for forming a fold line can be taken as a normal conveying roller instead of the fold roller 15. Accordingly, the cost can be reduced.

(5) The end section can be folded without regard for longitudinal feed or lateral feed of the paper conveyance direction.

(6) By setting the arrangement angle of the end section fold portion, the angle of the fold line of the end section fold portion can be made substantially the same even when the paper conveyance direction is longitudinal feed or lateral feed, and the size of the end section fold portion at the time of lateral feed can be reduced.

(7) End sections of a plurality of types and sizes of papers can be folded while keeping the arrangement angle Q of the end section fold portion for longitudinal conveyance the same angle.

A third modification of the third embodiment is described next.

In the third modification, the configuration of the end section fold portions 2, 2' is different compared to the second modification, thus like reference numerals are used to indicate the same portions, and an overlapping explanation is omitted.

Figure 65:
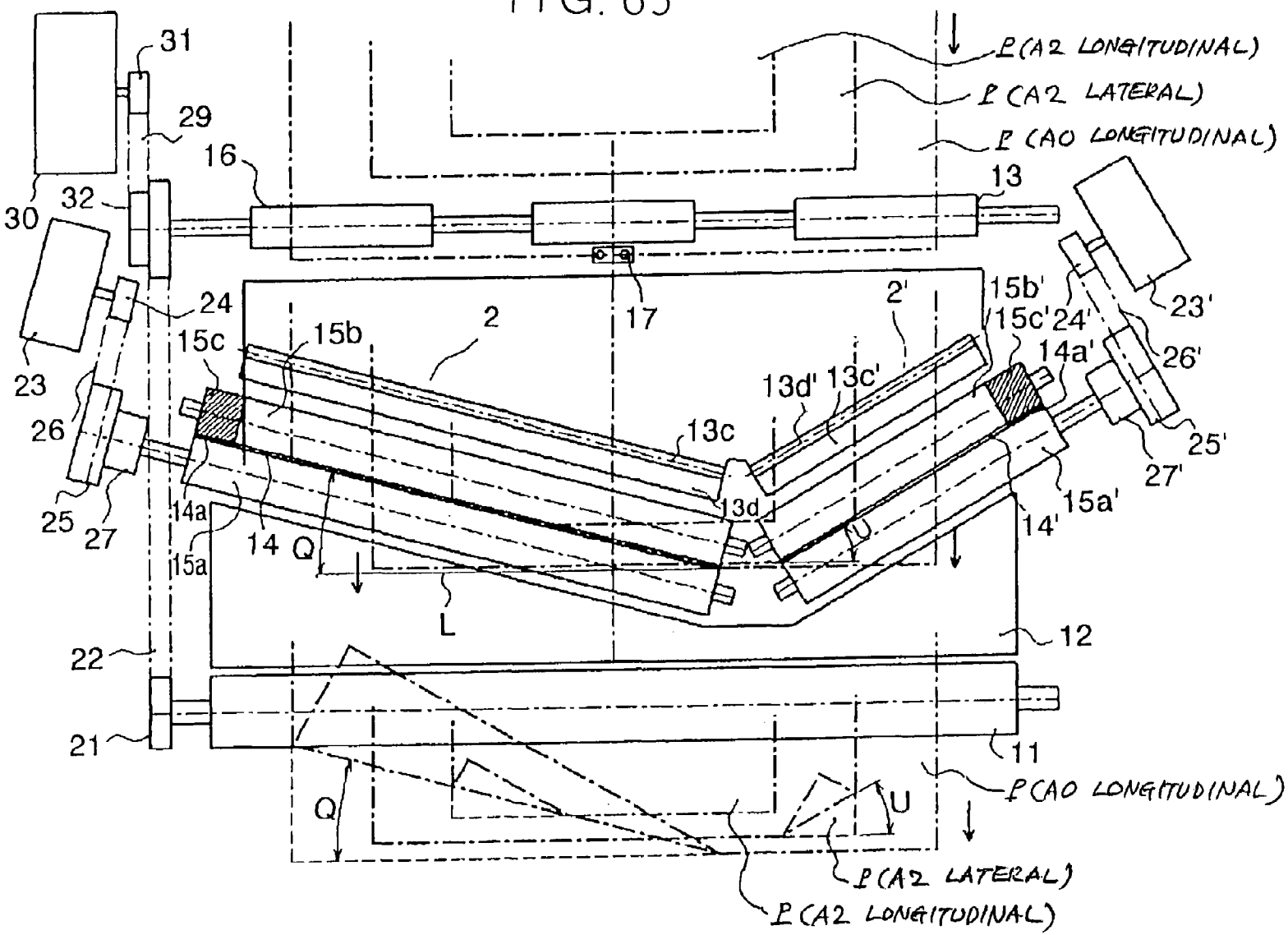
FIG. 65 is a front view showing a configuration of he paper folding machine according to a third modification of the third embodiment.
Figure 66:
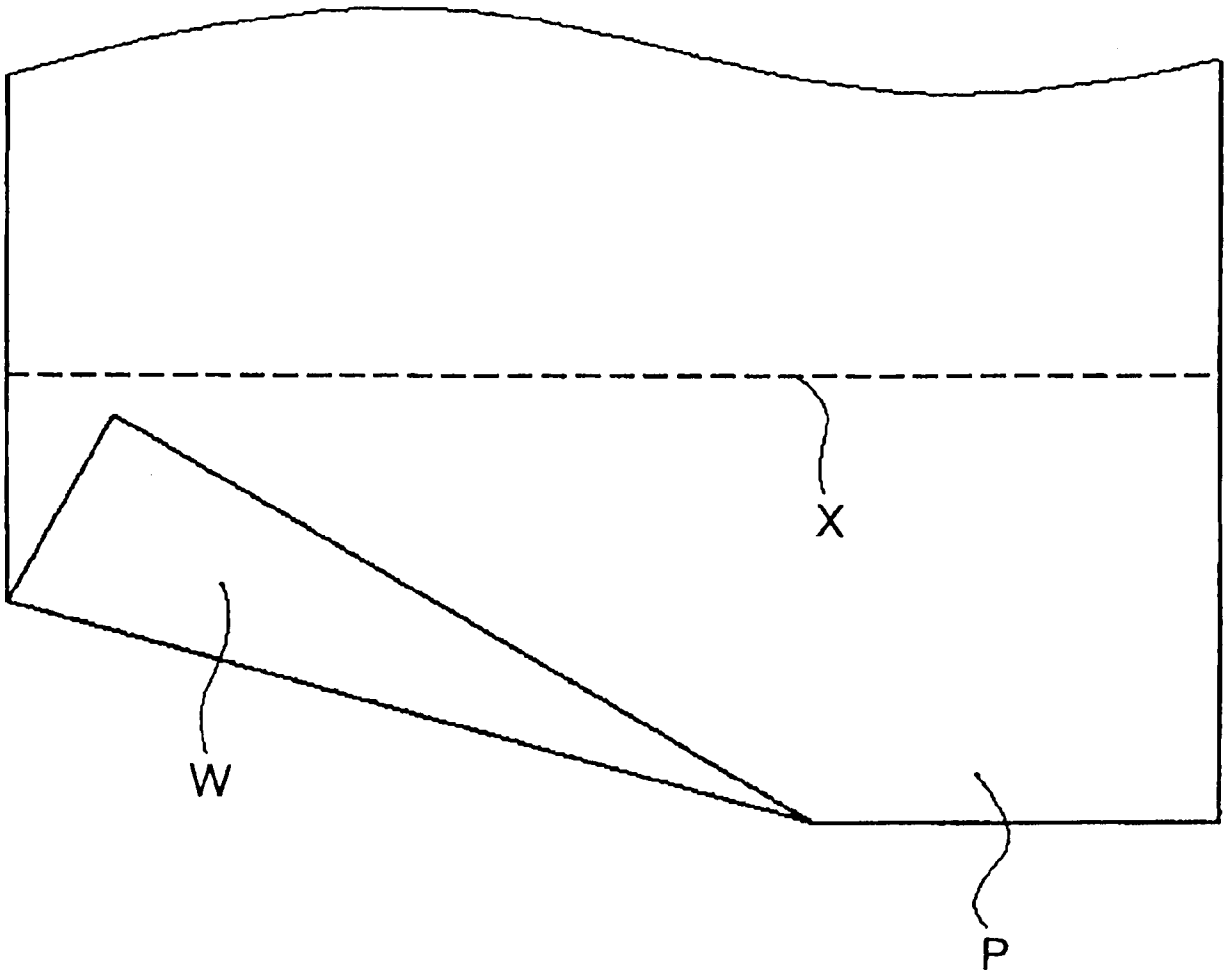
FIG. 66 is a figure showing the relationship between a bellows fold line formed when folding in bellows and the end section fold portion.

In the third modification, as is clear by comparing the third modification with FIG. 13, in the second modification the two end section fold portions 2, 2' disposed on the left and right with respect to the paper conveyance direction were disposed alternately instead of being arranged on the same line perpendicular to the paper conveyance direction. However, they are arranged such that the nip on the central side is positioned on the same line L perpendicular to the paper conveyance direction as shown in FIG. 61. Along with this, the space between the entrance conveying roller 16 and the exit conveying roller 11 is narrowed. The pairs of end section fold rollers 15*a*, 15*b*, and 15*a*', 15*b*' exist in the two end section fold portions 2, 2' respectively, and, as shown in FIG. 65, the arrangement angle Q of the pair of end section fold rollers for longitudinal conveyance 15*a*, 15*b* is set to be equal to 15°, and the arrangement angle U of the pair of end section fold rollers for lateral conveyance 15*a*', 15*b*' is set to be equal to 30°. The arrangement angel Q is an angle at which the end section for A0-size to A2-size paper P can be folded in bellows without causing an end section fold portion W to overlap with a bellows fold line X when folding in bellows as shown in FIG. 66.

Other portions which are not particularly described are configured and function in the same way as in the third embodiment.

The following effects are achieved according to the third modification.

(1) The relationship between the arrangement angle Q of the end section fold portion 2 for longitudinal paper conveyance, and the arrangement angle U of the end section fold portion for lateral paper conveyance is established as a relationship in which the respective end section folding means are arranged on the same line L perpendicular to the paper conveyance direction, thus the en section folding means can be disposed in a small space, the space with respect to the size of the machine can be saved, and the cost can be reduced because of miniaturization of the size of a part.

(2) The arrangement angles Q and U are set to angles at which the end section is folded at a position in which the end section fold portions 2, 2' do not overlap with the bellows fold line X when folding the paper in bellows after folding the end section thereof. Therefore, mismatch of the folded part generated by folding the end section fold portion together with the paper when folding the paper in bellows can be avoided, and the finisher of the paper can be finished neatly.

According to the third embodiment and the modifications thereof, the nip of the two fold rollers is arranged in an angle of a fold line, and the paper is pushed into the nip of the pair of fold rollers by the convex member at the timing at which the position of the fold line on the paper is conveyed to the nip of the two fold rollers, thus even in the case of strong paper such as heavy paper, the shape of the fold of the end section does not fluctuate, and a thin sheaf of papers can be produced even when stacking the folded parts of the papers.

Various modifications will become possible for those skilled in the art after receiving the teachings of the present disclosure without departing from the scope thereof.

What is claimed is:

1. A paper folding apparatus comprising:

a folding unit having two pairs of fold rollers for forming a fold line on a paper which is conveyed, and a convex member configured to form a fold line on the paper, the convex member including a protrusion shape portion extending from the convex member and configured to protrude directly into the nip of the two pairs of fold rollers, wherein a nip of at least one of the two pairs of fold rollers is disposed at an angle of the fold line, and the protrusion shape portion of the convex member pushes the paper into the nip of at least one of the pairs of fold rollers at a position of the fold line of the paper, according to the timing at which the paper is conveyed to the nip of at least one of the two pairs of fold rollers.

2. The paper folding apparatus as claimed in claim 1, wherein the timing at which the convex member is pushed into the nip of at least one of the pairs of fold rollers is set immediately after the leading edge of the conveyed paper passes through the nip of at least one of the pairs of fold rollers.

3. The paper folding apparatus as claimed in claim 1, wherein the speed at which the convex member is pushed into the nip of at least one of the pairs of fold rollers is set to speed slower than the paper conveying speed.

4. The paper folding apparatus as claimed in clam 3, wherein after the convex member is pushed into the nip of at least one of the pairs of fold rollers, the speed at which the convex member is pulled out is set to speed faster than the paper conveying speed.

5. The paper folding apparatus as claimed in claim 1, wherein when folding of a paper end section is not performed on the conveyed paper, at least one of the pairs of fold rollers are always rotated in a paper ejection direction.

6. The paper folding apparatus as claimed in claim 5, wherein the speed at which at least one of the pairs of fold rollers are rotated in the paper ejection direction is set to speed faster than the paper conveying speed.

7. The paper folding apparatus as claimed in claim 1, wherein when the paper is pushed into between at least one of the pairs of fold rollers by the convex member, a paper conveying unit located upstream of the paper conveyance direction is stopped temporarily.

8. The paper folding apparatus as claimed in claim 7, wherein after the convex member is pulled out from at least one of the pairs of fold rollers, the paper conveying speed of the paper conveying unit is increased temporarily.

9. The paper folding apparatus as claimed in claim 1, wherein the folding unit is provided in two locations on the left and right with respect to the paper conveyance direction, and arrangement angles of at least one of the pairs of fold rollers of the left and right folding unit are different.

10. The paper folding apparatus as claimed in claim 9, wherein when each of the arrangement angles of the two pairs of fold rollers is $\theta 1$ for a pair of fold rollers for longitudinal feed of the paper, and $\theta 2$ for a pair of fold rollers for lateral feed of the paper, the relationship between $\theta 1$ and $\theta 2$ is: $\theta 2 > \theta 1$, and $90 - \theta 1 > \theta 2$ (unit is degree).

11. The paper folding apparatus as claimed in claim 10, wherein the arrangement angle $\theta 1$ is set to an angle at which end sections of a plurality of types and sizes of papers can be folded while keeping the same angle.

12. The paper folding apparatus as claimed in claim 9, wherein the relationship between the arrangement angle $\theta 1$ and the arrangement angle $\theta 2$ is set to a relationship of an angle at which the pairs of fold rollers can be arranged respectively on the same line orthogonal to the paper conveyance direction.

13. The paper folding apparatus as claimed in claim 12, wherein the arrangement angles $\theta 1$ and $\theta 2$ are set to angles at which a paper end section is folded in the position in which the end section fold portion does not overlap with a bellows fold line when folding the papers in bellows respectively after folding the end section thereof.

14. The paper folding apparatus as claimed in claim 9, wherein a driving side fold roller of the folding unit is disposed downstream of the paper conveyance direction, and a driven side roller of the folding unit is disposed upstream, the surface of the driving side fold roller is formed with a high friction material, and the surface of the driven side fold roller is formed with a low friction material.

15. The paper folding apparatus as claimed in claim 14, wherein the driving side folding roller, which is made with a metallic material with high degree of hardness, is coated with urethane and constituted with a two-layered roller having high friction characteristic, while the driven side folding roller is a resin roller with high degree of hardness.

16. The paper folding apparatus as claimed in claim 1, wherein the fold rollers are driven via a torque limiter.

17. The paper folding apparatus as claimed in claim 1, wherein a same drive source is configured to drive the fold rollers and the convex member, and a one-rotation clutch is configured to control the timing of driving the convex member.

18. The paper folding apparatus as claimed in claim 1, wherein an angle formed by the paper conveyance direction of the nip of at least one of the fold rollers and the paper conveyance direction of an upstream conveying roller is set to an angle somewhat larger than a right angle.

19. The paper folding apparatus as claimed in claim 1, wherein a paper abutting portion of the convex member is provided with an inclination so as to approach a downstream conveying roller.

20. The paper folding apparatus as claimed in claim 1, wherein a portion outside the paper width of the fold rollers is formed from a material with hardness lower than the material of the rollers abutting on the paper.

21. The paper folding apparatus as claimed in claim 1, wherein a portion outside the paper width of the fold rollers is smaller than the diameter of the rollers abutting on the paper, and the difference of the diameters is less than or equal to the thickness of the convex member.

22. The paper folding apparatus as claimed in claim 1, wherein the folding line is formed on a paper end section side.

23. A paper folding apparatus comprising:

a folding unit including two pairs of fold rollers configured to form a fold line on a paper which is conveyed, and a convex member configured to form a fold line on the paper, wherein a nip of at least one of the two pairs of fold rollers is disposed at an angle of the fold line, and the convex member is configured to push the paper into the nip of at least one of the pairs of fold rollers at a position of the fold line of the paper, according to the timing at which the paper is conveyed to the nip of at least one of the two pairs of fold rollers, and when the convex member enters the nip of at least one of the pairs of fold rollers, the fold rollers rotate in the direction of entrance of the convex member, and when the convex member is pulled out of the fold rollers the fold rollers rotate in the direction in which the convex member is pulled out.

24. A paper conveying apparatus comprising:

a paper folding apparatus, wherein the paper folding apparatus includes, a folding unit having two pairs of fold rollers for forming a fold line on a paper which is conveyed, and a convex member configured to form a fold line on the paper, the convex member including a protrusion shape portion extending from the convex member and configured to protrude directly into the nip of the two pairs of fold rollers, wherein a nip of at least one of the two pairs of fold rollers is disposed at an angle of the fold line, and the protrusion shape portion of the convex member pushes the paper into the nip of at least one of the pairs of fold rollers at a position of the fold line of the paper, according to the timing at which the paper is conveyed to the nip of at least one of the two pairs of fold rollers.

25. A paper processing apparatus comprising:

a paper folding apparatus wherein the paper folding apparatus includes, a folding unit having two pairs of fold rollers for forming a fold line on a paper which is conveyed, and a convex member configured to form a fold line on the paper, the convex member including a protrusion shape portion extending from the convex member and configured to protrude directly into the nip of the two pairs of fold rollers, wherein a nip of at least one of the two pairs of fold rollers is disposed at an angle of the fold line, and the protrusion shape portion of the convex member pushes the paper into the nip of at least one of the pairs of fold rollers at a position of the fold line of the paper, according to the timing at which the paper is conveyed to the nip of at least one of the two pairs of fold rollers.

26. An image forming apparatus comprising:

a paper folding apparatus, wherein the paper folding apparatus includes, a folding unit having two pairs of fold rollers for forming a fold line on a paper which is conveyed, and a convex member configured to form a fold line on the paper, the convex member including a protrusion shape portion extending from the convex member and configured to protrude directly into the nip of the two pairs of fold rollers, wherein a nip of at least one of the two pairs of fold rollers is disposed at an angle of the fold line, and the protrusion shape portion of the convex member pushes the paper into the nip of at least one of the pairs of fold rollers at a position of the fold line of the paper, according to the timing at which the paper is conveyed to the nip of at least one of the two pairs of fold rollers.

27. An image forming apparatus comprising:

a paper processing apparatus integrally or separately, wherein the paper processing apparatus includes, a paper folding apparatus which includes, a folding unit having two pairs of fold rollers for forming a fold line on a paper which is conveyed, and a convex member configured to form a fold line on the paper, the convex member including a protrusion shape portion extending from the convex member and configured to protrude directly into the nip of the two pairs of fold rollers, wherein a nip of at least one of the two pairs of fold rollers is disposed at an angle of the fold line, and the protrusion shape portion of the convex member pushes the paper into the nip of at least one of the pairs of fold rollers at a position of the fold line of the paper, according to the timing at which the paper is conveyed to the nip of at least one of the two pairs of fold rollers.

* * * * *